US006099380A

United States Patent [19]

Rasmussen

[11] Patent Number: 6,099,380

[45] **Date of Patent: *Aug. 8, 2000**

[54] TRANSFORMING PLAYSET

[75] Inventor: Russ Rasmussen, Petaluma, Calif.

[73] Assignee: Lewis Galoob Toys, Inc., South San Francisco, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/522,512

[22] Filed: Sep. 1, 1995

[51] Int. Cl.[7] ..... A63H 33/42

[52] U.S. Cl. ..... 446/478; 446/476

[58] Field of Search ..... 446/80, 152, 476, 446/478, 487, 71, 147, 148, 489, 491, 151

[56] References Cited

U.S. PATENT DOCUMENTS

| | | | |
|---|---|---|---|
| 1,199,413 | 9/1916 | Peyser . | |
| 1,661,429 | 3/1928 | Jade | 446/476 |
| 3,768,175 | 10/1973 | Hill et al. | 446/487 |
| 4,026,066 | 5/1977 | Reiner et al. | 46/47 |
| 4,467,556 | 8/1984 | Iwao et al. | 446/230 |
| 4,477,999 | 10/1984 | Harigai et al. | 446/470 |
| 4,508,519 | 4/1985 | Becker | 446/478 |
| 4,575,348 | 3/1986 | Wiggs et al. | 446/310 |
| 4,599,078 | 7/1986 | Obara | 446/95 |
| 4,623,317 | 11/1986 | Nagano | 446/289 |
| 4,680,018 | 7/1987 | Ohno | 446/376 |
| 4,680,022 | 7/1987 | Horshino et al. | 446/487 |
| 4,750,895 | 6/1988 | Shinohara et al. | 446/230 |
| 4,755,159 | 7/1988 | Templeton et al. | 446/478 |
| 4,762,511 | 8/1988 | Lee et al. | 446/6 |
| 4,865,574 | 9/1989 | Kobayashi | 446/487 |
| 4,867,723 | 9/1989 | Asbach | 446/478 |
| 5,019,010 | 5/1991 | Nikaido et al. | 446/487 |
| 5,069,650 | 12/1991 | Lehmann et al. | 446/476 |
| 5,183,427 | 2/1993 | Draper | 446/478 |
| 5,310,378 | 5/1994 | Shannon | 446/268 |
| 5,580,296 | 12/1996 | Chow | 446/487 |
| 5,971,833 | 10/1999 | Rasmussen et al. | 446/478 |

FOREIGN PATENT DOCUMENTS

| | | | |
|---|---|---|---|
| 491235 | 3/1953 | Canada | 446/152 |
| 2135591 | 9/1984 | United Kingdom | 446/478 |
| 2159721 | 11/1985 | United Kingdom | 446/487 |
| 2 184 663 | 5/1986 | United Kingdom | A63H 13/16 |

*Primary Examiner*—Robert A. Hafer
*Assistant Examiner*—Jeffrey D. Carlson
*Attorney, Agent, or Firm*—Dergosits & Noah LLP

[57] ABSTRACT

A transformable playset is reversibly configurable from a first environmental scene into a second environmental scene. A single actuator initiates reversible transformation via configuring means contained in the playset.

9 Claims, 39 Drawing Sheets

TRANSFORMING PLAYSET

BACKGROUND OF THE INVENTION

1. Field of the Invention

The present invention relates to toys which are capable of reversibly transforming from one configuration to another configuration.

2. Description of Related Art

Toys which transform from one shape to another are well-known in the art. Such toys are attractive because they allow the user to play with and fantasize about the interchangeability of the shapes. Transformable toys usually involve a vehicle such as a car or truck which is manually converted into a different car, truck, airplane or armored vehicle or into a vaguely humanoid robot by manipulating various pivoting or sliding members by hand. Examples of such transformable toys are provided in U.S. Pat. Nos. 4,477,999, 4,599,078, 4,623,317, 4,680,018, and 4,750,895. A transformable toy which includes spring elements operable to drive segments of the toy to spring open upon release of a fastener holding the segments in a closed position is provided in U.S. Pat. No. 5,310,378.

There is a continuing need for toys which are capable of stimulating the imagination. Transformable toys are certainly capable of doing so. The present invention provides transformable playsets which are easy to operate and further, provides structural transformation to a degree heretofore unknown.

SUMMARY OF THE INVENTION

The present invention provides a playset that reversibly transforms from one environmental scene to another via a mechanical transformation triggered by a single actuator. A transformable playset includes a first structure configurable into at least a second structure and a third structure configurable into at least a fourth structure. An actuator is connected to a first configuring means and to a second configuring means. The first configuring means is configured to cause the first structure to be configured into the at least a second structure and the second configuring means is configured to cause the third structure to be configured into the at least a fourth structure. The actuator is capable of causing the first and third structures to be transformed simultaneously or sequentially into the at least second and at least fourth structures. The actuator is also capable of causing the at least second structure and the at least fourth structure to be simultaneously or sequentially back-transformed into the first and third structures.

In another aspect, a transformable playset includes an actuator connected to a building structure having component parts configured to be reversibly transformable between a first building structure and a second building structure. A first manipulation of the actuator causes the first structure to be transformed into the second structure and a second manipulation of the actuator causes the second structure to be transformed into the first structure.

In yet another aspect, a transformable playset includes a structure including configuring means depending from an actuator such that actuation of the configuring means with the actuator causes the structure to reversibly transform from the appearance of a first environment to the appearance of a second environment.

In still yet another aspect, a transformable playset includes an actuator connected to a building structure having component parts configured to be reversibly transformed into automobile track environment. A first manipulation of the actuator causes the building structure to be transformed into the automobile track environment and a second manipulation of the actuator causes the automobile track environment to be transformed into the building structure.

In still yet another aspect, a transformable playset includes an actuator connected to an above-ground military missile launcher site structure having component parts configured to be reversibly transformed into a multilevel structure. A first manipulation of the actuator causes the above-ground military missile launcher site structure to be transformed into the multilevel structure and a second manipulation of the actuator causes the multilevel structure to be transformed into the above-ground military missile launcher site structure.

DETAILED DESCRIPTION OF THE INVENTION

Transformable playsets according to the present invention provide reconfigurable structures and environments that are achieved with a minimum of effort on the part of the operator. A single actuator allows the operator to shift back and forth between one environmental scene and another related or unrelated environmental scene. When related environments are incorporated, the operator is free to imagine stories that are woven around and extended by the shifting environments. The various embodiments described below illustrate the versatility of the present invention, i.e., other possible environments or scenes are limited only by the imagination of the ordinary artisan skilled in the art.

Figure 1:
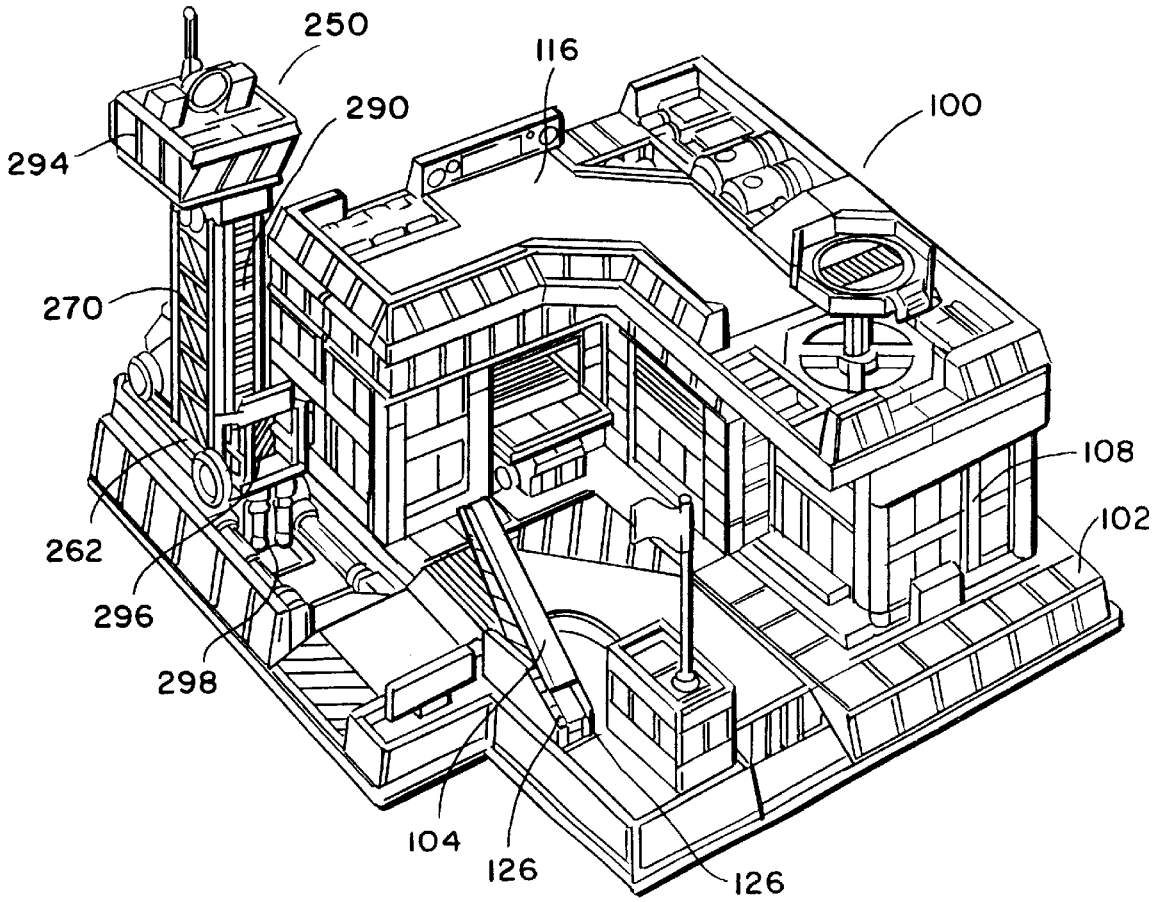
FIG. 1 is a perspective front view of one embodiment of a transforming playset having fanciful detailing in a first configuration according to the present invention.
Figure 2:
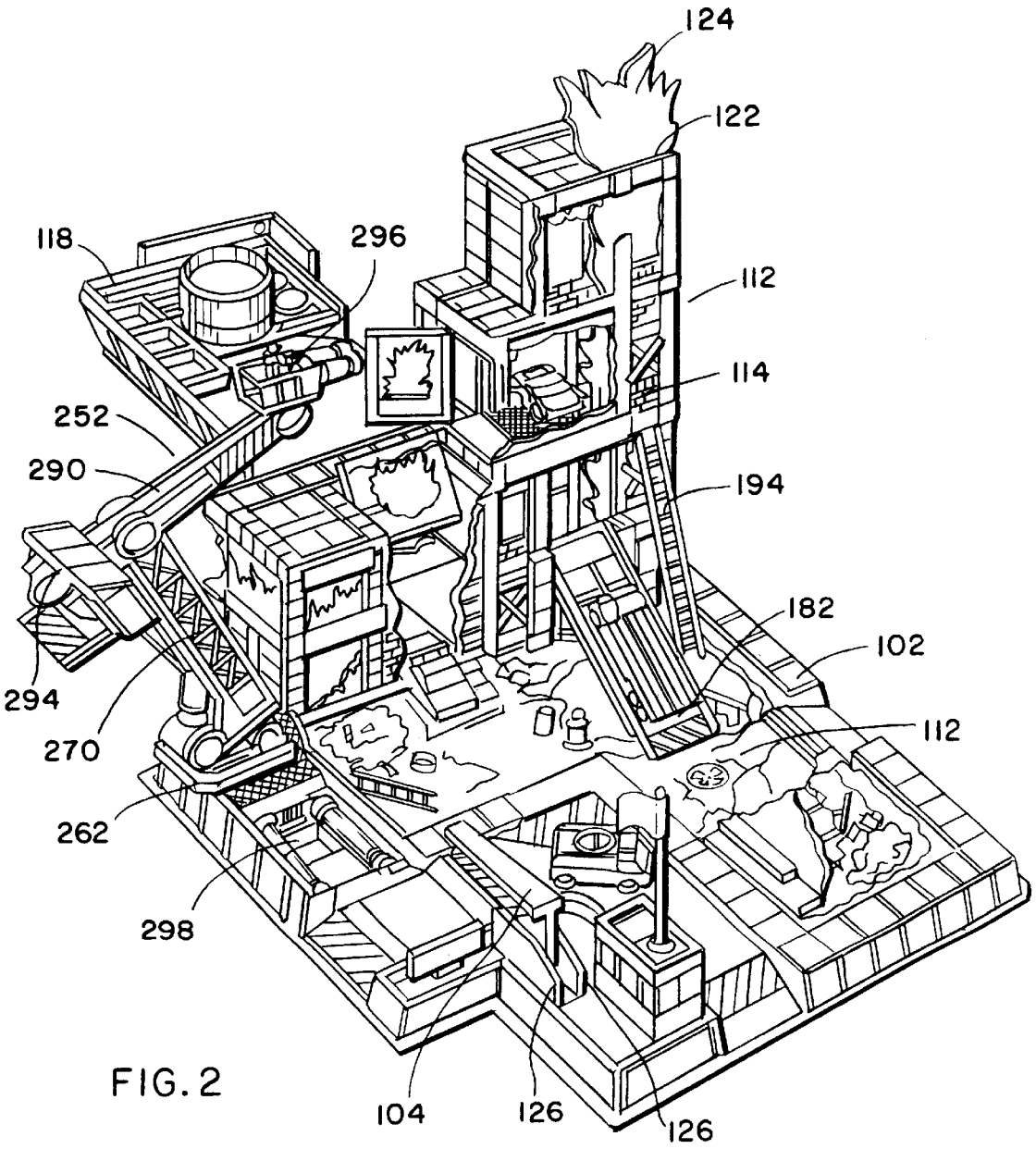
FIG. 2 is a perspective front view of the transforming playset having fanciful detailing illustrated in FIG. 1 in a second configuration.
Figure 3:
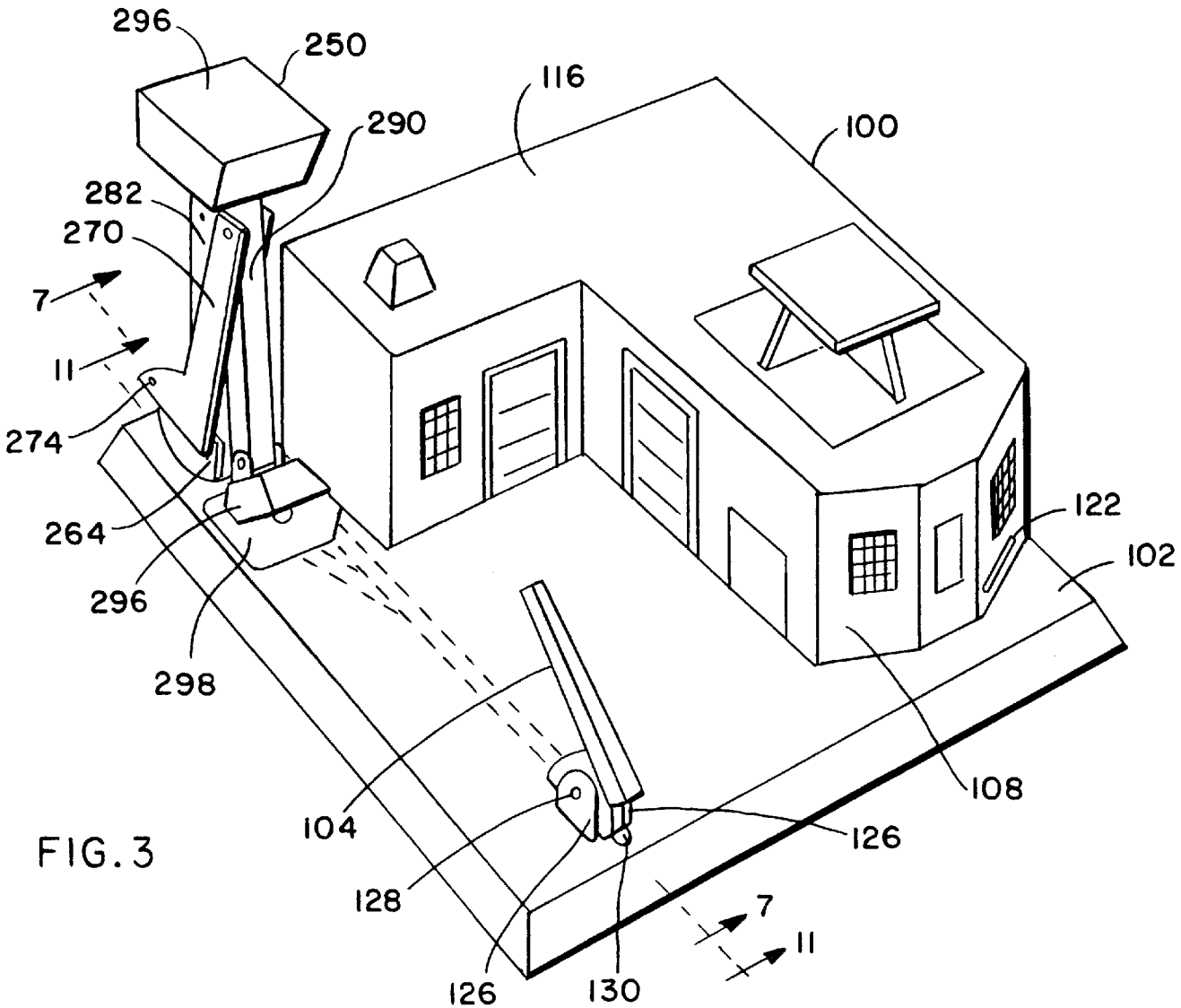
FIG. 3 is a perspective front view of a stripped embodiment of the transforming playset in first configuration illustrated in FIG. 1.
Figure 4:
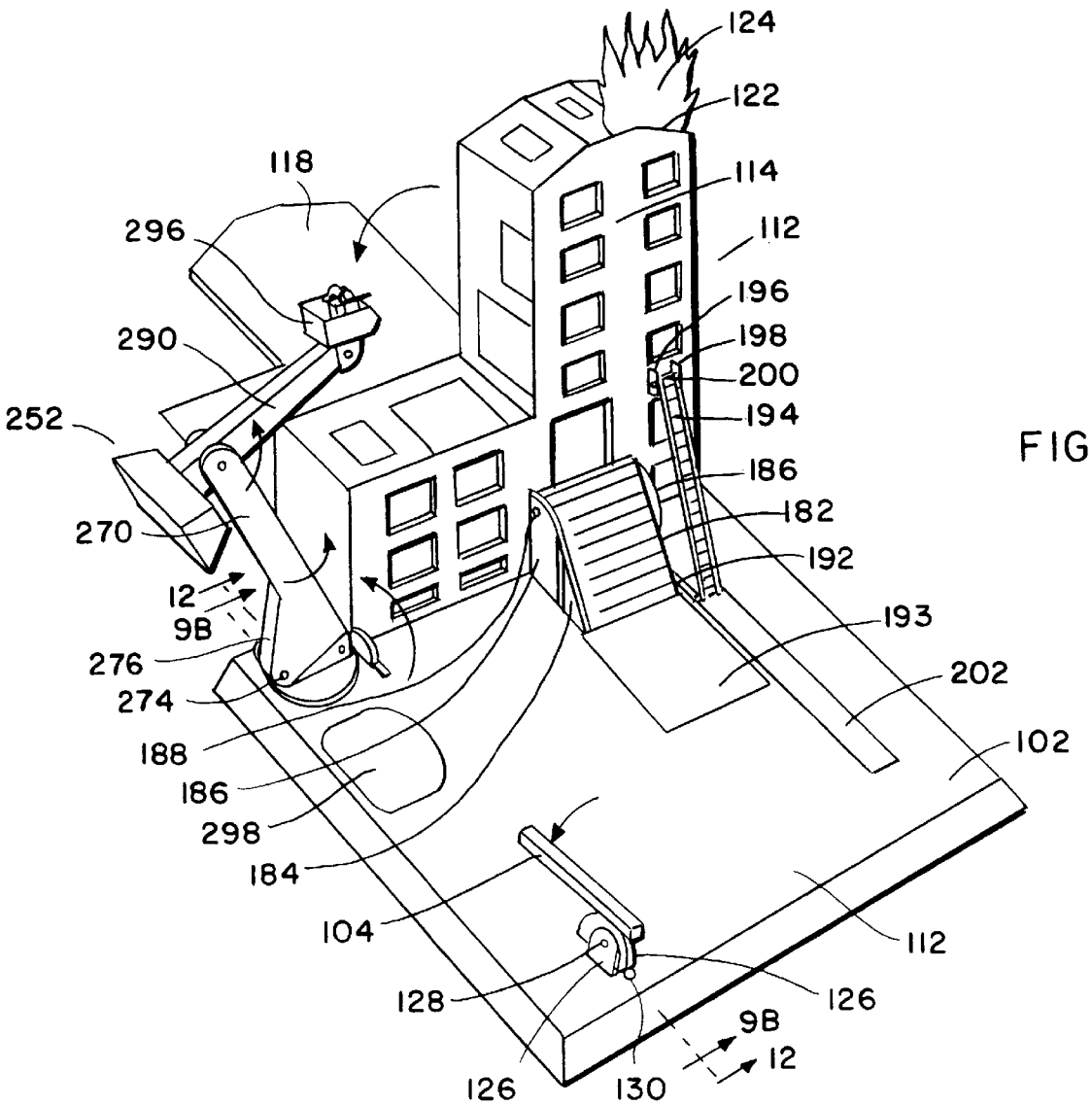
FIG. 4 is a perspective front view of the transforming playset illustrated in FIG. 3 in a second configuration.
Figure 5:
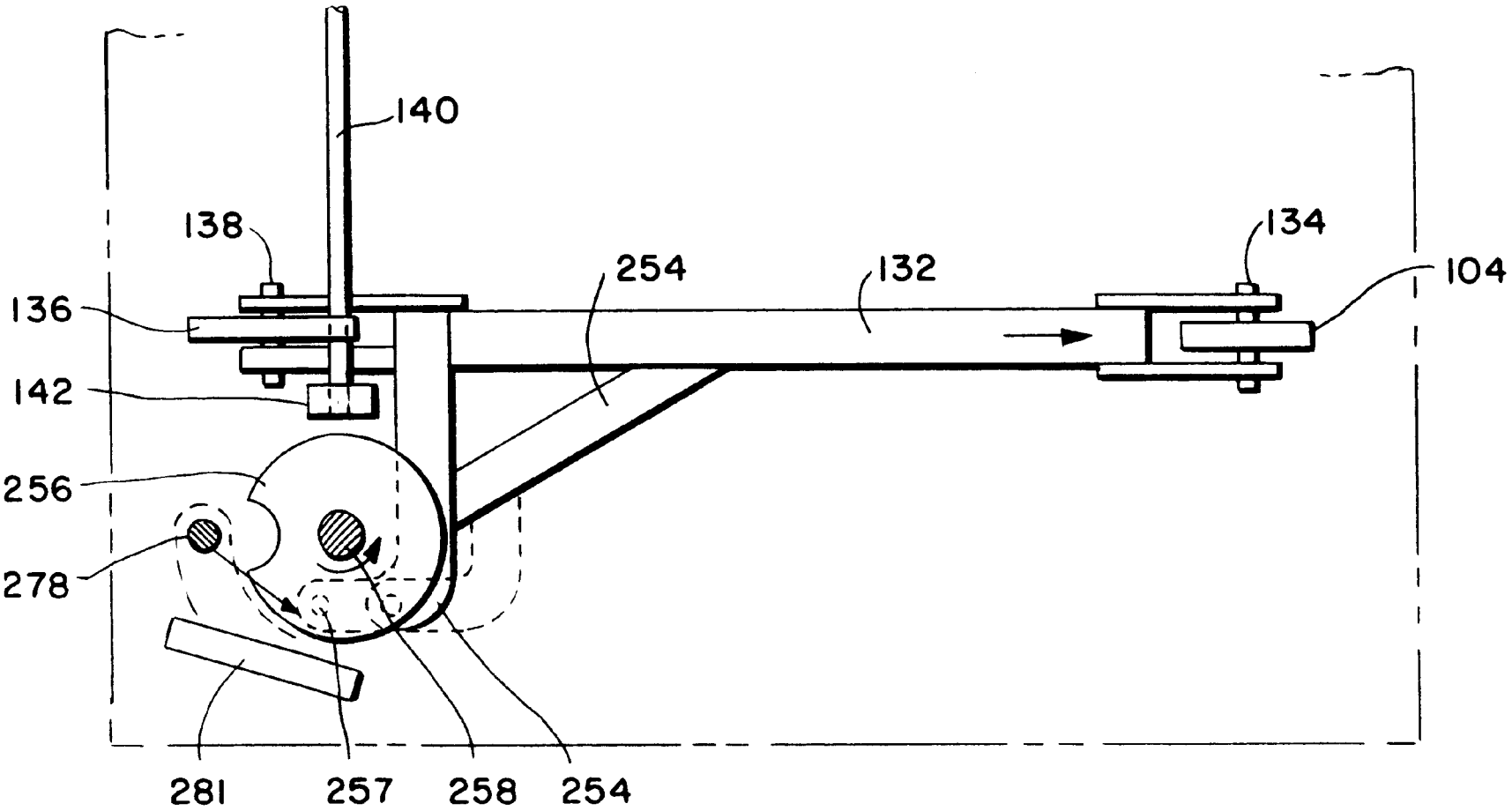
FIG. 5 is a fragmentary top view of a portion of an actuator and first configuring means and a portion of second configuring means while in the first configuration.
Figure 6:
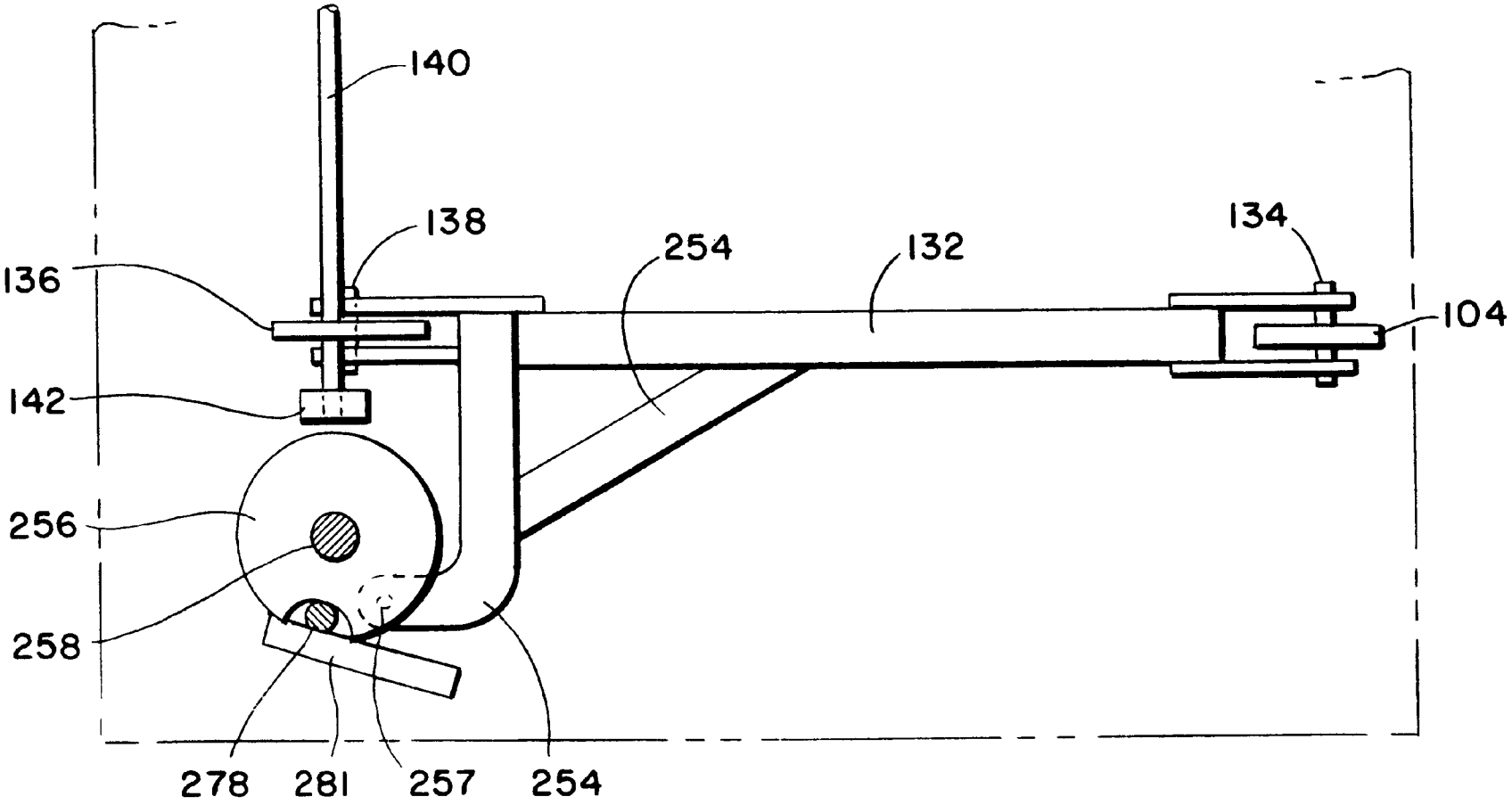
FIG. 6 is a fragmentary top view of the portion of the actuator and first configuring means and the portion of second configuring means shown in FIG. 5 while in the second configuration.
Figure 7:
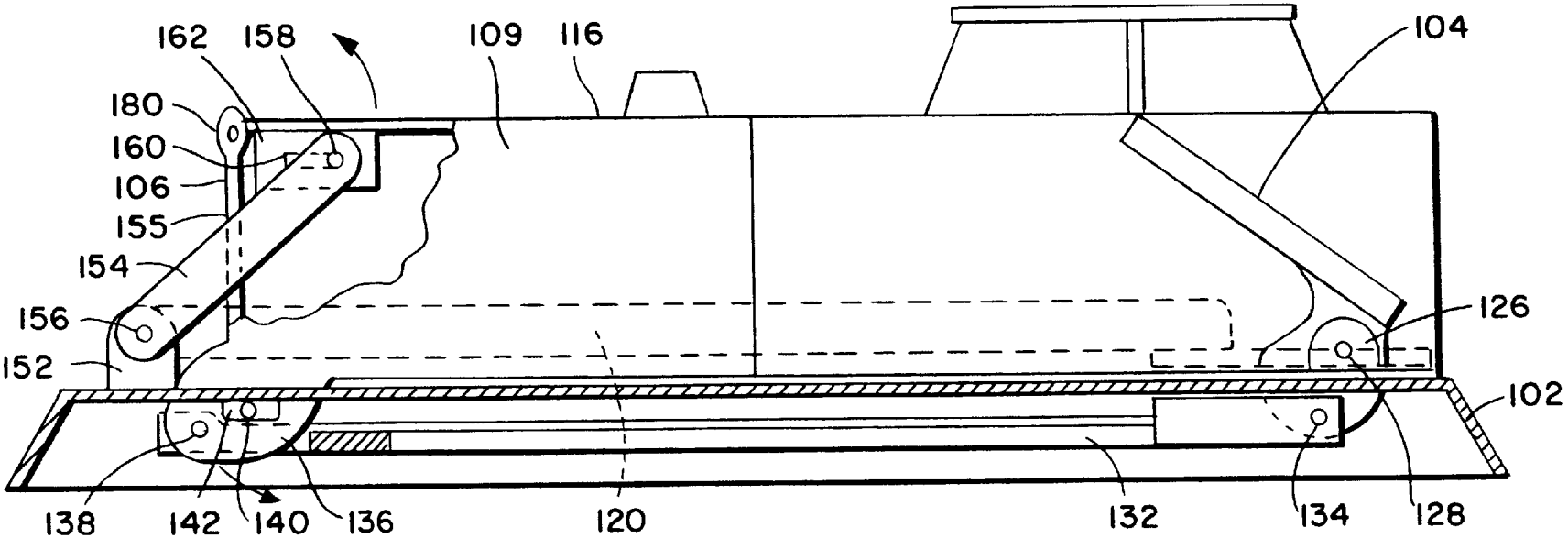
FIG. 7 is a partial cut-away side view of the actuator and first configuring means in first structure orientation in the first configuration taken along lines 7—7 illustrated in FIG. 3.

In one embodiment illustrated in FIGS. 1 through 12, the playset mechanically transforms from a firehouse environment to the scene of a burning warehouse by manipulation of a single actuator connected to configuring means. Further manipulation of the actuator causes the configuring means to reconfigure the burning warehouse scene into the firehouse environment. For convenience, the firehouse environment, which is illustrated in FIGS. 1 and 3, will also be referred to as the first position and the burning warehouse environment, which is illustrated in FIGS. 2 and 4, will also be referred to as the second position. FIGS. 1 and 2 illustrate certain fanciful detailing which, although not essential for operation of this embodiment of the present invention, is included to provide an aesthetic aspect. FIGS. 3 and 4 illustrate a "stripped" version of the present embodiment which depicts the playset without much of the fanciful detailing included in FIGS. 1 and 2. For convenience, corresponding structures in FIGS. 1 through 12 will be provided with the same reference numbers. For example, the firehouse 100 in FIG. 1 corresponds to the firehouse 100 in FIG. 3.

The firehouse environment includes two structures, namely, a firehouse 100 and a communication tower 250. The burning warehouse environment includes a multistory building 112 and a snorkel tower 252.

In transforming from the first position the second position, the single story firehouse 100 is pivotally mounted to a base 102 such that upon manipulation of an actuator 104 (a gate in this embodiment), the firehouse 100 pivots at the bottom of its rear wall 106 (see FIGS. 7–9) thus causing the firehouse front 108 to swing up along a 90 degree arc as the firehouse floor 110 becomes perpendicular to the base 102. The firehouse floor 110 is designed and configured to have the appearance of the front of a multistory building 112 on its exterior face 114. The firehouse roof 116 is pivotally mounted to the top of the rear wall 106 such that upon actuation, the roof 116 opens and flips over 180 degrees to present its interior face 118 which is designed and configured to have the appearance of a backyard to the multistory building 112. The portion of the base 102 underlying and concealed by the firehouse floor 110 is exposed when the firehouse 100 swings up and is designed and configured to have the appearance of the front yard of the building 112.

As the firehouse 100 swings up, an interiorly contained elongate member 120, which has one end pivotally mounted to the base 100 and is slidably supported within the interior of the firehouse 100, slides thorough a slit 122 in the firehouse front 108, thus presenting a decoration 124 mounted at the other end of the elongate member 120 through the slit 122 as the firehouse 100/multistory building 112 reaches its apex. In the case of a burning building, the decoration 124 is designed and configured to give the appearance of flame.

In this embodiment, in addition to the above, the actuator and configuring means include a variety of elements more particularly described as follows. The actuator 104 is pivotally mounted to a two-pronged support 126 by an actuator support pin 128 which extends through the actuator 104 and is held in the prongs of the support 126. The support 126 is fixedly mounted to the base 102. A lower portion of the gate actuator 104 extends through a slot 130 in the base 102; the lower portion being pivotally mounted to a push rod 132 by an actuator pivot pin 134. As can be seen in FIGS. 5–8 and 9B the push rod 132 extends along the underside of the base 102 until it pivotally mates with the lower portion of a first building support pivot boss 136. A pin 138 maintains a pivotal connection between the push rod 132 and the lower portion of the first building support pivot boss 136. A building support pivot boss mounting rod 140 extends along the underside of the base 102 where one end of the building support pivot boss mounting rod 140 perpendicularly pivotally intersects with, supports and continues through the central portion of the first building support pivot boss 136 and is thereafter fixedly mounted to the base 102 at mount 142. The other end of the building support pivot boss mounting rod 140 perpendicularly pivotally intersects with, supports and continues through the central portion of a second building support pivot 144 and is thereafter fixedly mounted to the base 102 at a mount (not shown) which corresponds to mount 142.

As can be seen in FIGS. 7–9B, the first building support pivot boss 136 extends upwardly through a first building support pivot boss slot 148 in the base 102 and is rigidly affixed to the corner portion formed by the intersection of the firehouse rear wall 106, the first firehouse side wall 109 and the firehouse floor 110. The second building support pivot boss 144 extends upwardly through a second building support pivot boss slot (not shown but corresponds to first building support pivot boss slot 148) in the base 102 and is rigidly affixed to the corner portion formed by the intersection of the firehouse rear wall 106, the second firehouse side wall 111 and the firehouse floor 110.

A first upwardly extending base boss 152 is mounted to the base 102 adjacent to and slightly behind the first building support pivot slot 148 and pivotally supports a first roof lifting arm 154. One end of the first roof lifting arm 154 is pivotally held to the first base boss 152 by a pin 156 which extends through and is held at the center of the first base boss 152. The first roof lifting arm 154 extends through a slot 155 located in the firehouse rear wall 106 adjacent to the first firehouse side wall 109, where it enters the interior of the firehouse 100 and extends to and slidably engages a first roof boss 162. More particularly, the other end of the first lifting arm 154 has an inwardly extending pin 158 which slidably engages a slot 160 contained in the first roof boss 162. The first roof boss 162 is fixedly mounted to the inside of the firehouse roof interior face 118 at the corner formed at the intersection of the firehouse roof 116, the firehouse rear wall 106 and the first firehouse side wall 109.

A second upwardly extending base boss 164 is mounted to the base 102 adjacent to and slightly behind the second building support pivot slot 150 and pivotally supports a second roof lifting arm 166 which is located adjacent to the interior of the second firehouse side wall 111. One end of the second roof lifting arm 166 is pivotally held to the second base boss 164 by a pin 168 which extends through and is held at the center of the second base boss 164. The second roof lifting arm 166 extends through a slot 169 located in the firehouse rear wall 106 adjacent to the second firehouse side wall 111 where it enters into the interior of the firehouse 100 and extends to slidably engages a second roof boss 174. More particularly, the other end of the second roof lifting arm 166 has an inwardly extending pin 170 which slidably engages a slot 172 contained in the second roof boss 174. The second roof boss 174 is fixedly mounted to the inside of the firehouse roof interior face 118 at the corner formed at the intersection of the firehouse roof 116, the firehouse rear wall 106 and the second firehouse side wall 111.

Figure 8:
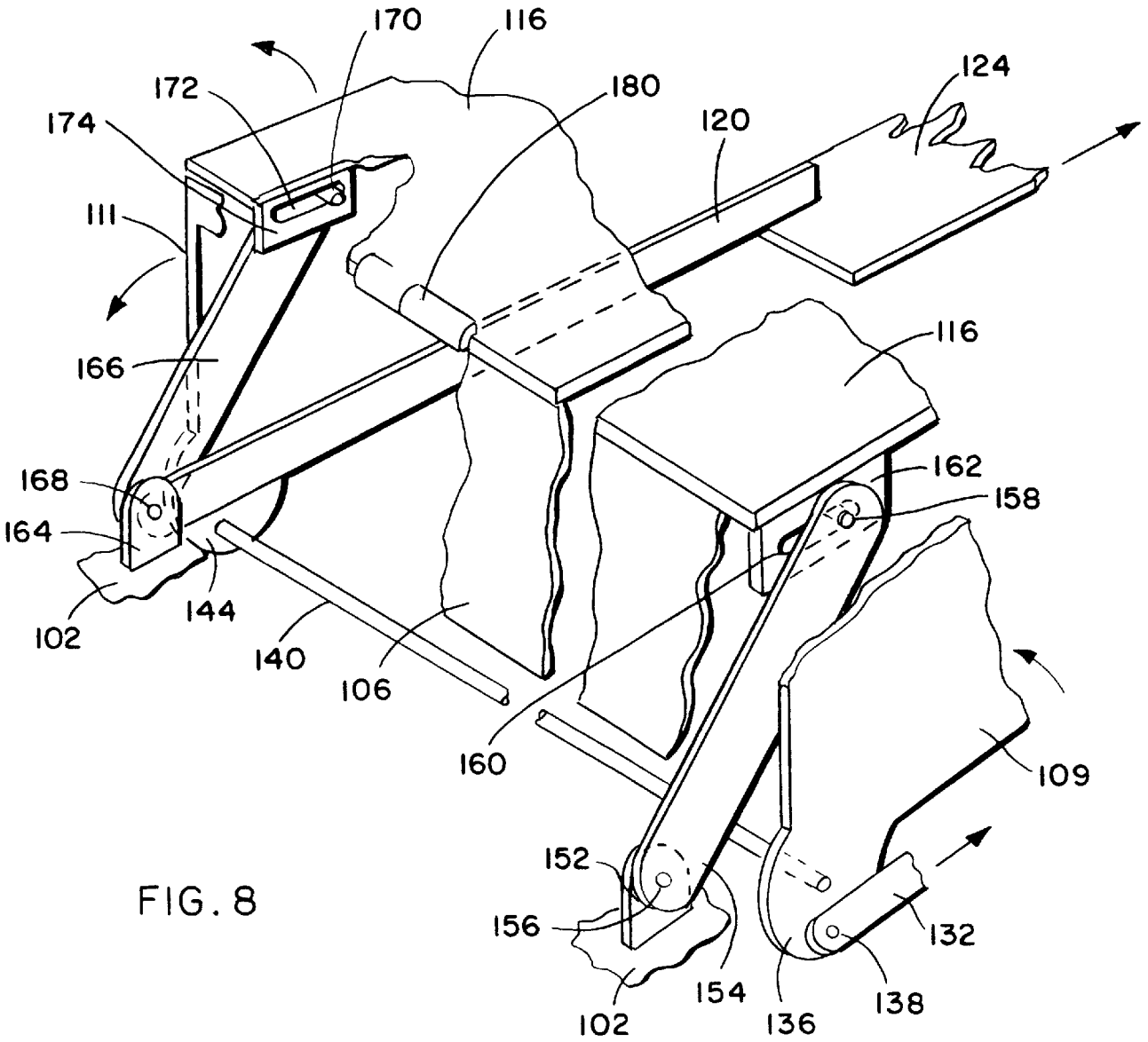
FIG. 8 is a partial fragmentary cutaway rear perspective view of a portion of first configuring means in the first configuration illustrated in FIG. 3.
Figure 9A:
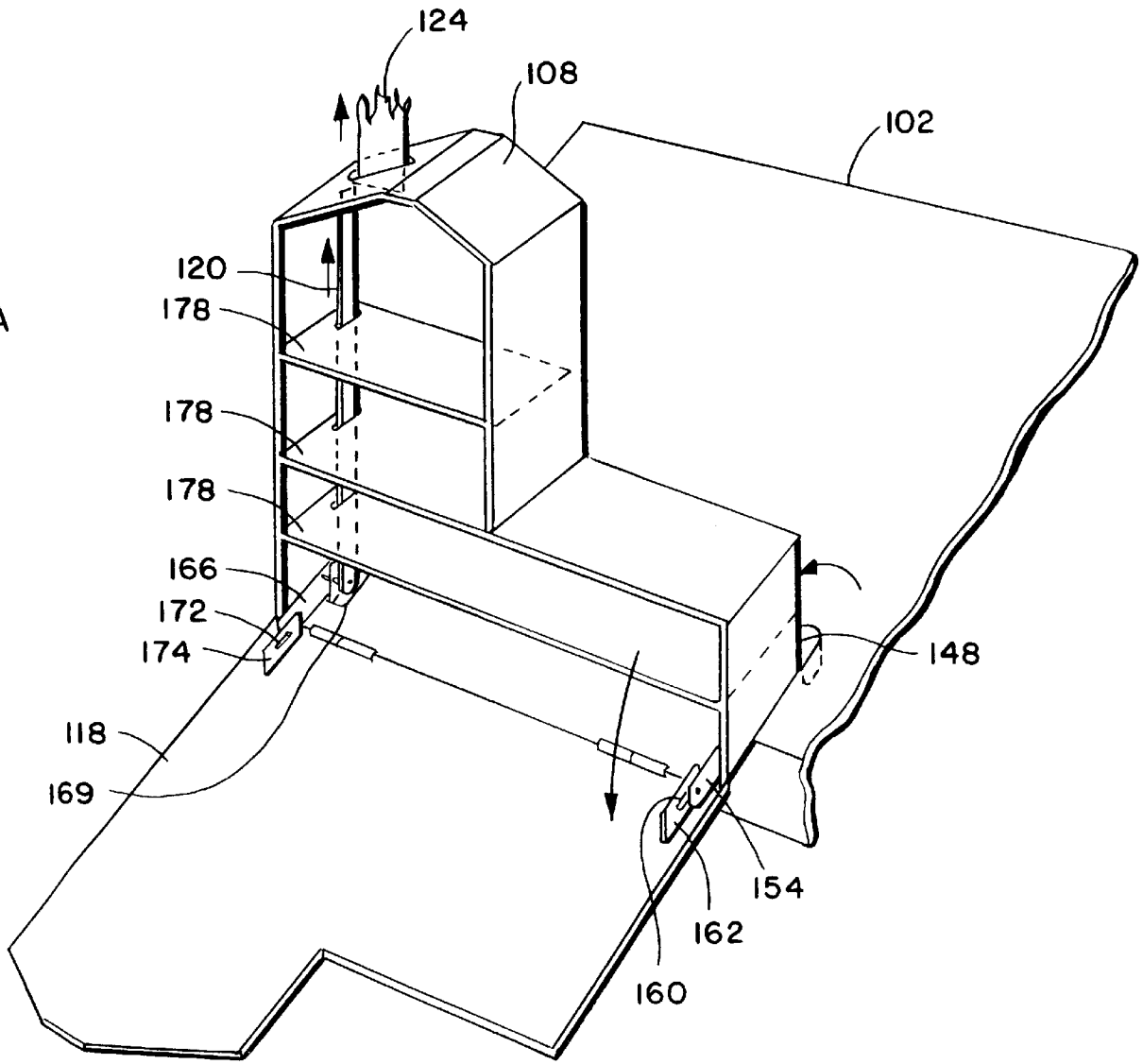
FIG. 9A is a perspective rear view of a portion of first configuring means in the second configuration.
Figure 9B:
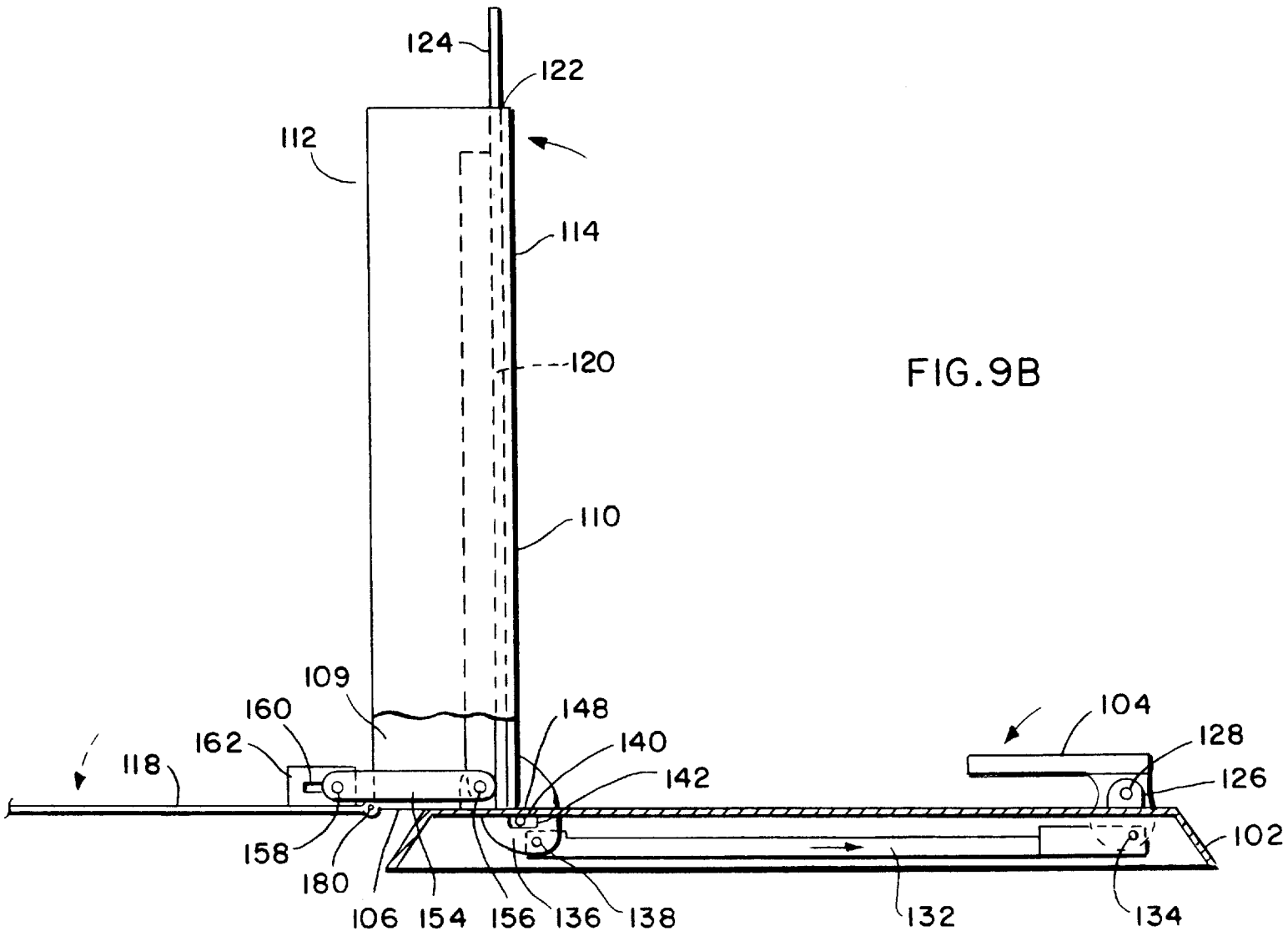
FIG. 9B is a partial cut-away side view of the actuator and first configuring means in second structure orientation in the second configuration taken along lines 9B—9B illustrated in FIG. 4.
Figure 10:
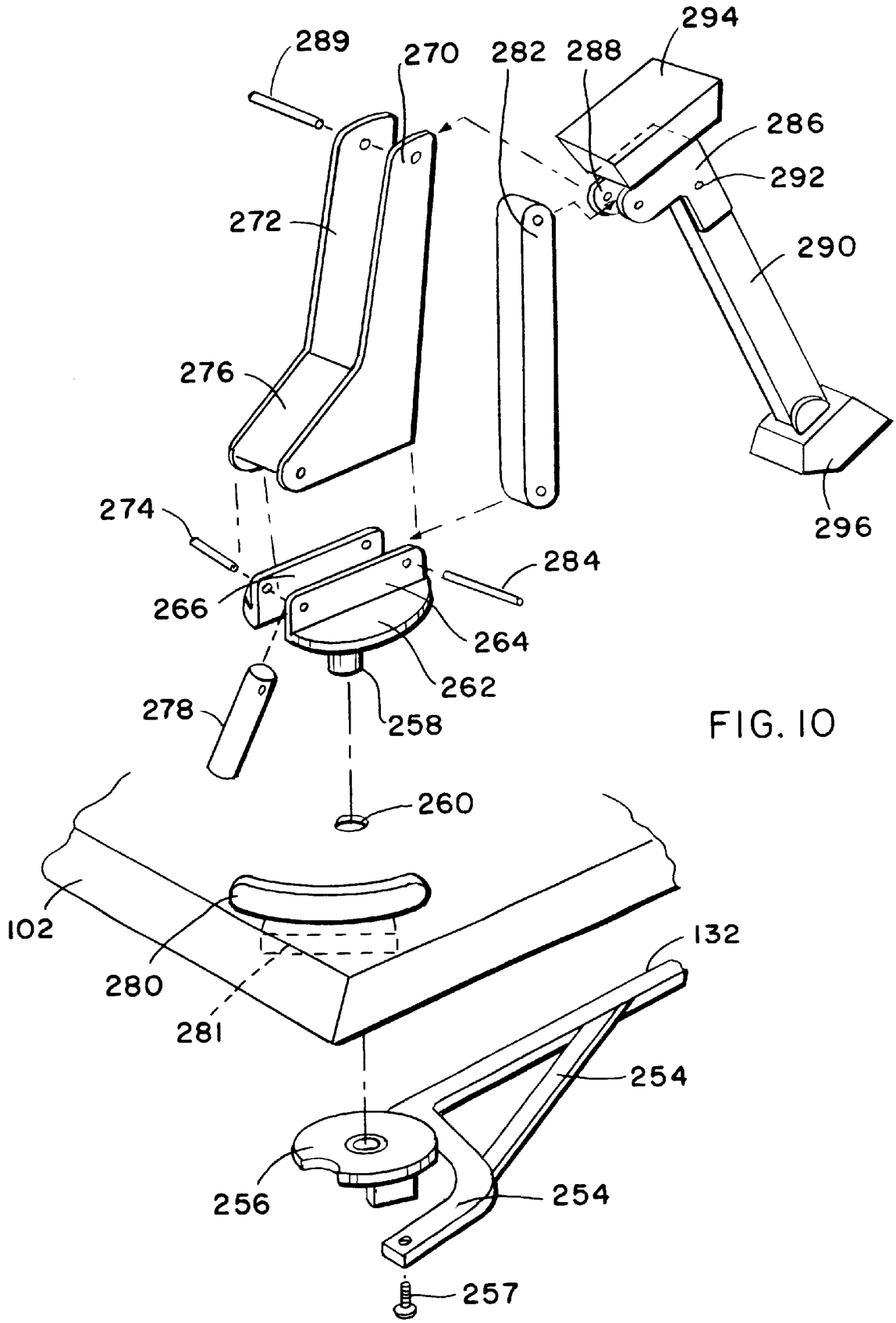
FIG. 10 is an exploded fragmentary perspective view of second configuring means contained in the playset illustrated in FIGS. 3 and 4.
Figure 11:
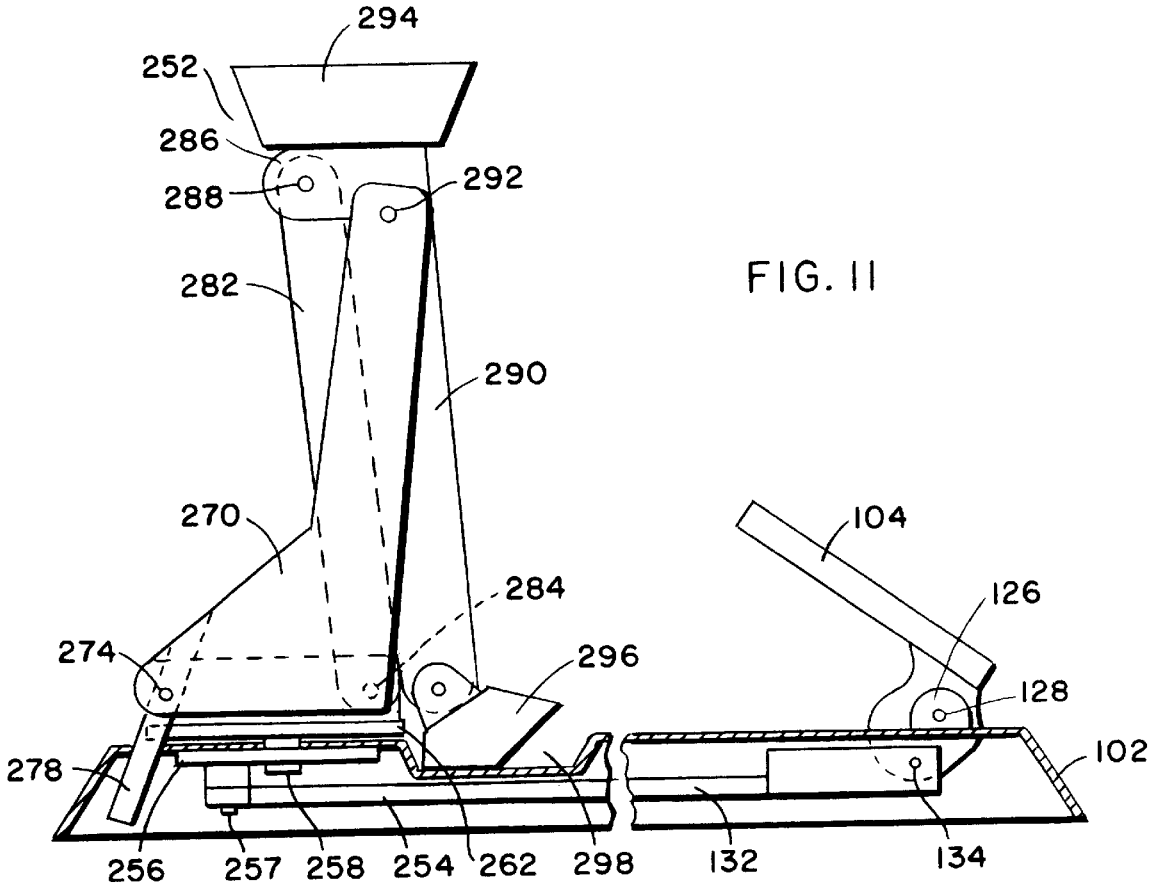
FIG. 11 is a fragmentary side view of the actuator and second configuring means in third structure orientation in the first configuration taken along lines 11—11 illustrated in FIG. 3.
Figure 12:
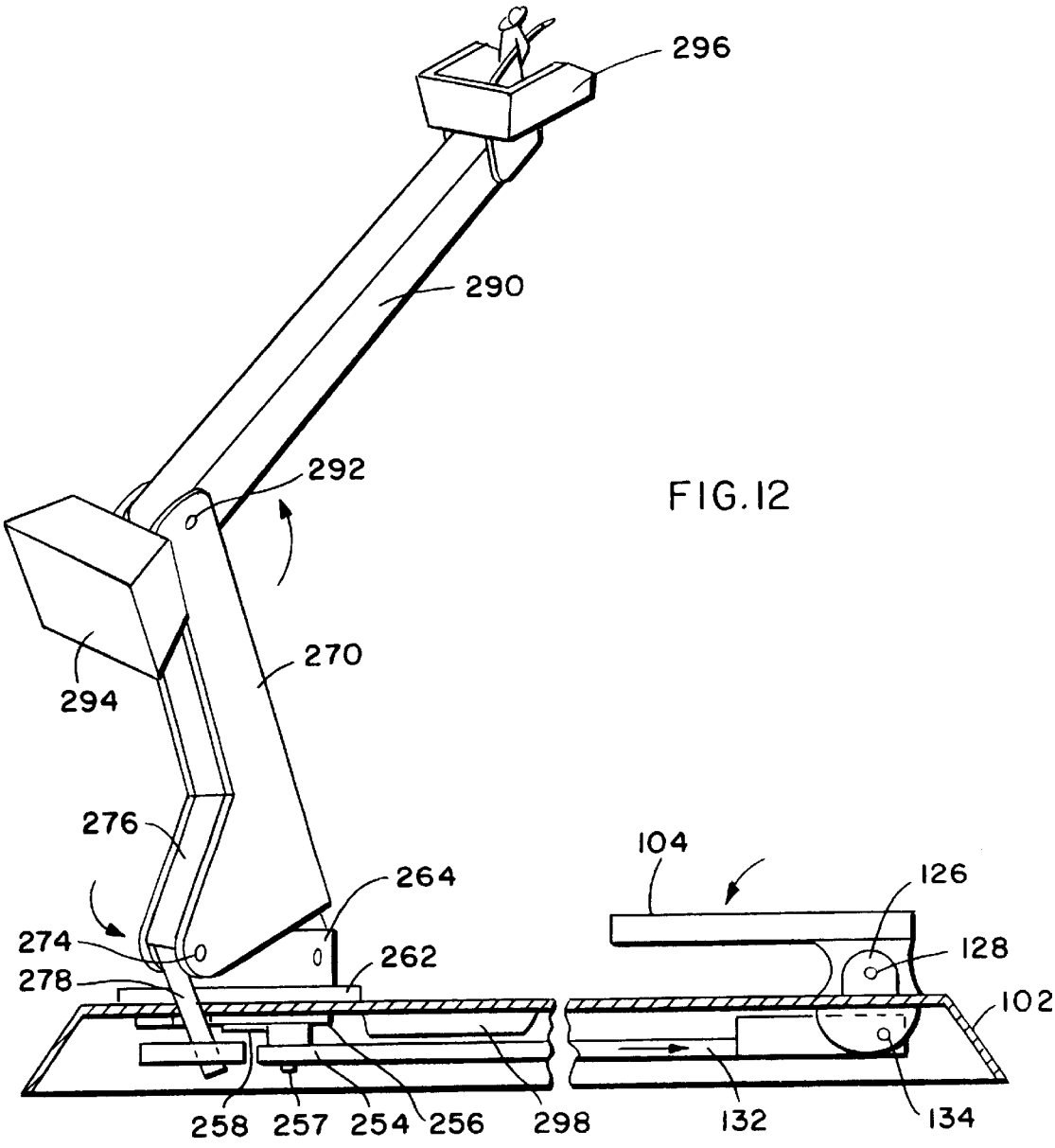
FIG. 12 is a fragmentary side and partial perspective view of the actuator and second configuring means in fourth structure orientation in the second configuration taken along lines 12—12 illustrated in FIG. 4.

The elongate member 120 is pivotally attached at one end by the pin 168 to the side of the second base boss 164 not occupied by the second roof lifting arm 166 as shown in FIGS. 8–9B. The elongate member 120 extends into the interior of the firehouse 100 through the slot 169 and parallel to the second firehouse side wall 111 along the length of the firehouse floor 110, slidably guided by a series of slots 176 contained in the floors 178 of the multistory building 112 and the slit 122 in the firehouse front 108. The firehouse roof 116 is pivotally attached at the top of the firehouse rear wall 106 by roof hinges 180.

As shown in FIGS. 2 and 4, a ramp 182 is pivotally attached at one end by a pin 188 to a central lower portion of the multistory building face 114 between a first building boss 184 and a second building boss 186. A first base slot 190 is configured to allow the first building boss 184 to enter into and received by it when the multistory building face 114 abuts the base 102. Likewise, a second base slot 192 is configured to allow the second building boss 186 to enter into and be received by it when the multistory building face 114 abuts the base 102. A rectangular indent portion 193 contained in the base 102 is configured to receive the ramp 182 when the multistory building face 114 abuts the base 102. A ladder 194 is pivotally attached at one end to a central portion of the multistory building face 114 near the second firehouse side wall 111. The ladder 194 is pivotally held between a third building boss 196 and a fourth building boss 198 by a pin 200. An elongated indent portion 202 contained in the base 102 is configured to receive the ladder 194 when the multistory building face 114 abuts the base 102.

In operation, transformation from the first position to the second position is initiated by pressing down the gate actuator 104 which pivots counterclockwise about the actuator support pin 128 thus pulling back on the push rod 132. As the push rod 132 is pulled back, it acts like a crank and pulls back on the lower portion of the first building support pivot boss 136 which turns counterclockwise around the axis of the building support pivot boss mounting rod 140 thus causing the firehouse 100 to swing upwardly with the building support pivot boss mounting rod 140 acting as a fulcrum. The second building support pivot boss 144 also turns counterclockwise around the axis of the building support pivot boss mounting rod 140 and acts to stabilize and guide the firehouse 100 as it swings upwardly.

As the firehouse 100 swings upwardly, both slots 159 and 169 slide over the first roof lifting arm 154 and the second roof lifting arm 166, respectively, causing the first roof lifting arm 154 and the second roof lifting arm 166 to simultaneously push against the first roof boss 162 and second roof boss 174, respectively, via the inwardly extending pins 158 and 170, which respectively push against their respectively engaged slots 160 and 172. At the same time, the first roof lifting arm 154 and second roof lifting arm 166 pivot about the pins 156 and 168 in the base bosses 152 and 164, respectively, and follow an arc of from about 45 degrees to about 180 degrees when the firehouse roof 116 is completely open. The first roof lifting arm 154 and second roof lifting arm 166 respectively push against the first and second roof bosses 162 and 174 thus pushing the firehouse roof 116 to open and pivot around the roof hinges 180. As the roof 116 is opening and slightly past perpendicular to the base 102, gravity pulls the roof 116 completely open to its full 180 degree span, thus assisting the action of the actuator 104. The open roof 116 presents its underside for viewing which is designed and configured to have the appearance of the backyard of the multistory building 114.

The elongate member 120 which is slidably supported inside the firehouse 100, is pulled up, i.e., it pivots around the axis formed by the pin 168 in the second roof boss 174 and goes from about 0 degrees, i.e, parallel to the base, along an arc to about 90 degrees, i.e., perpendicular to the base, along with the firehouse 100 as it swings up. As the elongate member 120 pivots, it slides up relative to the multistory building face 114 and presents its flaming decoration 124 up through the slit 122.

As the firehouse 100 swings up to present the multistory building face 114, the end of the ramp 182 which is pivotally attached to the multistory building face 114 is raised as the other end of the ramp 182 slides along the base 102. Likewise, the end of the ladder 194 which is pivotally attached to the multistory building face 114 is raised when the firehouse 100 swings up, while the other end of the ladder 194 slides along the base 102. Transformation from the first position to the second position is complete when the actuator 104 no longer moves, the multistory building 112 is perpendicular to the base 102, and the decoration at the end of the elongate member 120 is presented out of the slit 124.

Transformation from the second position to the first position is initiated by lifting the gate actuator 104 which pivots clockwise about the actuator support pin 128 thus pushing the push rod 132 forward. As the push rod 132 moves forward, it pushes the lower portion of the first building support pivot boss 136 which pivots clockwise around the axis of the building support pivot boss rod 140 thus causing the multistory building 112 to swing down clockwise from its upright position perpendicular to the base 102 with the building support pivot boss mounting rod 140 acting as a fulcrum. The second building support pivot boss 144 also pivots clockwise around the axis of the building support pivot boss mounting rod 140 and acts to stabilize and guide the multistory building 112 as it swings downwardly.

As the multistory building 112 swings down, the roof 116 swings up clockwise, initially supported by the roof hinges 180 which are fully extended and do not allow the roof 166 to further pivot in the counterclockwise direction. At the same time, the interior of the firehouse rear wall 106 pushes upwardly against the first and second roof lifting arms 154 and 166 causing them to pivot clockwise while the inwardly extending pins 158 and 170 slide up in their respectively engaged slots 160 and 172. As the first and second roof lifting arms 154 and 166 pivot, they exert a pulling force on the roof 116 by pulling respectively on the first and second roof bosses 162 and 174, thus causing the roof 116 to pivot clockwise about the roof hinges 180 and begin to close. As the roof 116 passes perpendicular to the base 102, gravity also exerts a closing force on the roof 116. It should also be noted that as the multistory building 112 swings past perpendicular it too is pulled down by gravity, thus assisting the actuator 104 during the transformation. As the roof 116 is pulled down, the first and second roof bosses 162 and 174 respectively push against the inwardly extending pins 158 and 170 which gently guide the roof 166 as it swings down, thus preventing the roof 116 from slamming shut.

The elongate member 120 pivots clockwise as the multistory building 112 swings downwardly while the series of slots 176 and slit 122 in the firehouse front 108 slide over the elongate member 120. In this manner, the decoration 124 is seen to retract into the firehouse 100. At the same time, the ends of both the ramp 182 and ladder 194 slide into and are received by their respective indent portions 193 and 202 while pivoting counterclockwise at the pivotal attachment to their respective building bosses 184,186,196 and 198.

Turning now to the transforming towers illustrated in FIGS. 1–4 and 10–12, a communication tower 250 is presented in the firehouse environment. The communication tower 250 is pivotally mounted to the base 102 such that upon manipulation of the actuator 104, the tower 250 rotates counterclockwise and tilts back while opening to present a snorkel tower 252. Upon further manipulation of the actuator 104, the snorkel tower 252 converts back to the communication tower 250 by rotating clockwise and tilting forward while closing. The configuring means which transforms the communication tower 250 into the snorkel tower 252 and back again is connected to the same actuator 104 and pushrod 132 as the configuring means which transforms the firehouse 100 into the multistory building 112. Thus manipulation of the actuator 104 causes transformation of both the firehouse 100 and communication tower 250 into the multistory building 112 and snorkel tower 252, respectively, and further manipulation of the actuator 104 causes the multistory building 112 and snorkel tower 252 to reverse transform into the firehouse 100 and communication tower 250, respectively.

The actuator 104 is connected to the pushrod 132 as described above. See FIGS. 3–6. As illustrated in FIGS. 3–6 and 10–12, one end of a branch 254 is connected to the pushrod 132 while the other end of the branch 254 is pivotally connected to a wheel 256 by a pin 257. The wheel 256 is mounted parallel to the underside of the base 102. An axle 258 is mounted coaxially to the wheel 256 and passes up through an aperture 260 in the base 102 where it mates with a turret platform 262 which is rotatably mounted on top of the base 102. Two parallel elongate support members 264 and 266 are rigidly mounted perpendicular to the turret platform 262 and serve to support upwardly extending components described below.

First and second lifting arms 270 and 272 are pivotally mounted to the exterior sides at one end of the elongate support members 264 and 266. The first and second lifting arms 270 and 272 each have a substantially triangular base. The corners of the bases furthest from the upward extensions of the arms 270 and 272 receive a pivot pin 274 to pivotally mount the arms 270 and 272 to the support members 264 and 266. A plank 276 is mounted to both first and second lifting arms 270 and 272, straddling the area between the approximate hypotenuses of the triangular bases. The upward extensions of the arms 270 and 272 are fixed at an angle of about 80 degrees in relation to the floor of the triangular bases. A downwardly extending rod 278 is rigidly mounted to the underside of the plank 276. As a cam follower, the rod 278 extends through an elliptical guide slot 280 contained in the base 102 between the turret platform 262 and the wheel 256. A rectangular reinforcement guide 281 is provided below the elliptical guide slot 280.

One end of a support arm 282 is pivotally mounted between the support members 264 and 266 by a pin 284. The support arm 282 extends upwardly between the first lifting arm 270 and the second lifting arm 272 where it is pivotally mounted between L-shaped boom mounts 286 and 288 by a pin 289. The boom mounts 286 and 288 are rigidly mounted to opposite sides of a boom 290. The upwardly extending ends of the first and second lifting arms 270 and 272 intersect with and are pivotally mounted by a pin 292 to the outside walls of the boom mounts 286 and 288 at the portion of the boom mounts 286 and 288 mounted to the exterior walls of the boom 290. The end of the boom 290 closest to the boom mounts 286 and 288 has an ornament platform 294 attached thereto. The other end of the boom 290 has a basket 296 attached thereto. The base 102 has a rectangular indent 298 configured to receive the basket 296 when the transforming towers are in the communication tower 250 configuration.

In operation, transformation from the communication tower 250 to the snorkel tower 252 is initiated by pressing down on the gate actuator 104 which pivots counterclockwise about the actuator support pin 128 thus pulling back on the pushrod 132. As the pushrod 132 is pulled back, the branch 254 pulls on the wheel like a crank 256 thus causing the wheel 256 to rotate clockwise. Clockwise rotation is transmitted to the turret platform 262 through the axle 258. As the turret platform 262 rotates, the downwardly extending rod 278 slides and is guided in the elliptical slot 280 as a cam follower. As the walls of the elliptical slot 280 press against the rod 278, the rod 278, lifting arms 270 and 272, and support arm 282 pivot and tilt back about 10 degrees. As the lifting arms 270 and 272 tilt back, they arcuately push up against the boom 290 which pivots about the axis formed by pin 292. The boom 290 is thus pushed up as the pivotally anchored end at the boom mounts 286 and 288 acts as a fulcrum. In this manner, the communication tower 250 rotates and tilts back while the boom 290 opens, i.e., the boom 290 goes from being substantially perpendicular to the base 102 to extending outwardly at approximately a 10 to 15 degree angle relative to the base 102 thus presenting the open basket 296.

Transformation from the snorkel tower 252 (second position) to the communication tower 250 (first position) is initiated by lifting the gate actuator 104 which pivots clockwise about the actuator support pin 128 thus pushing the pushrod 132 and branch 254 forward. As the branch 254 moves forward, it pushes the wheel 256 like a crank thus causing the wheel 256 to rotate counterclockwise. Counterclockwise rotation is transmitted to the turret platform 262 through the axle 258. As the turret platform 262 rotates, the downwardly extending rod 278 slides and is guided in the elliptical slot 280. As the rod 278 slides in the slot 280, the rod 278, lifting arms 270 and 272, and the support arm 282 pivot and tilt forward about 10 degrees. As the lifting arms 270 and 272 tilt forward, they arcuately pull down on the boom 290 which pivots about the axis formed by the pin 292. The boom 290 is thus pulled down as the pivotally anchored end at the boom mounts 286 and 288 acts as a fulcrum. In this manner the snorkel tower 252 rotates clockwise and tilts forward while the boom 290 closes, i.e., the boom 290 goes from extending outwardly to dropping down and being substantially perpendicular to the base 102.

Figure 13:
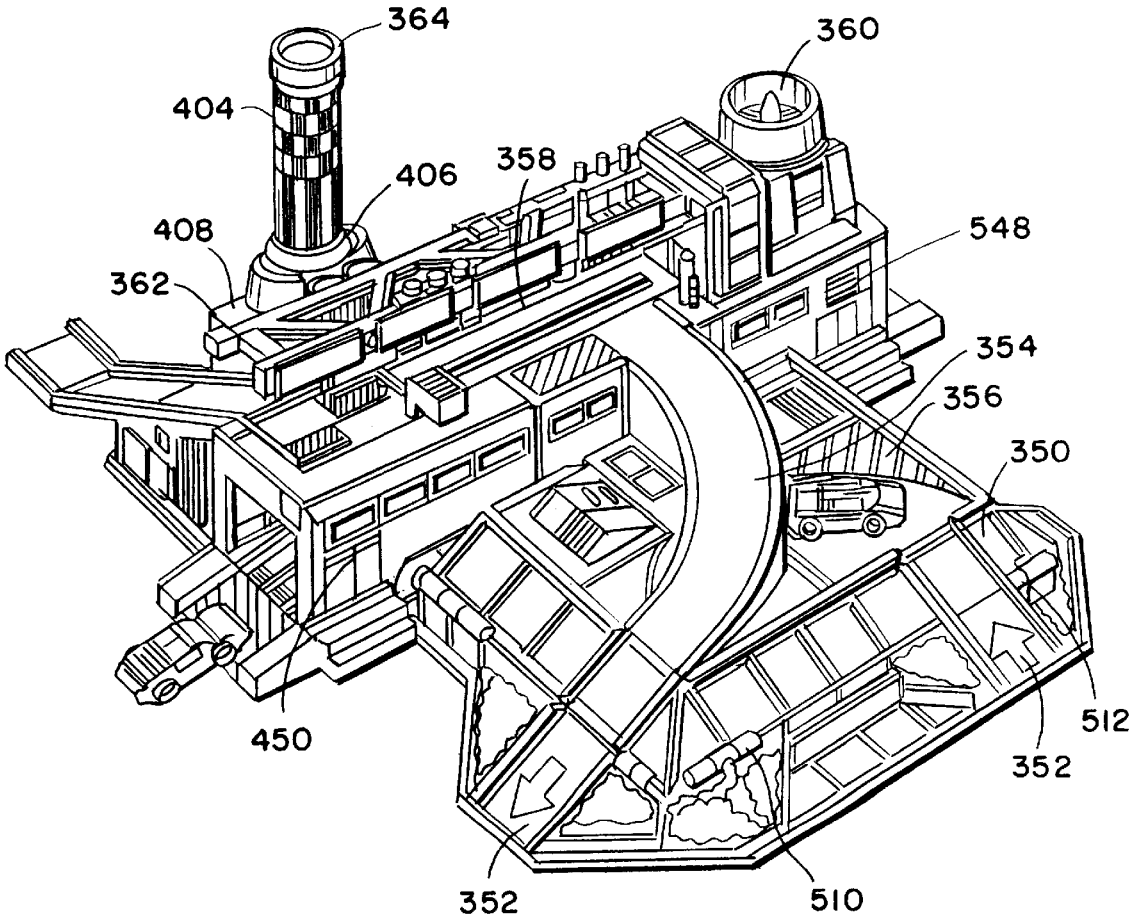
FIG. 13 is a front perspective view of a second embodiment of a transforming playset having fanciful detailing in a first configuration according to the present invention.
Figure 14:
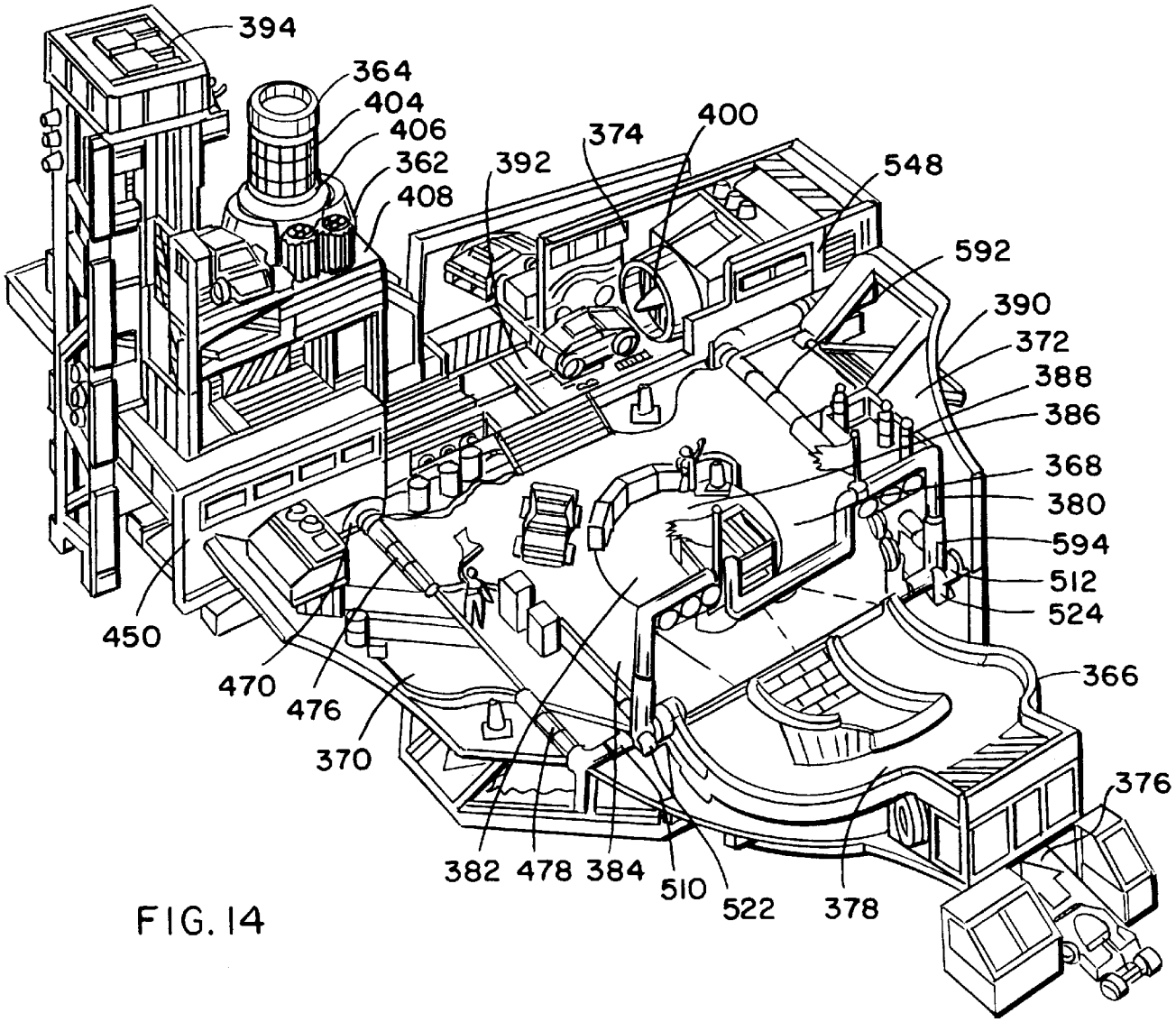
FIG. 14 is a front perspective view of the second embodiment of the transforming playset having fanciful detailing in a second configuration according to the present invention.
Figure 15:
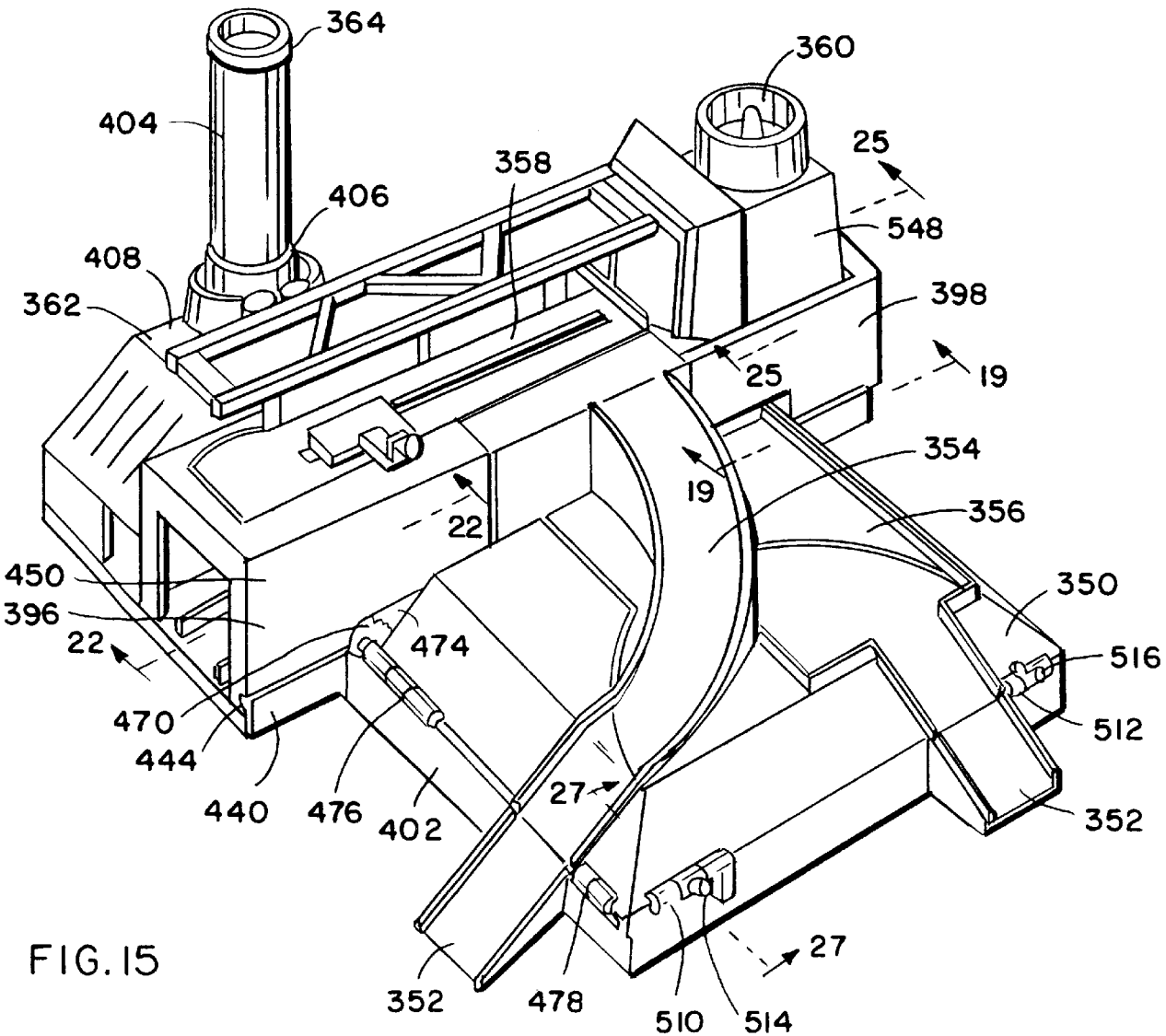
FIG. 15 is a front perspective view of a stripped version of the second embodiment in first configuration illustrated in FIG. 13.
Figure 16:
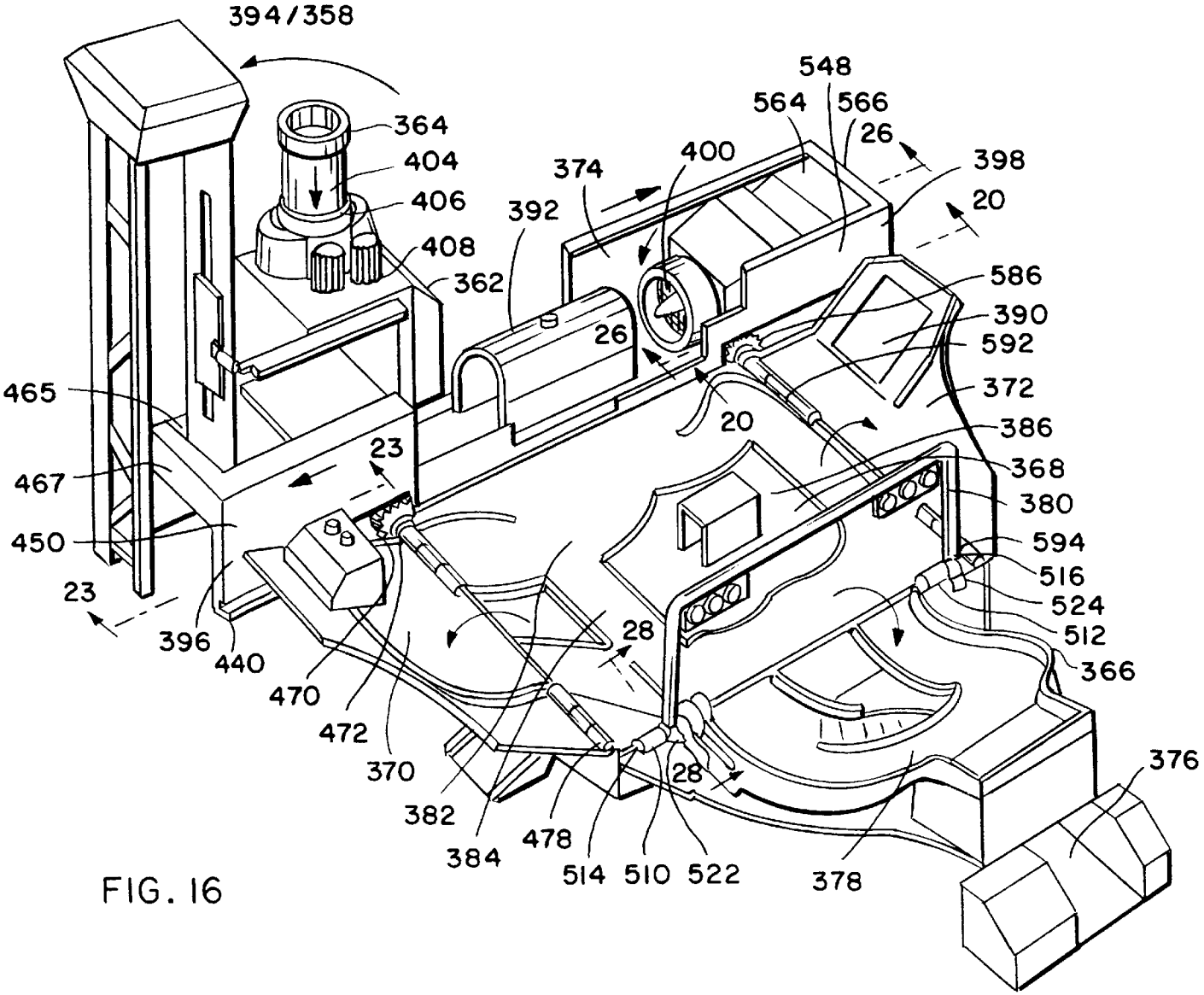
FIG. 16 is a front perspective view of a stripped version of the second embodiment in second configuration illustrated in FIG. 14.

In another embodiment illustrated in FIGS. 13–28, the playset mechanically transforms from an exterior view of an automobile factory environment to an automobile test track environment by manipulation of a single actuator connected to configuring means. Further manipulation of the actuator causes the configuring means to reconfigure the automobile test track environment back into the automobile factory environment. For convenience, the automobile factory environment, which is illustrated in FIG. 13, may also be referred to as the first position and the automobile test track environment, which is illustrated in FIG. 14, may also be referred to as the second position. FIGS. 13 and 14 illustrate certain fanciful detailing which, although not essential for operation of this embodiment of the invention, is included to provide an aesthetic aspect. FIGS. 14 and 15 illustrate a "stripped" version of the present embodiment which depicts the playset without much of the fanciful detailing included in FIGS. 13 and 14. For convenience, corresponding structures in FIGS. 13–28 will be provided with the same reference numbers. For example, the building 350 in FIG. 13 corresponds to the building 350 in FIG. 15.

The automobile factory environment includes a front portion designed and configured to have the appearance of a low-rise building 350 with ramps 352 leading to a roadway 354 on its roof 356. A rear portion of the automobile factory environment is designed and configured to have the appearance of a manufacturing facility and includes an assembly line facility 358, a turbine 360 and a power plant 362 having a smoke-stack 364.

The automobile test track environment contains a front portion 366, a middle portion 368, a first side portion 370, second side portion 372 and a rear portion 374. The front portion 366 includes an entrance tunnel 376, a curved banked roadway track 378 and a light bar 380. The middle portion 368 includes a central portion 382 having roadway track 384 and infield 386. The first side portion 370 is designed and configured to have the appearance of a pit stop area. The second side portion 372 includes bleachers 388 and a ramp 390. The rear portion 374 includes a wind tunnel area 392, a tower 394, and the power plant 362.

In this embodiment, the smoke-stack 364 is a component of the actuator which is pressed to cause transformation from the first position to the second position. During such transformation, the assembly line facility 358 swings up to become the tower 394, a first portion 396 of the manufacturing facility slides outwardly from the center of the playset while a distal second portion 398 of the manufacturing facility slides outwardly in the opposite direction thus exposing and enlarging the wind tunnel area 392. The turbine 360 swings down into the wind tunnel area 392 and creates the appearance of a wind tunnel fan 400. The roof 356 splits open into three segments which diverge and pivot outwardly from the base 402 to expose the previously concealed underside of the front portion 366, first side portion 370 and second side portion 372. The light bar 380 is pivotally attached to the front portion 366 and swings up to present itself as the front portion 366 opens.

Figure 17A:
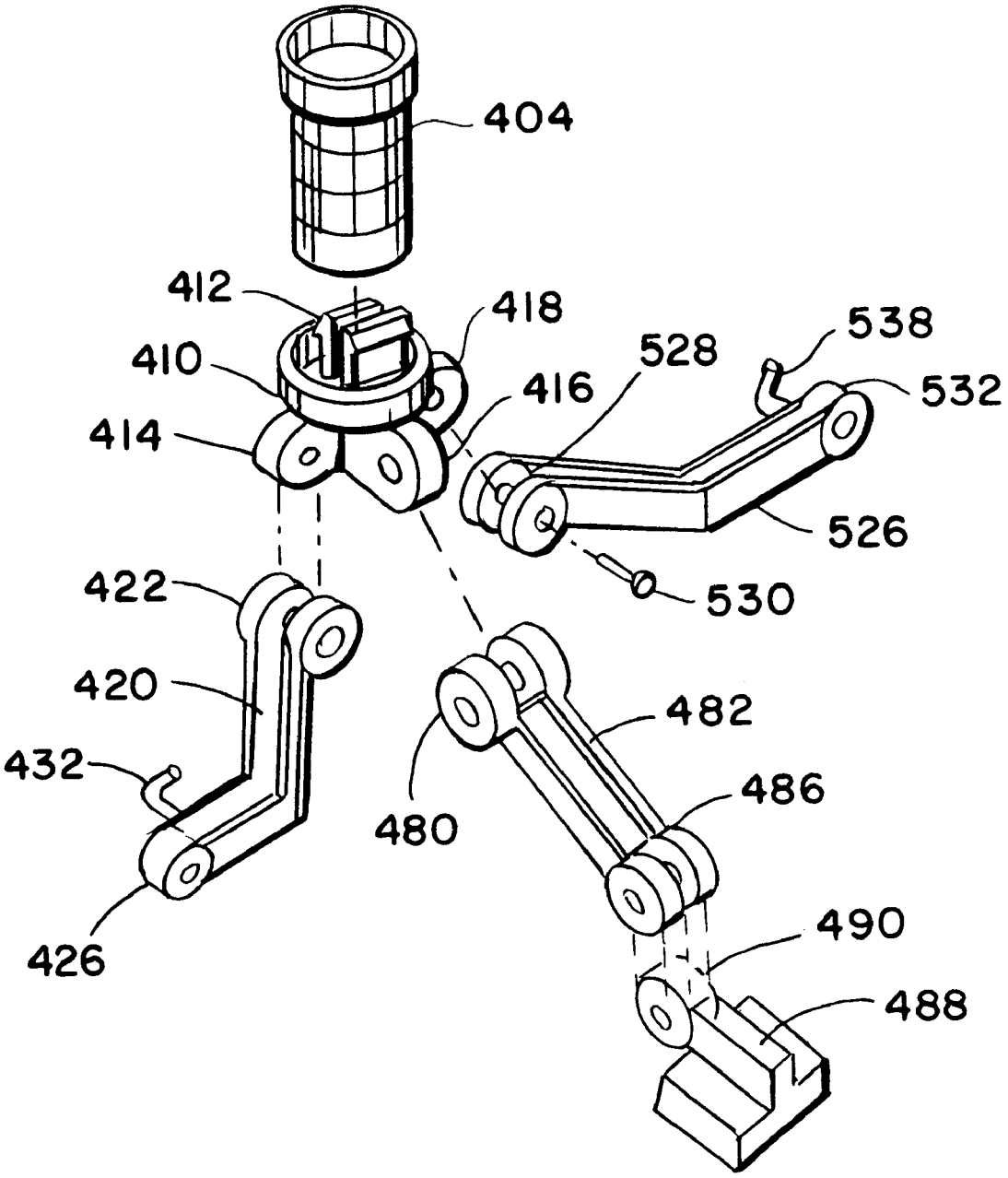
FIG. 17A is a perspective exploded fragmentary view of portions of an actuator and portions of configuring means contained in the second embodiment illustrated in FIGS. 13 through 16.
Figure 18A:
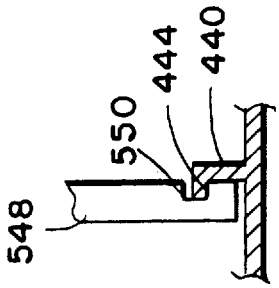
FIG. 18A is a cross-sectional view of a frontside track which slidably engages a frontside portion of a sliding structure portion contained in the second embodiment illustrated in FIGS. 15 through 17.
Figure 18B:
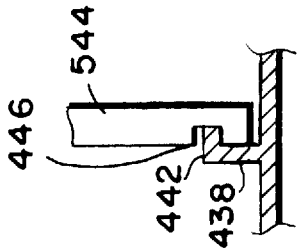
FIG. 18B is a cross-sectional view of a rearside track which slidably engages a rearside portion of the sliding structure portion contained in the second embodiment illustrated in FIGS. 15 through 17.
Figure 17B:
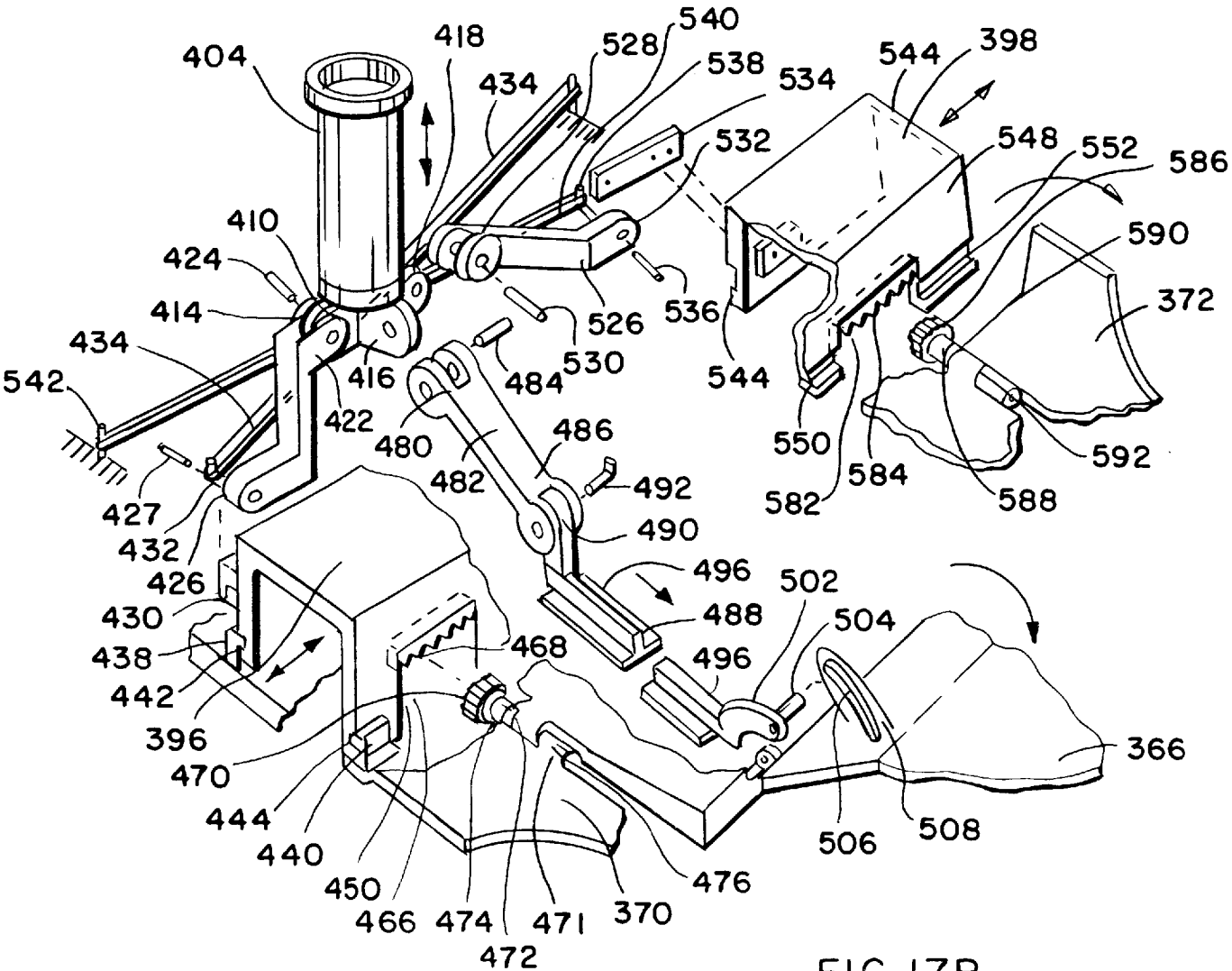
FIG. 17B is a perspective exploded fragmentary view of portions of the actuator and portions configuring means contained in the second embodiment illustrated in FIGS. 13 through 17A.
Figure 19:
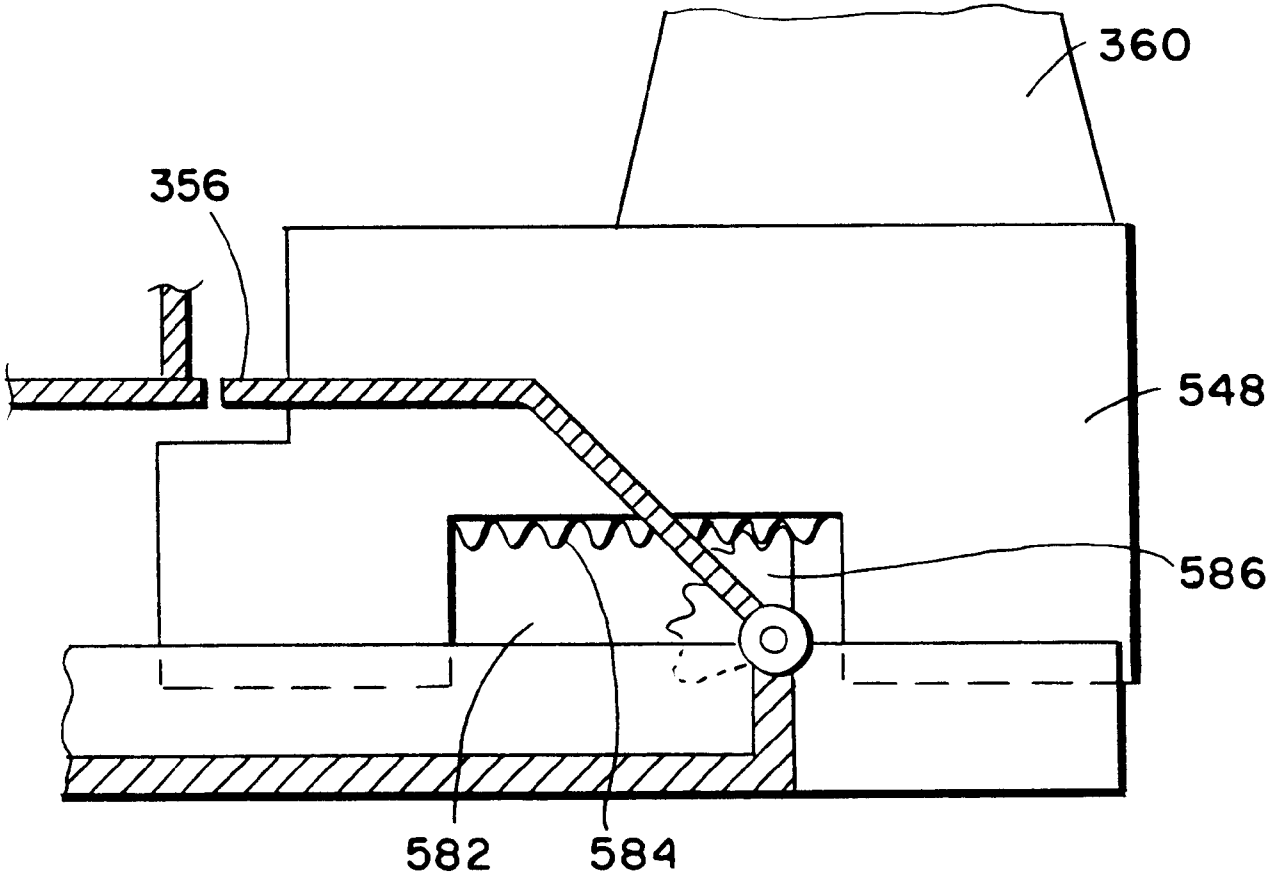
FIG. 19 is a sectional front view of a right-hand portion of the second embodiment in first configuration taken along lines 19—19 illustrated in FIGS. 15 and 17.
Figure 20:
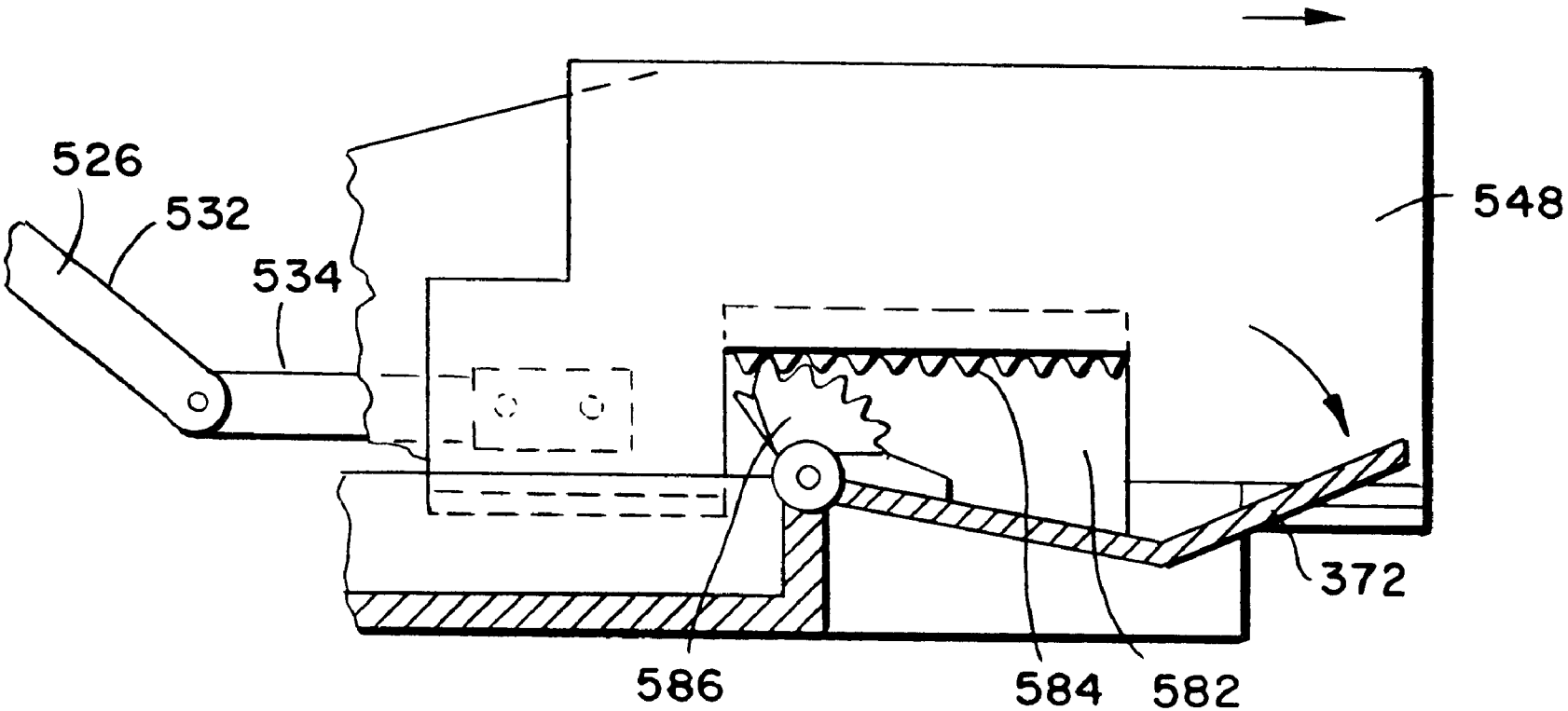
FIG. 20 is a sectional front view of a left-hand portion of the second embodiment in first configuration taken along lines 20—20 illustrated in FIGS. 15 and 17.
Figure 21:
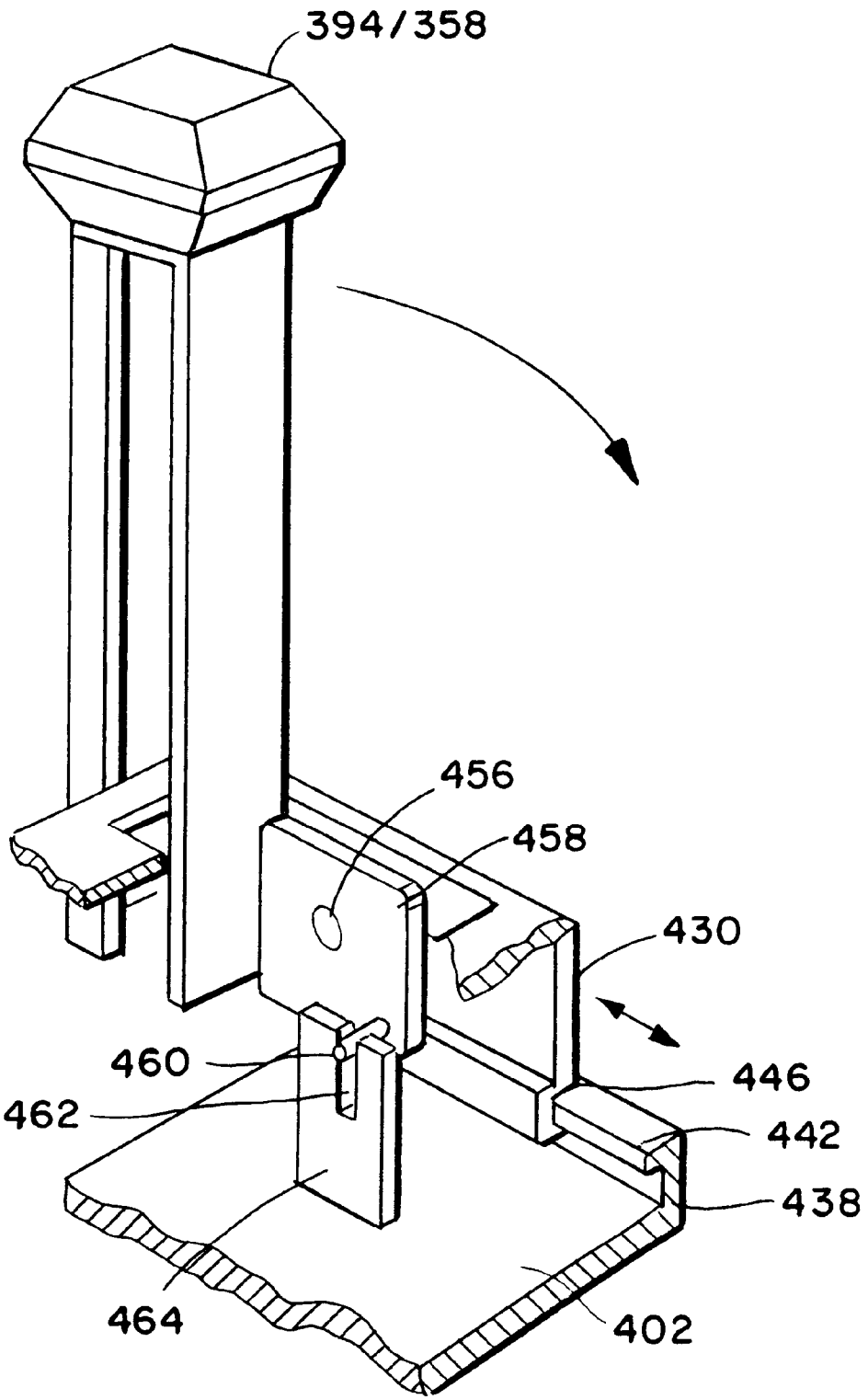
FIG. 21 is a perspective sectional view of a left-hand portion of the second embodiment containing a tower and a portion of configuring means in the second configuration.
Figure 22:
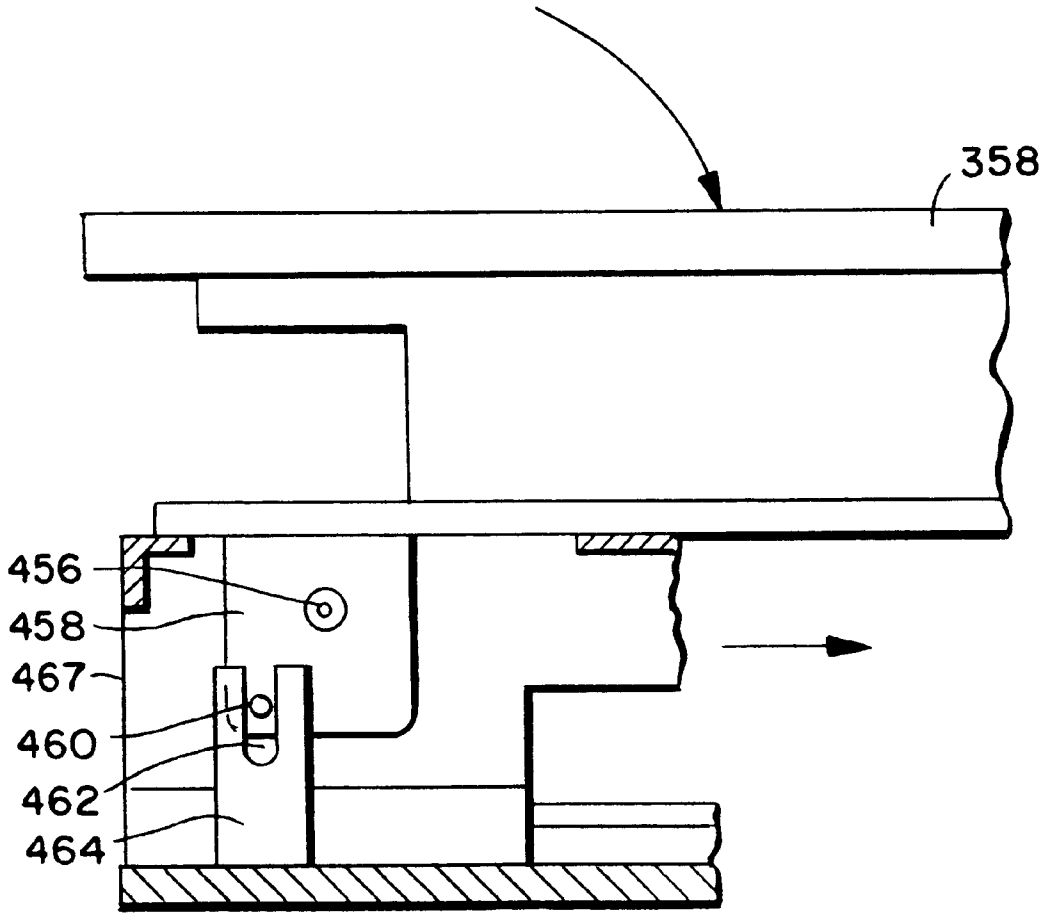
FIG. 22 is a front sectional view of the left-hand portion of the second embodiment containing a portion of configuring means in the first configuration taken along lines 22—22 illustrated in FIG. 15.
Figure 23:
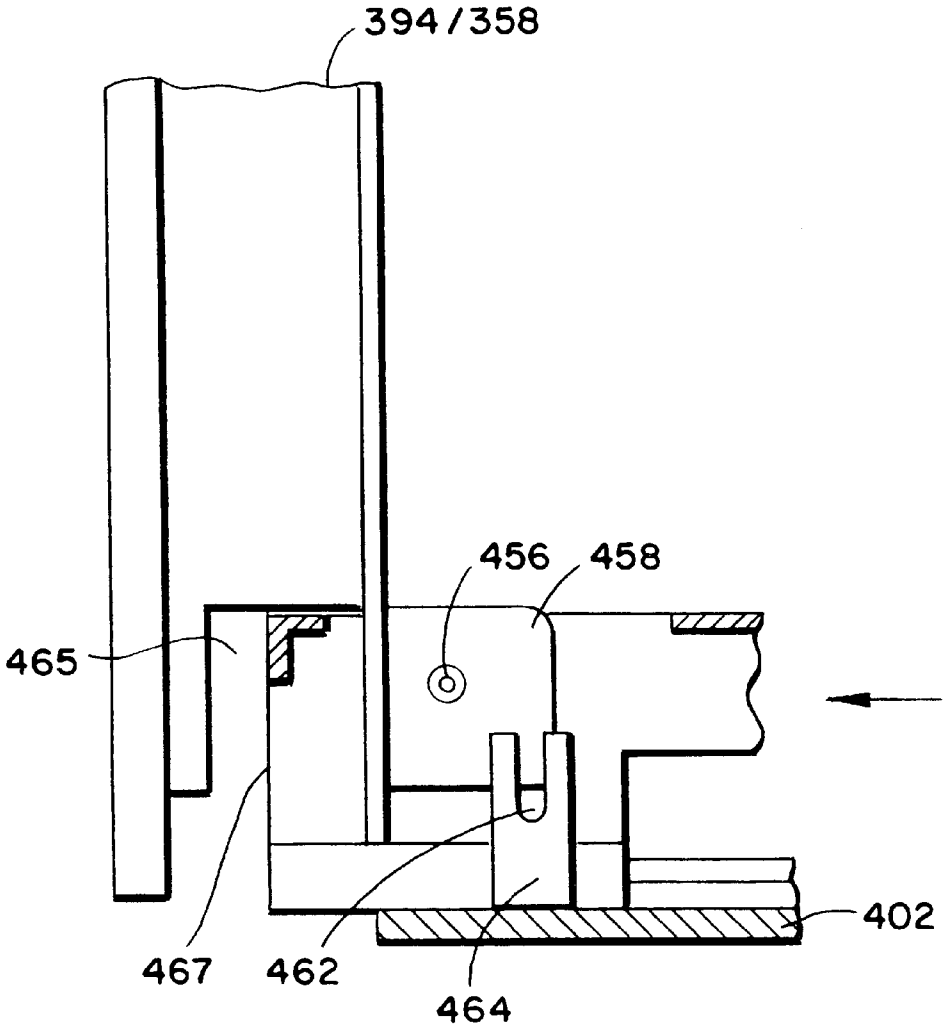
FIG. 23 is a front sectional view of a portion of the left-hand portion of the second embodiment in second configuration taken along lines 23—23 illustrated in FIG. 21.

In this embodiment, in addition to the above, the actuator and configuring means include a variety of elements which are more particularly described as follows. The actuator includes a first tubular member 404 slidably mounted within an outer tube 406 which together give the appearance of the smoke-stack 364. The outer tube 406 is fixedly mounted to the power plant roof 408 and thus acts as a stabilizer and guide for the tubular member 404 which descends into the power plant 462. As illustrated in FIGS. 17A and 17B, the bottom end of the tubular member 404 mates with a yoke 410 having an annular top portion configured to receive the tubular member 404 which is held to the yoke 410 by a snap fit connector 412 that engages an interior lip of the tubular member (not shown).

The bottom portion of the yoke 410 is provided with three downwardly projecting pivot receiving bosses 414, 416 and 418. The first yoke boss 414 is distally opposed to the third yoke boss 418; the second yoke boss 416 being perpendicular to the intersection of the first and third bosses 414 and 416. A first bent arm 420 having one forked end 422 is pivotally attached at the forked end 422 to the first boss 414 by a pin 424. The other end 426 of the first bent arm 420 is pivotally attached by a pin 427 to an L-shaped boss 428 which is fixedly mounted to a rear wall 430 of the first portion 396 of the manufacturing facility. The end 426 of the first bent arm 420 is provided with a hook 432 for engaging one end of a first elastic band 434 which has its other end engaged to a first hook boss 436 mounted to the base 402 within the power plant 362. Alternatively, a helical spring may be used in place of the band 434.

The first portion 396 of the manufacturing facility is slidably mounted to first and second tracks 438 and 440 which are fixedly mounted to the base 402. The tracks 438 and 440 are provided with lips 442 and 444, respectively, which slidably engage slots, i.e., lip 442 engages rear wall slot 446 while lip 444 engages slot 452 contained on a front wall 450 of the first portion 396 of the manufacturing facility.

As can be seen in FIGS. 16 and 21–23, the tower 394/assembly line track 358 is pivotally mounted to the interior face of the rear wall 430 by a pin 456 passing through a tower boss 458 attached to the tower 394/assembly line track 358. The tower boss 458 is provided with an inwardly extending fixed pin 460 which engages a vertical guide slot 462 located in a first base boss 464 mounted to the base 402. The rear wall 459 of the tower 394/assembly line track 358 is provided with an elliptical slot 465 configured to allow a side wall 467 of the first portion 396 of the manufacturing facility to be received therein.

The front wall 450 includes a substantially rectangular cut-out portion 466 having a rack 468 mounted to an upper side of the cut-out portion 466. The rack 468 engages a half spur gear 470 which is coaxially mounted to a shaft 472, the shaft 472 being fixedly mounted to a rear edge 474 of the first side portion 370. The first side portion 370 is pivotally mounted to the base 402 via first side portion hinges 476 and 478.

The second yoke boss 416 is pivotally connected to a first forked end 480 of a straight arm 482 by a pin 484. A second forked end 486 of the arm 482 is pivotally connected by a pin 492 to one end of a pushrod 488 via a first pushrod boss 490 mounted to the pushrod 488. The pushrod 488 is sidably mounted at the underside of the base 402 and is guided by slot 494 in the base configured to receive a pushrod track 496 located on an upper face of the pushrod 488. The pushrod 488 is further slidably supported by first and second pushrod supports 498 and 500 mounted to the underside of the base 402. Mounted to the other end of the pushrod 488 is a second pushrod boss 502 with an inwardly extending pin 504 attached thereto. The pin 504 is received by an elliptical slot 506 contained in an upwardly projecting boss 508 mounted near a side of the front portion 366 of the automobile test track environment. The front portion 366 is pivotally mounted to the base 402 via hinges 510 and 512. End portions 514 and 516 of the light bar 380 are pivotally mounted to the shafts 518 and 520 (not shown) of the hinges 510 and 512, the shafts 518 and 520 passing through the end portions 514 and 516, respectively. The end of the end portions 514 and 516 are bent where they continue past the shafts 518 and 520, the bent ends passing through notches 522 and 524, respectively, in the rear of the front portion 366.

The third yoke boss 418 is pivotally connected to the forked end 528 of a second bent arm 526 by a pin 530. The other end 532 of the arm 526 is pivotally connected to one end of a pushrod 534 by a pin 536. The end 532 is provided with a hook 538 for engaging one end of a second elastic band 540 which has its other end engaged to a second hook boss 542 mounted to the base 402 within the power plant 362. Alternatively, a helical spring may be used in place of the band 540. The other end of the pushrod 534 is fixedly mounted to a rear wall 544 of the second portion 398 of the manufacturing facility.

The second portion 398 of the manufacturing facility is slidably mounted to the base 402 by the first and second tracks 438 and 440. The rear wall 544 of the second portion 398 of the manufacturing facility has a rear wall slot 446 which slidably engages lip 442 of the first track 438. The front wall 548 of the second portion 398 of the manufacturing facility has front wall slots 550 and 552 which slidably engage lip 444 of the second track 440.

Figure 24:
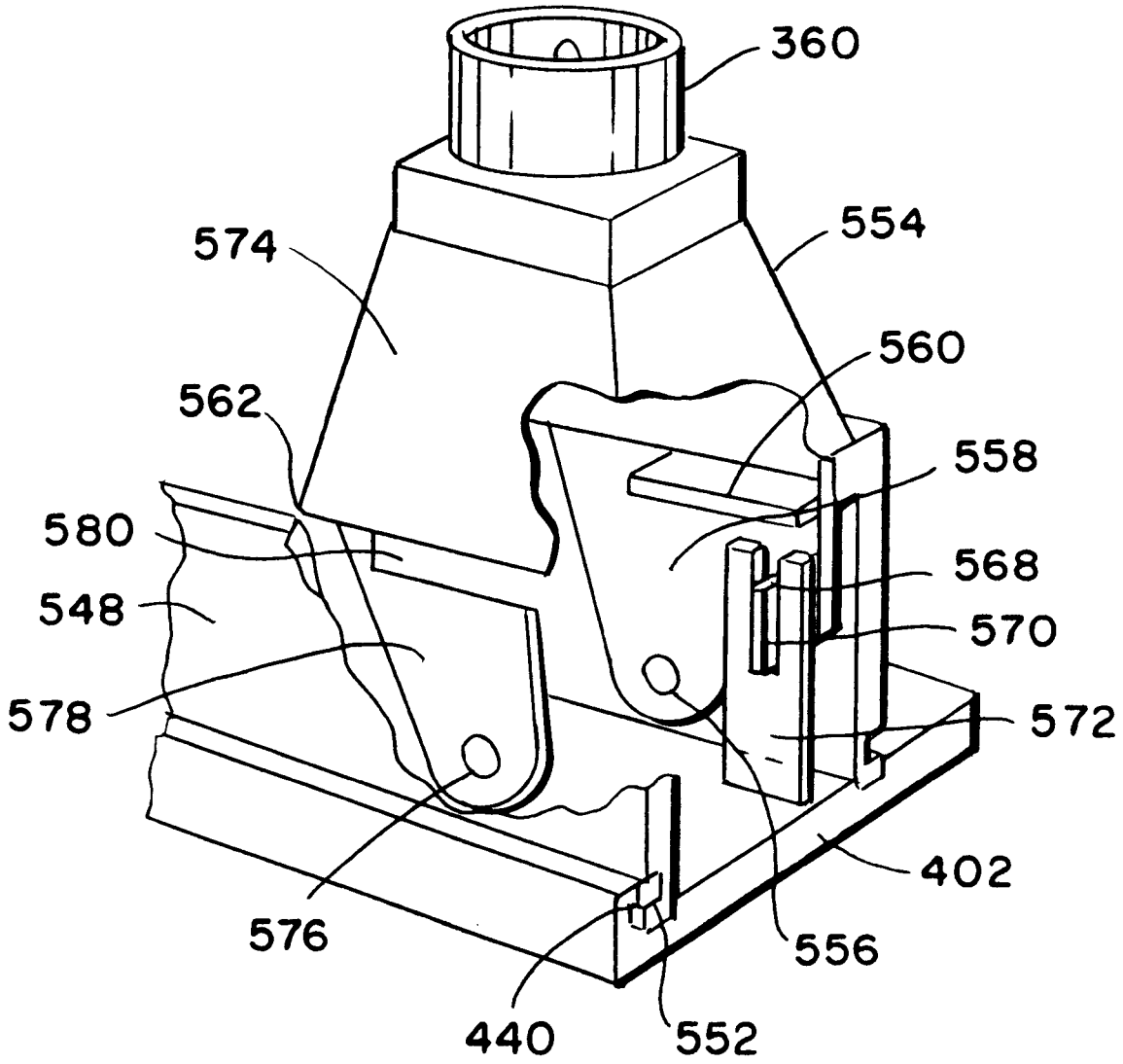
FIG. 24 is a perspective cut-away sectional view of a right-hand portion of the second embodiment showing a portion of configuring means and a pivoting turbine structure in first configuration.
Figure 25:
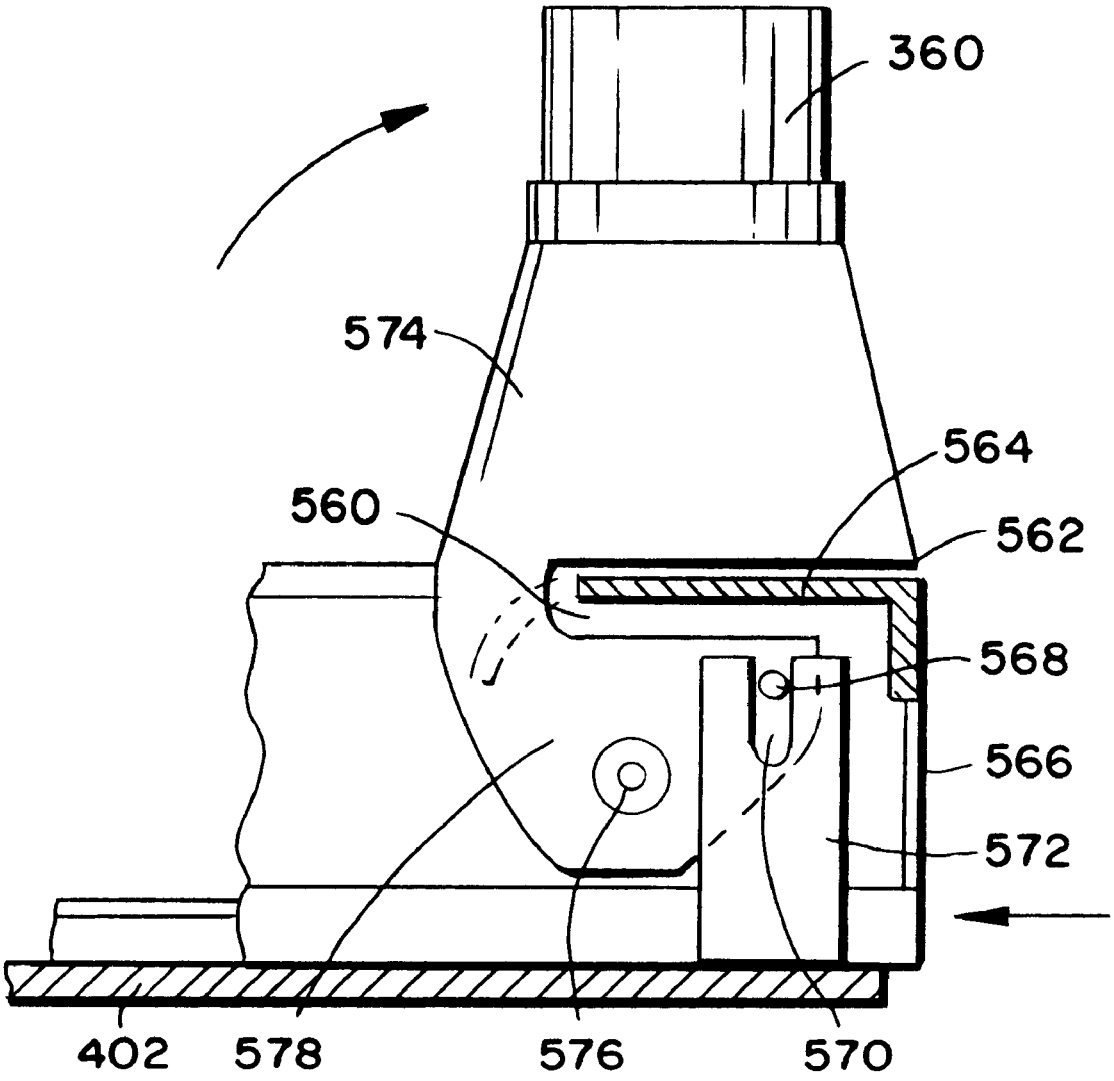
FIG. 25 is a sectional cut-away front view of the right-hand portion taken along lines 25—25 illustrated in FIG. 24.
Figure 26:
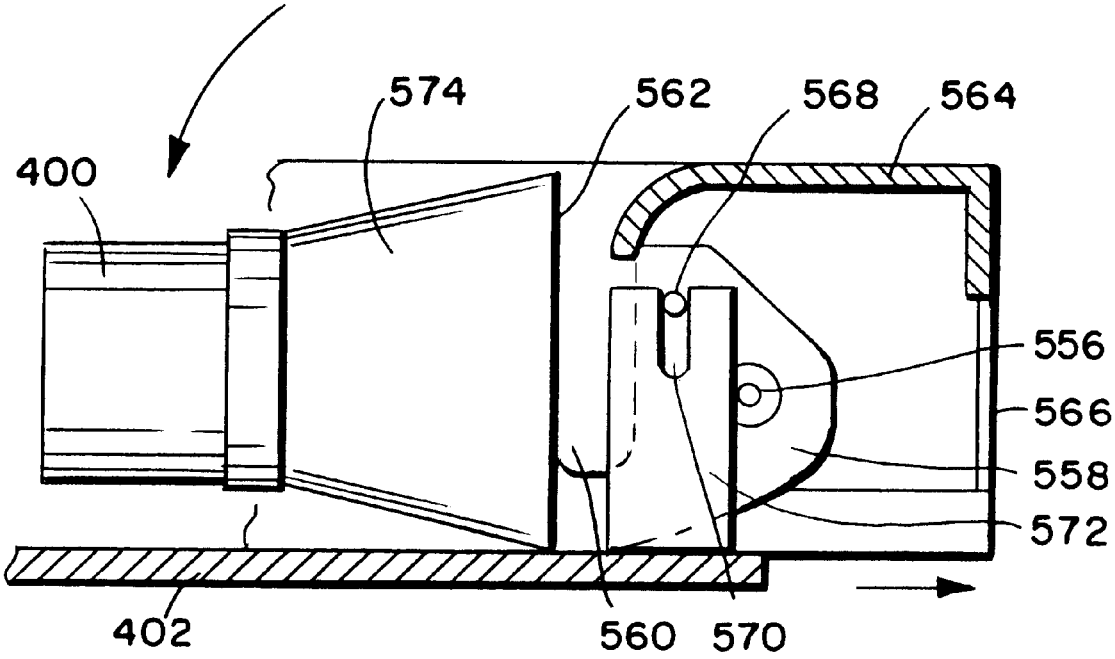
FIG. 26 is a sectional front view of the right-hand portion illustrated in FIGS. 24 and 25 in second configuration taken along lines 26—26 illustrated in FIG. 16.
Figure 27:
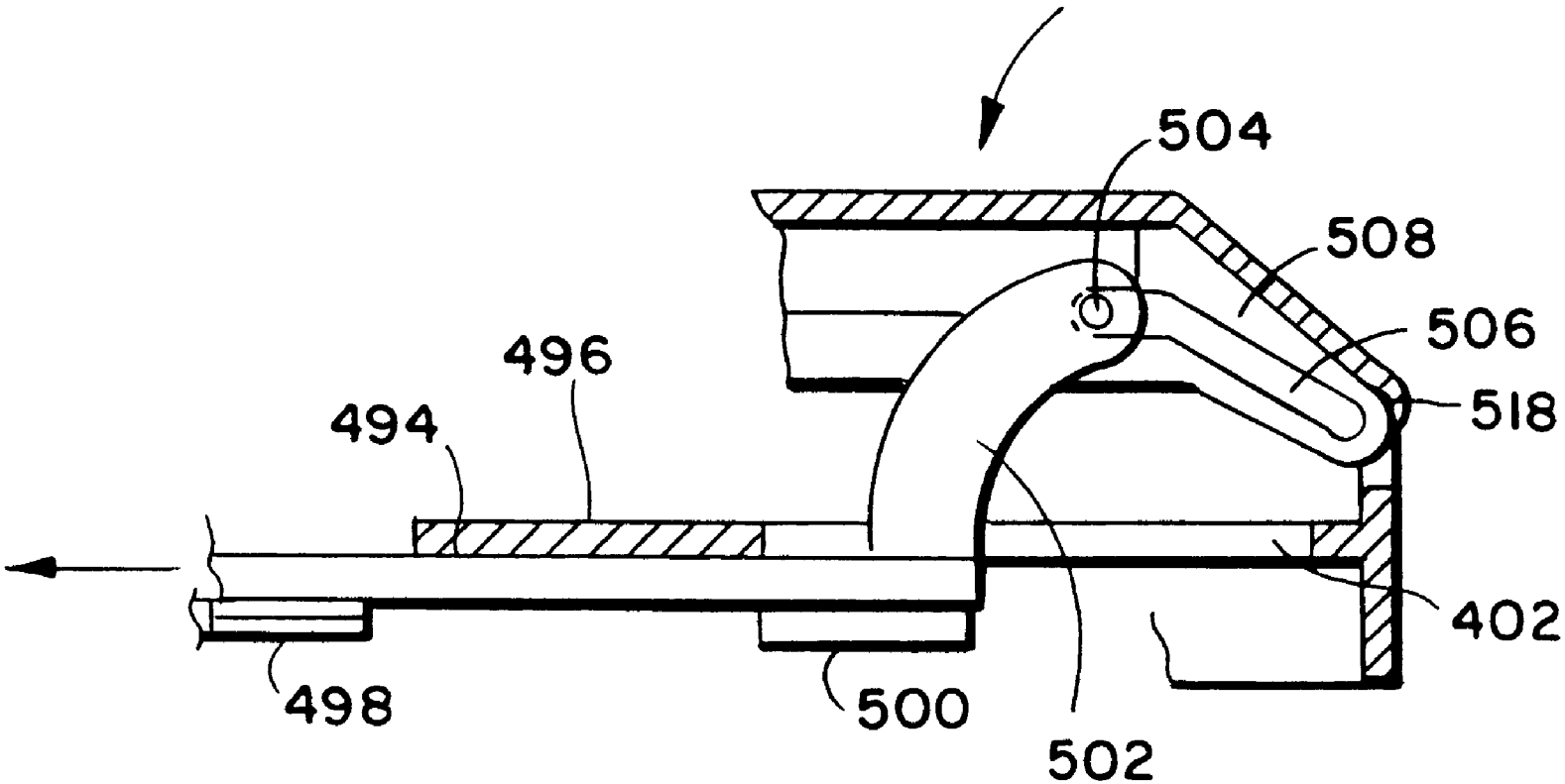
FIG. 27 is a cut-away partial side view of a front portion of the second embodiment in first configuration taken along lines 27—27 illustrated in FIG. 15.
Figure 28:
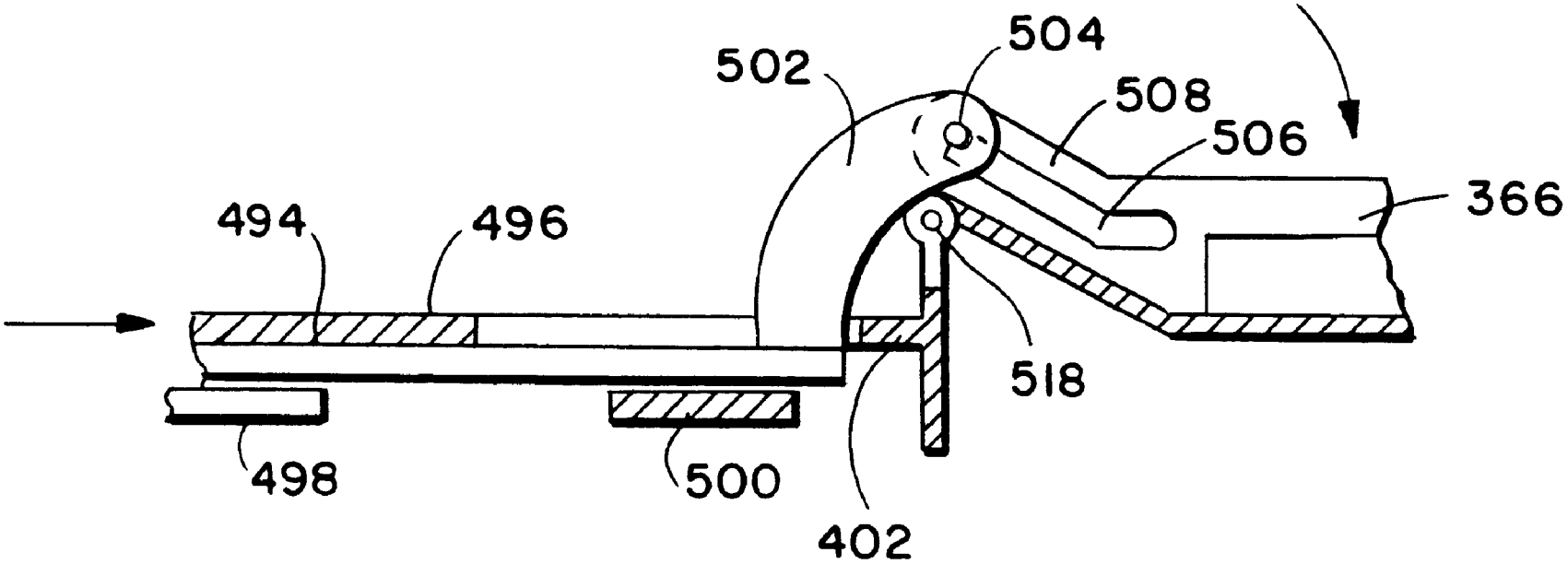
FIG. 28 is a cut-away partial side view of the front portion of the second embodiment in second configuration taken along lines 28—28 illustrated in FIG. 16.

As can be seen from FIGS. 24–26, a rear wall 554 of the turbine 360/fan 400 is pivotally mounted to the interior face of the rear wall 544 of the second portion 370 by a pin 556 passing through a turbine rear wall boss 558 attached to the rear wall 554 of the turbine 360/fan 400. The turbine rear wall boss 558 contains a slot 560 running substantially parallel to the floor 562 of the turbine 360. The slot 560 is configured to receive the top 564 of one end portion 566 of the wind tunnel 392. The turbine rear wall boss 558 is provided with an inwardly extending fixed pin 568 which engages a vertical guide slot 570 located in a second base boss 572 mounted to the base 402 interiorly adjacent to the turbine rear wall boss 558. The front wall 574 of the turbine 360/fan 400 is pivotally mounted to the interior face of the front wall 548 of the second portion 370 by a pin 576 passing through a turbine front wall boss 578 attached to the front wall 574 of the turbine 360/fan 400. The turbine front wall boss 578 contains a slot 580 running substantially parallel to the floor 562 of the turbine 360 and corresponding to the slot 560. The slot 580 is configured to fit over and receive the top 564 of the end portion 566 of the wind tunnel 392.

The front wall 548 of the second portion 398 of the manufacturing facility includes a substantially rectangular cut-out portion 582 having a rack 584 mounted to an upper side of the cut-out portion 582. The rack 584 engages a half spur gear 586 which is coaxially mounted to a shaft 588 fixedly mounted to a rear edge 590 of the second side portion 372. The second side portion 372 is pivotally mounted to the base 402 via second side portion hinges 592 and 594.

In operation, transformation from the from the automobile factory environment to the automobile test track environment is initiated by pressing down on the first tubular member 404 of the smoke-stack 364 which slides down within the outer tube 406 thus forcing the yoke 410 down. As the yoke 410 moves down, the forked end 422 of the first bent arm 420 is pushed down vertically as it pivots about the first yoke boss 414 causing downward angular rotation of the arm 420. In this manner, the other end 426 of the first arm 420 pushes outwardly against the L-shaped boss 428 thus causing the first portion 396 of the manufacturing facility to slide outwardly along the tracks 438 and 440. When the yoke 410 is in the up position, the first arm 420 extends upwardly from the L-shaped boss 428 at an angle which preferably ranges from, but is not limited to, about 50 to about 60 degrees relative to the base 402. When the yoke 410 is fully depressed, the first arm 420 is substantially parallel to the base 402. The elastic band 434 acts to assist the action of pushing down the actuator 404 by exerting a pulling force and magnifying the angular rotational moment of the arm 420. Moreover, the force exerted by the elastic band 434 serves to lock the arm 420 at its orientation substantially parallel to the base 402.

The outward sliding of the first portion 396 causes the assembly line facility 358 to swing upwardly by causing the tower boss 458 which is rigidly connected to the pivotable assembly line facility 358 to pivot counterclockwise about the pin 456. More specifically, the walls of the slot 462 in the first base boss 464 hold the inwardly extending pin 460 which is fixedly mounted to the tower boss 458 such that as the first portion 396 slides, the pin 460 acts as a crank and a counterclockwise rotational moment is imparted to the tower boss 458 which pivots about pin 456. The slot 462 allows the pin 460 to be held at a substantially fixed horizontal position while allowing the pin 460 to reciprocate in the slot 462 as the tower boss 458 rotates. As the assembly line facility 358 swings up along about a 90 degree arc to become recognizable as the tower 394, the side wall 467 of the first portion 396 is received by the elliptical slot 465 thus allowing the walls of the tower 394 to straddle the side wall 467 when the tower 394 is fully vertical.

The outward sliding of the first portion 396 of the manufacturing facility also causes the underside of the first side portion 370 containing the pit stop area to be exposed. This is accomplished by converting the linear motion of the sliding first portion 396 of the manufacturing facility into a rotational moment via the rack 468 and half gear 470 (rack and pinion assembly). Thus, as the first portion 396 slides outwardly, the rack 468 is pulled along and since it meshes with the half gear 470, it causes the half gear 470 to rotate counterclockwise. Counterclockwise rotation is imparted to the first side portion 370 through the shaft 472 which is fixedly mounted to the rear edge 474 of the first side portion 370. The rotating shaft 472 causes the first side portion 370 to swing open as it pivots about the hinges 476 and 478 thus traversing an arc of about 180 degrees.

Downward movement of the yoke 410 also causes the first forked end 480 of the straight arm 482 to pivot about the pin 484 and cause the end 480 of the arm 483 to move vertically down. As the arm 482 moves down, it pivots about the pin 492 in the first pushrod boss 490, going preferably, but not limited to, from approximately a 50–60 degree angle in the up position to being substantially parallel to the base 402. The downward movement of the arm 482 pushes the pushrod 488 forward in the slot 494 contained in the base 402. The second pushrod boss 490 moves forward along with the pushrod 488 thus causing the inwardly extending pin 492 to slide forward in the elliptical slot 506. The front portion 366 of the playset is thus pushed open by the camming action of the pin 492 in the slot 506 which creates a rotational moment about the hinges 510 and 512. As the front portion 366 swings open following about a 180 degree arc, it exposes its underside banked roadway track 378. The light bar 380 pivotally swings up as the top of the front portion 366 containing the roadway 354 swings up and catches the bent ends of the light bar 514 and 516 near the shafts 518 and 520, thus causing the light bar 380 to swing up along about a 90 degree arc. The rearmost portion of the front portion 366 (when in the first position) forms a center portion 399 of the manufacturing facility. When the front portion 366 swings up, it exposes the center portion of the wind tunnel area 392.

Downward movement of the yoke 410 also causes the forked end 528 of the second bent arm 526 to pivot about the pin 530 and move vertically down thus causing downward angular rotation of the arm 526. In this manner, the other end 532 of the arm 526 pivots counterclockwise about the pin 536 connecting the arm 526 to the pushrod 534 thus pushing the pushrod 534 outwardly. When the yoke 410 is in the up position, the second arm 526 extends upwardly from pushrod 534 at an angle which preferably ranges from, but is not limited to, about 50 to about 60 degrees relative to the base 402. When the yoke 410 is fully depressed, the second arm 526 is substantially parallel to the base 402. The elastic band 540 acts to assist the action of pushing down the actuator 404 by exerting a pulling force and magnifying the angular rotational moment of the arm 526. Moreover, the force exerted by the elastic band 540 serves to lock the arm 525 at its orientation substantially parallel to the base 402.

Since the pushrod 534 is mounted to the second portion 398 of the manufacturing facility, movement of the pushrod 534 causes the second portion 398 to slide outwardly along the tracks 438 and 440 in the opposite direction of the distally sliding first portion 396 of the manufacturing facility thus exposing and expanding the wind tunnel area 392.

The outward sliding of the second portion 398 causes the turbine 360 to pivotally swing down into the wind tunnel area 392 by causing the turbine rear wall boss 558 which is rigidly connected to the turbine 360 to pivot counterclockwise about the pin 556. More specifically, the walls of the vertical guide slot 570 in the second base boss 572 hold the inwardly extending pin 568 which is fixedly mounted to the turbine rear wall boss 558 such that as the second portion 3298 slides, the pin 568 acts as a crank and a counterclockwise rotational moment is imparted to the turbine rear wall boss 558 which pivots about the pin 556. The vertical slot 570 allows the pin 568 to be held at a substantially fixed horizontal position while allowing the pin 468 to reciprocate in the slot 570 as the turbine rear wall boss 458 rotates. As the turbine 360 swings down along about a 90 degree arc going from substantially perpendicular to the base 420 to substantially parallel to the base 402 and becomes recognizable as the fan 400, it is also pivotally supported by the turbine front wall boss 578 which pivots about pin 576. Furthermore, as the turbine 360 swings down, corresponding slots 560 and 580 slide past and receive the top 564 of the end portion 566 of the wind tunnel 392.

The outward sliding of the second portion 398 of the manufacturing facility also causes the underside of the second side portion 372 containing the bleachers and ramp to be exposed. This is accomplished by converting the linear motion of the sliding second portion 398 of the manufacturing facility into a rotational moment via the rack 584 and half spur gear 586 (rack and pinion assembly). Thus, as the second portion 398 slides outwardly, the rack 584 is pulled along and since it meshes with the half gear 586, it causes the half gear 586 to rotate clockwise. Clockwise rotation is imparted to the second side portion 372 through the shaft 588 which is fixedly mounted to the rear edge 590 of the second side portion 372. The rotating shaft 588 causes the second side portion 372 to swing open as it pivots about the hinges 592 and 594 thus traversing an arc of about 180 degrees.

Transformation from the second position to the first position is initiated by pulling up on the first tubular member 404 of the smoke-stack 364 which pulls the yoke 410 up from its down position. As the yoke 410 moves up, the forked end 422 of the first bent arm 420 is pulled vertically upward as it pivots about the first yoke boss 414 thus causing upward angular rotation of the arm 420. The elastic band 434 acts to assist the action of pulling up the tubular member 404 by exerting a pulling force and magnifying the angular rotational moment of the arm 420. Moreover, the force exerted by the elastic band 434 serves to lock the arm 420 in the up position. In this manner, as the arm 420 roates, the other end 426 of the arm 420 pulls inwardly on the L-shaped boss 428 thus causing the first portion 396 of the manufacturing facility to slide inwardly toward the center of the playset along the tracks 438 and 440.

The inward sliding of the first portion 396 causes the tower 394 to swing downwardly by causing the tower boss 458 which is rigidly connected to the tower 394 to pivot clockwise about the pin 456. More specifically, the walls of the slot 462 in the first base boss 464 hold the inwardly extending pin 460 which is fixedly mounted to the tower boss 458 such that as the first portion 396 slides inwardly, the pin 460 acts as a crank and a clockwise rotational moment is imparted to the tower boss 458 which pivots about the pin 456. The slot 462 allows the pin to be held at a substantially fixed horizontal position while allowing the pin 460 to reciprocate in the slot 462 as the tower boss 458 rotates. As the tower 494 swings down to become recognizable as the assembly line facility 358, the elliptical slot 465 passes over the side wall 467 of the first portion 396.

The inward sliding of the first portion 396 of the manufacturing facility also causes the first side portion 370 containing the pit stop area to flip over, thus exposing a portion of the roof 356 of the low-rise building 350. This is accomplished by the rack 468 riding over the half spur gear 470 as the first portion 396 of the manufacturing facility slides inward, thus causing the half gear 470 to rotate clockwise. Clockwise rotation is imparted to the first side portion 370 through the shaft 472 which is fixedly mounted to the rear edge 474 of the first side portion 370. The rotation of the shaft 473 causes the first side portion 370 to swing closed as it pivots about the hinges 476 and 478 thus traversing an arc of about 180 degrees.

Upward movement of the yoke 410 also causes the first forked end 480 of the straight arm 483 to pivot about the pin 484 and cause the first end 480 to move vertically upward. As the arm 482 moves up, it pivots about the pin 492 in the first pushrod boss 490, going from being substantially parallel to the base 402 to an angle of preferably, but not limited to, about 50 to about 60 degrees. The upward movement of the arm 482 pivotally pulls the pushrod 488 backward in the slot 494 contained in the base 402. The second pushrod boss 490 moves back along with the pushrod 488 thus causing the inwardly extending pin 492 to pull on a rear wall of the elliptical slot 506. The front portion 366 of the playset is thus made to swing shut by the action of the pin 492 pulling on the rear wall of the elliptical slot 506 which creates a rotational moment about the hinges 510 and 512. As the front portion 366 swings closed following about a 180 degree arc it exposes the roof 356 portion containing a portion of the roadway 354. The light bar 380 pivotally swings down toward the infield 386 as the front portion 366 closes over it.

Upward movement of the yolk 410 also causes the forked end 528 of the second bent arm 526 to pivot about the pin 530 and move vertically up thus causing angular rotation of the arm 526. Thus, the arm 526 moves from being substantially parallel to the base 402 to angling up to preferably but not limited to about a 50 to about a 60 degree angle in relation to the base 402. In this manner, the other end 532 of the arm 526 pivots clockwise about the pin 536 connecting the arm 526 to the pushrod 534 and pulls the pushrod 534 inwardly toward the center of the playset. The elastic band 540 acts to assist the action of pulling up on the tubular member 404 by exerting a pulling force and magnifying the angular rotational moment of the arm 526. Moreover the force exerted by the elastic band 540 serves to lock the arm 526 in its up position. Since the pushrod 534 is mounted to the second portion 398 of the manufacturing facility, the movement of the pushrod 534 causes the second portion 398 to slide inwardly along the tracks 438 and 440 toward the center of the playset thus covering and obscuring a portion of the wind tunnel area 372.

The inward sliding of the second portion 398 causes the fan 400 to pivotally swing up and out of the wind tunnel area 372 by causing the turbine rear wall boss 558 which is rigidly connected to the fan 400 to pivot clockwise about the pin 556. More specifically, the walls of the vertical guide slot 570 in the second base boss 572 hold the inwardly extending pin 568 which is fixedly mounted to the turbine rear wall boss 558 such that as second portion slides inwardly, the pin 568 acts as a crank and a clockwise rotational moment is imparted to the turbine rear wall boss 558 which pivots about the pin 556. The vertical slot 570 allows the pin 568 to be held at a substantially fixed horizontal position while allowing the pin 568 to reciprocate in the slot 570 as the turbine rear wall boss 558 rotates. As the fan 400 swings up along about a 90 degree arc going from substantially parallel to the base 402 to substantially perpendicular to the base 402 and becomes recognizable as the turbine 360, it is also pivotally supported by the turbine front wall boss 578 which pivots about pin 576. As the fan 400 swings up, the top 564 of the end portion 566 of the wind tunnel 392 slides into and is received by corresponding slots 560 and 580.

The inward sliding of the second portion 398 of the manufacturing facility also causes the second side portion 372 containing the bleachers and ramp to flip over, thus exposing a portion of the roof 356 of the low-rise building 350. This is accomplished by the rack 584 riding over the half spur gear 586 as the second portion 398 of the manufacturing facility slides inward thus causing the half gear 586 to rotate counterclockwise. Counterclockwise rotation is imparted to the second side portion 372 through the shaft 588 which is fixedly mounted to the rear edge 590 of the second side portion 372. The rotation of the shaft 588 causes the second side portion 372 to swing closed as it pivots about the hinges 592 and 594 thus traversing an arc of about 180 degrees.

In transforming from the second position to the first position, the rear wall 430 of the first portion 396 of the manufacturing facility and the rear wall 544 of the second portion 398 of the manufacturing facility converge to form a contiguous wall which completely obscures the wind tunnel area 392 from the rear of the playset while the rearmost portion of the front portion 366 swings into and fits between the front wall 450 of the first portion 396 and the front wall 548 of the second portion 398 to form a contiguous facade of the manufacturing facility. At the same time, the first and second side portions 370 and 372 converge and shut to form the contiguous roof 356 along with the front portion 366.

Figure 29:
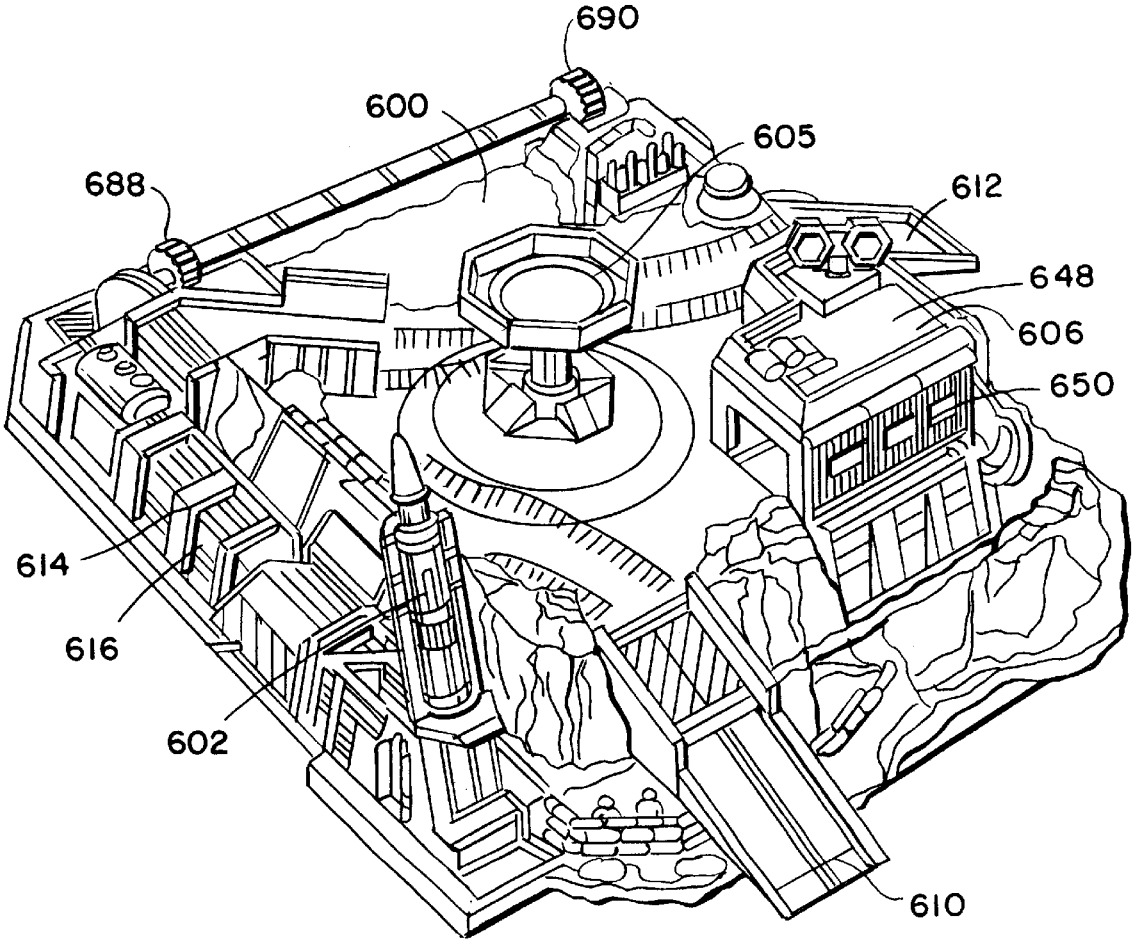
FIG. 29 is a front perspective view of a third embodiment of a transforming playset having fanciful detailing in a first configuration according to the present invention.
Figure 30:
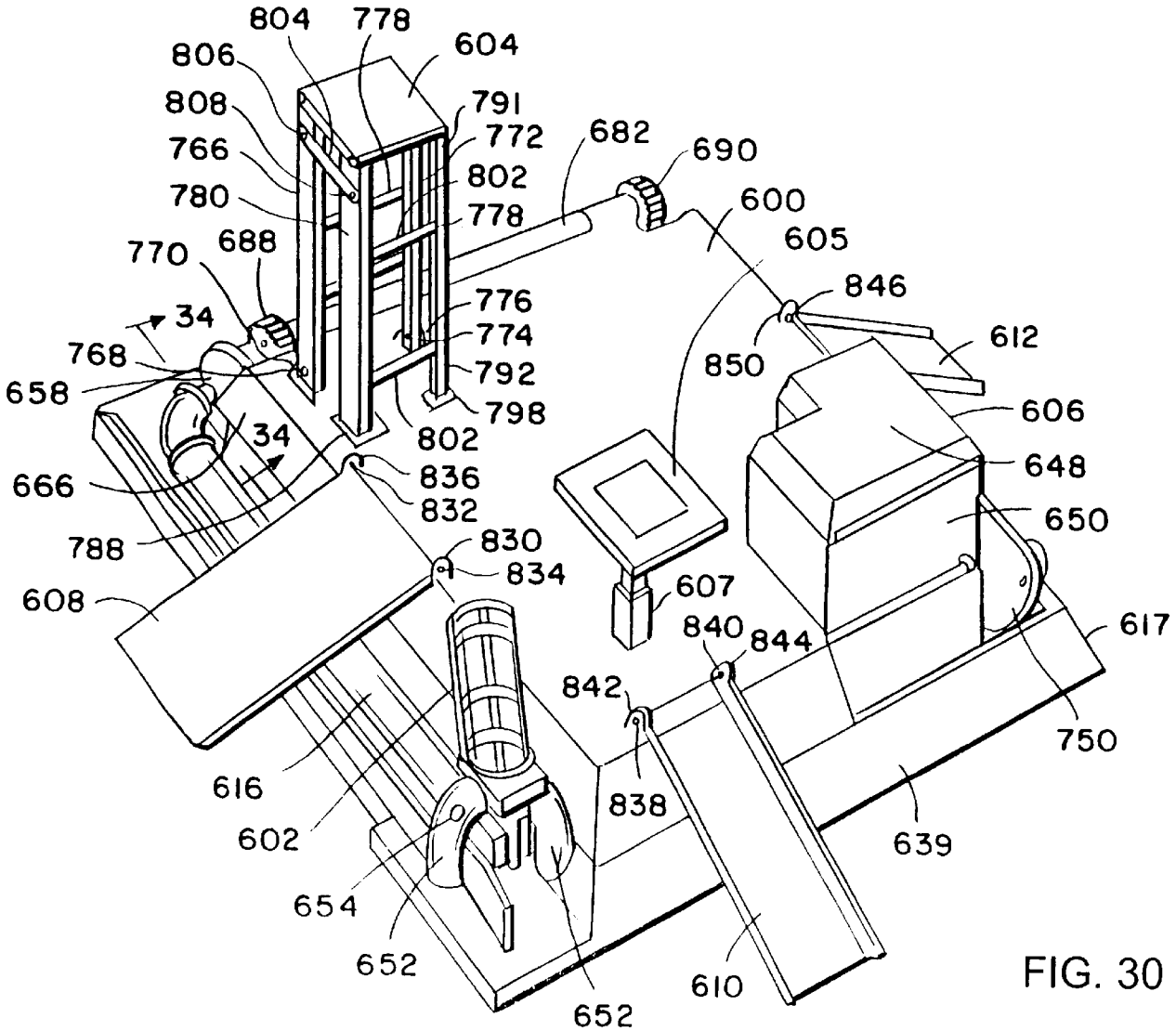
FIG. 30 is a front perspective view of a variation of the third embodiment without fanciful detailing in a first configuration according to the present invention.
Figure 31:
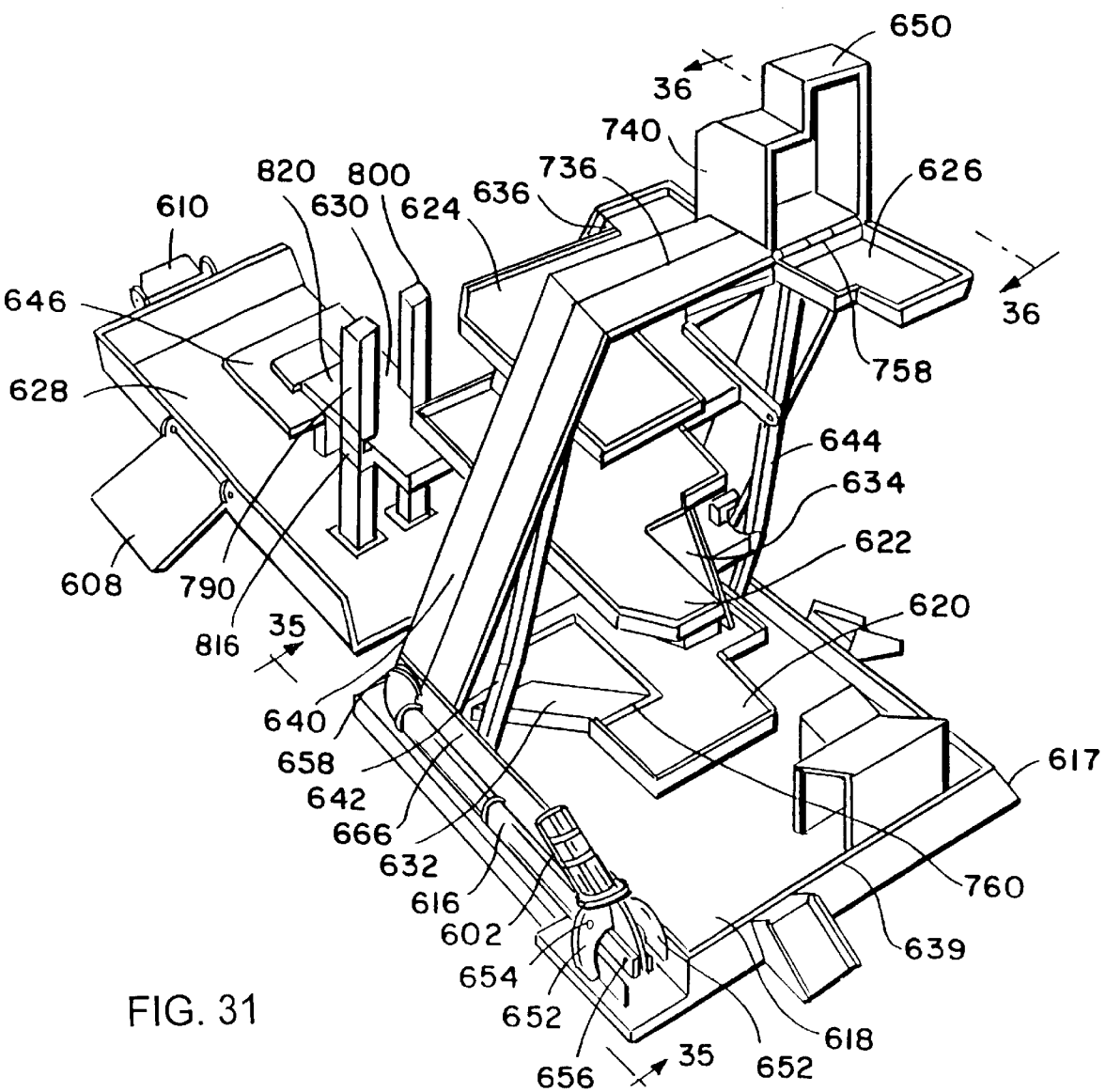
FIG. 31 is a front perspective view of the variation of the third embodiment without fanciful detailing in a second configuration according to the present invention.
Figure 32:
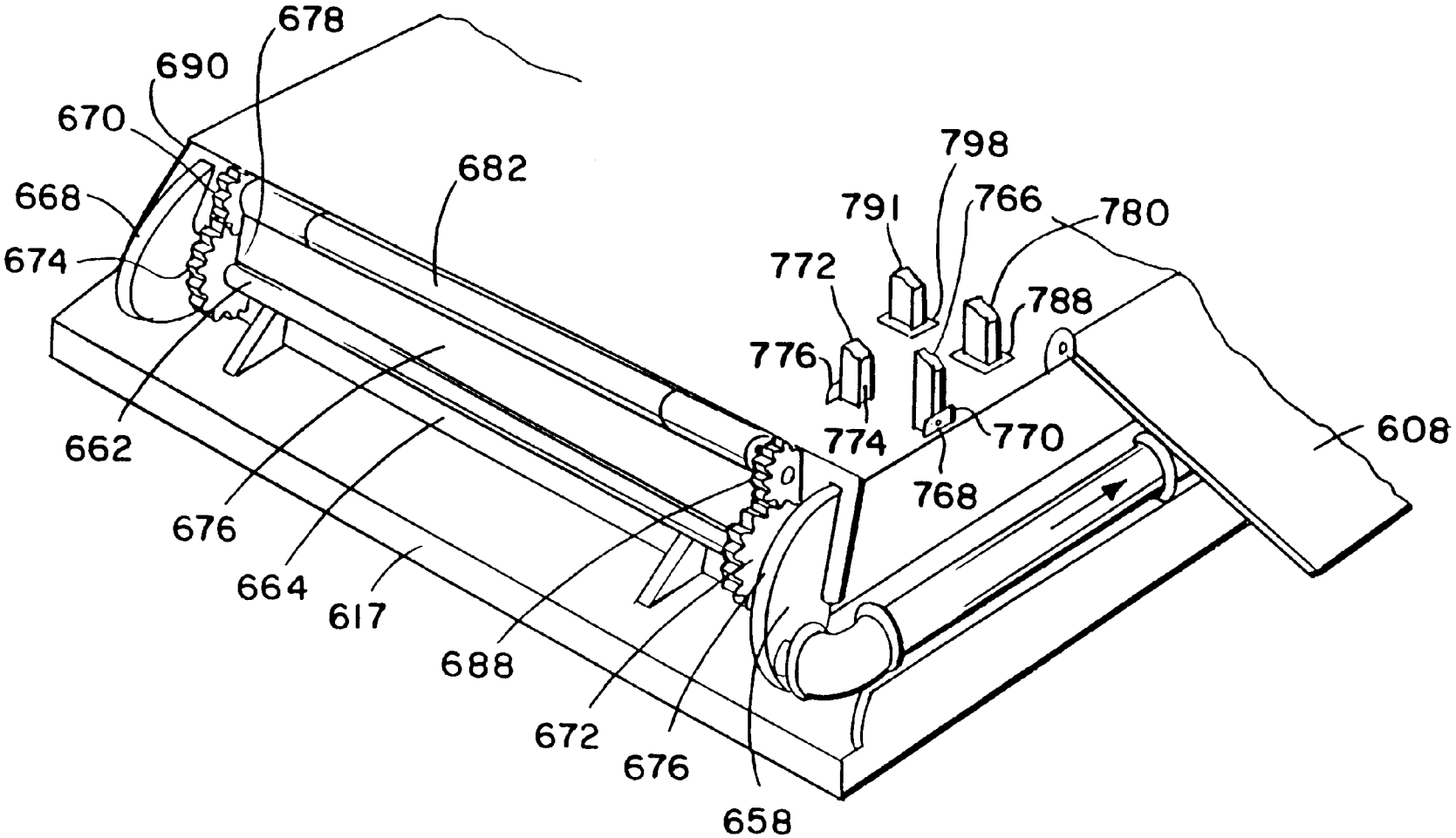
FIG. 32 is a partial rear perspective view of the variation of the third embodiment in first configuration illustrated in FIG. 30.
Figure 33:
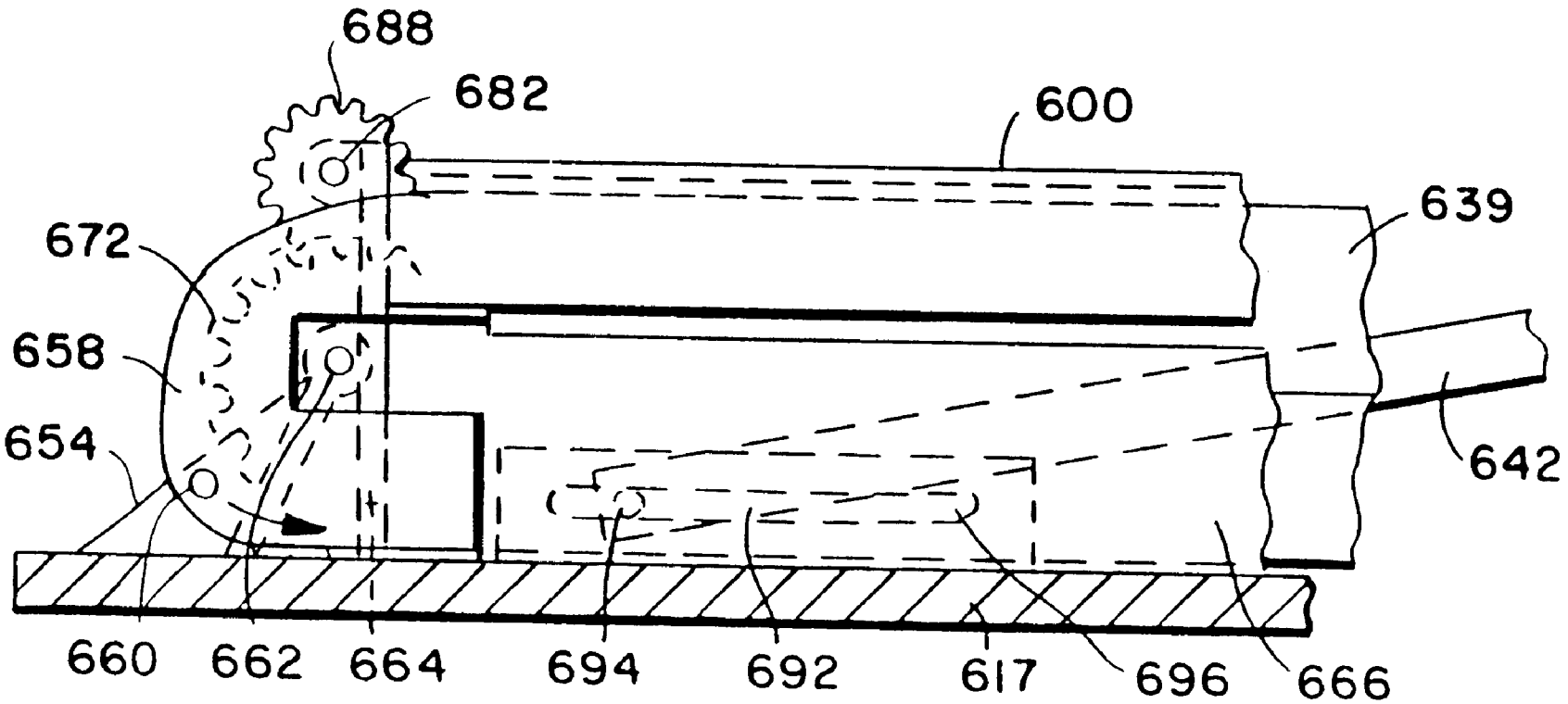
FIG. 33 is a partial side view of a rear portion of the variation of the third embodiment in first configuration taken along line 34—34 illustrated in FIG. 30.

In another embodiment illustrated in FIGS. 29 through 39, manipulation of an actuator connected to configuring means mechanically transforms the playset from an above-ground missile launch site including various associated structures to a multilevel structure environment having platforms successively connected to one another by ramps. Further manipulation of the actuator causes the configuring means to reconfigure the multilevel structure environment back into the above-ground missile launcher site. For convenience, the above-ground missile launch site, which is illustrated in FIGS. 29 and 30, may also be referred to as the first position and the multilevel structure, which is illustrated in FIG. 31, may also be referred to as the second position. FIG. 29 illustrates one variation of the third embodiment having certain fanciful detailing which, although not essential for operation of this embodiment of the present invention, is included to provide an aesthetic aspect. FIGS. 30 through 39 illustrate another variation of the third embodiment without depicting as much fanciful detailing. FIGS. 30 through 38 include certain structures not depicted in FIG. 29. For convenience, corresponding structures in FIGS. 29–38 will be provided with the same reference numbers. For example, a planar top 600 in FIG. 29 corresponds to planar top 600 in FIG. 30.

Turning now to FIGS. 29–31, the missile launch site includes a planar top portion 600, a missile launcher 602, a tower 604, a minitower 605 and a building 606. A first ramp 608 is positioned to provide sloped access to the vicinity of the tower 604, a second ramp 610 is positioned to provide sloped access to the vicinity of the missile launcher 602 and a third ramp 612 is positioned to provide sloped access to the vicinity of the building 606. A frame (not shown in FIGS. 30–39) covers piping 616 along a side of the playset.

Figure 34:
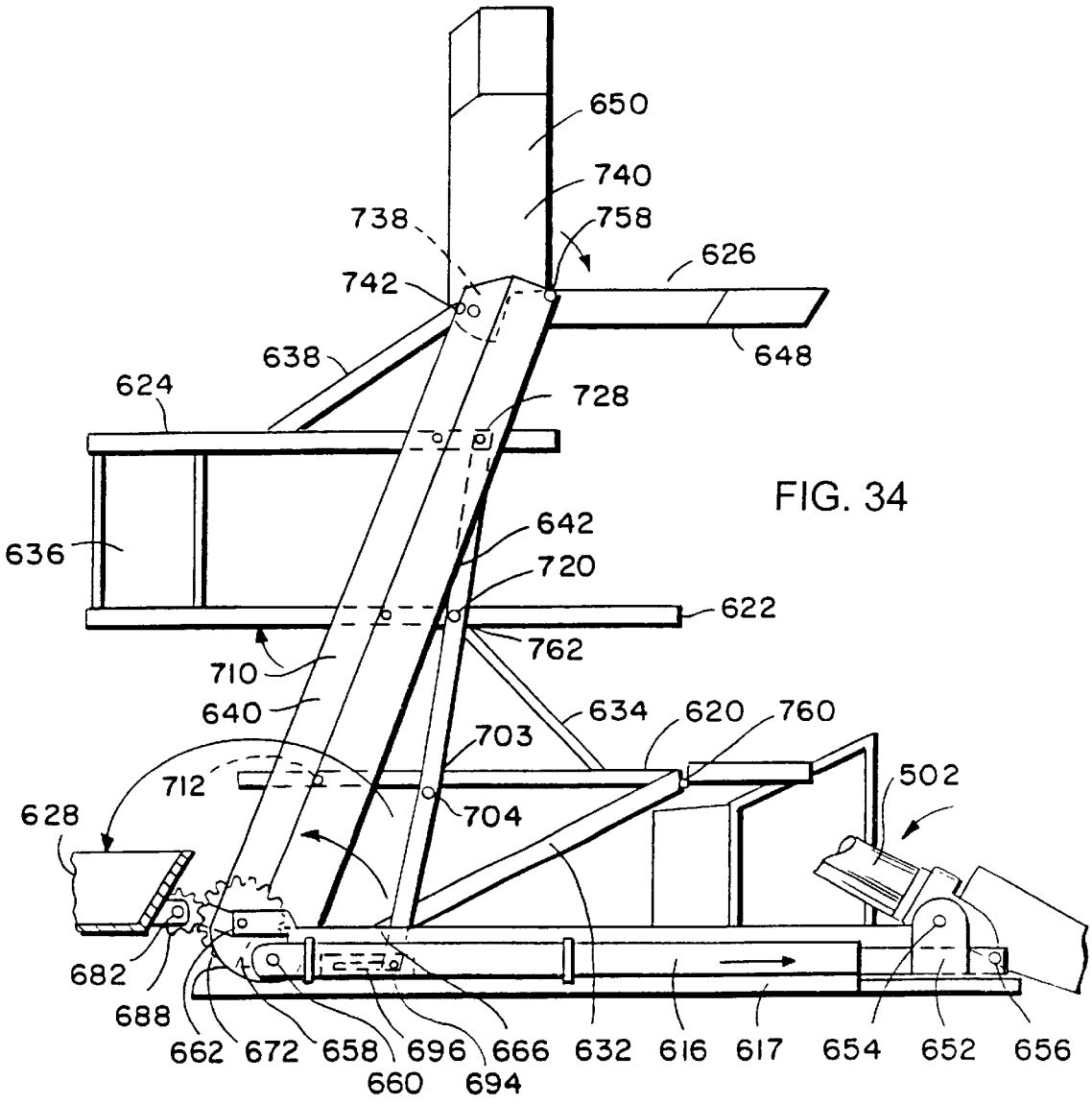
FIG. 34 is a partial side view of the variation of the third embodiment in second configuration taken along line 35—35 illustrated in FIG. 31.
Figure 35:
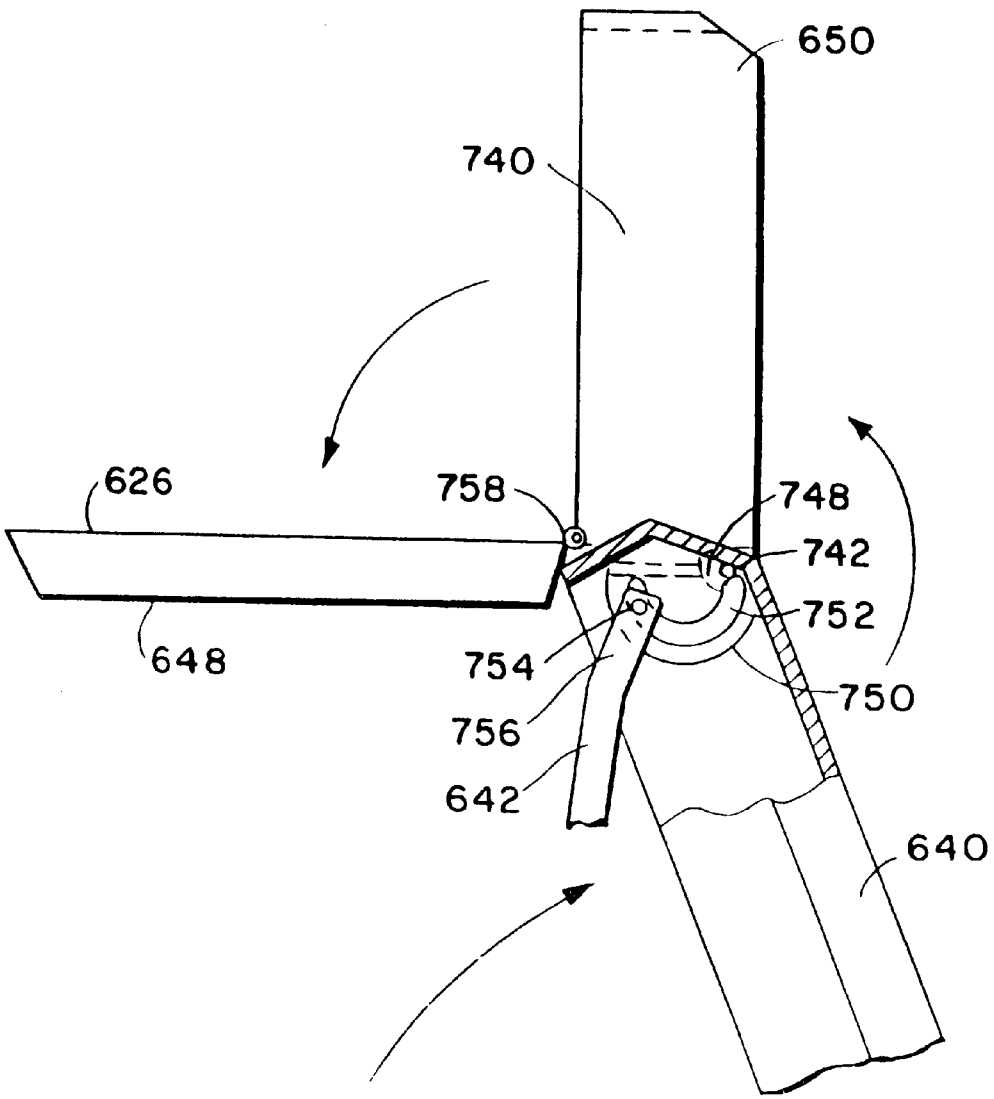
FIG. 35 is a partial side view of an upper portion of the variation of the third embodiment in second configuration taken along line 36—36 illustrated in FIG. 32.
Figure 36:
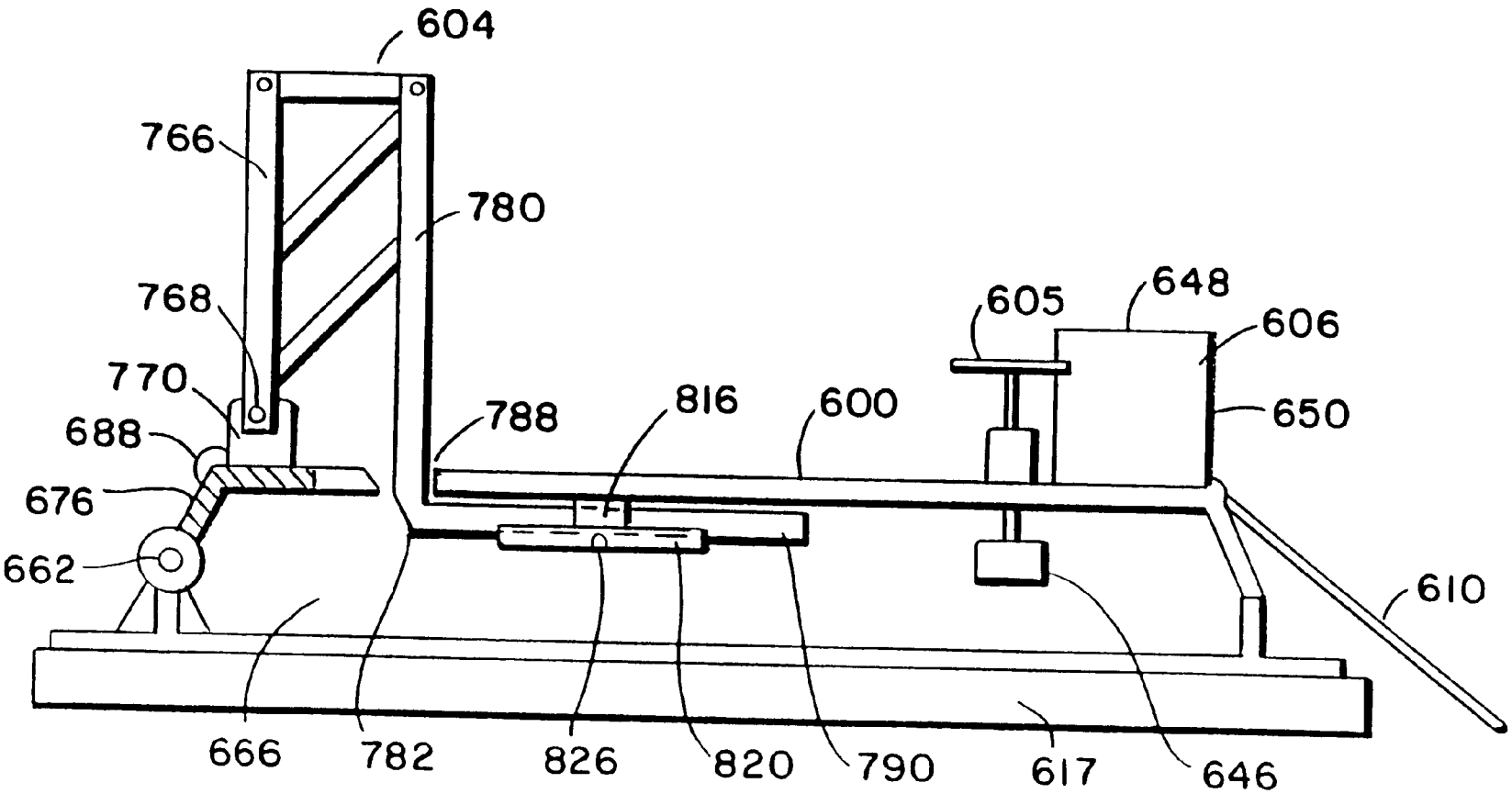
FIG. 36 is a cross-sectional side view of the variation of the third embodiment in first configuration.
Figures 37, 39:
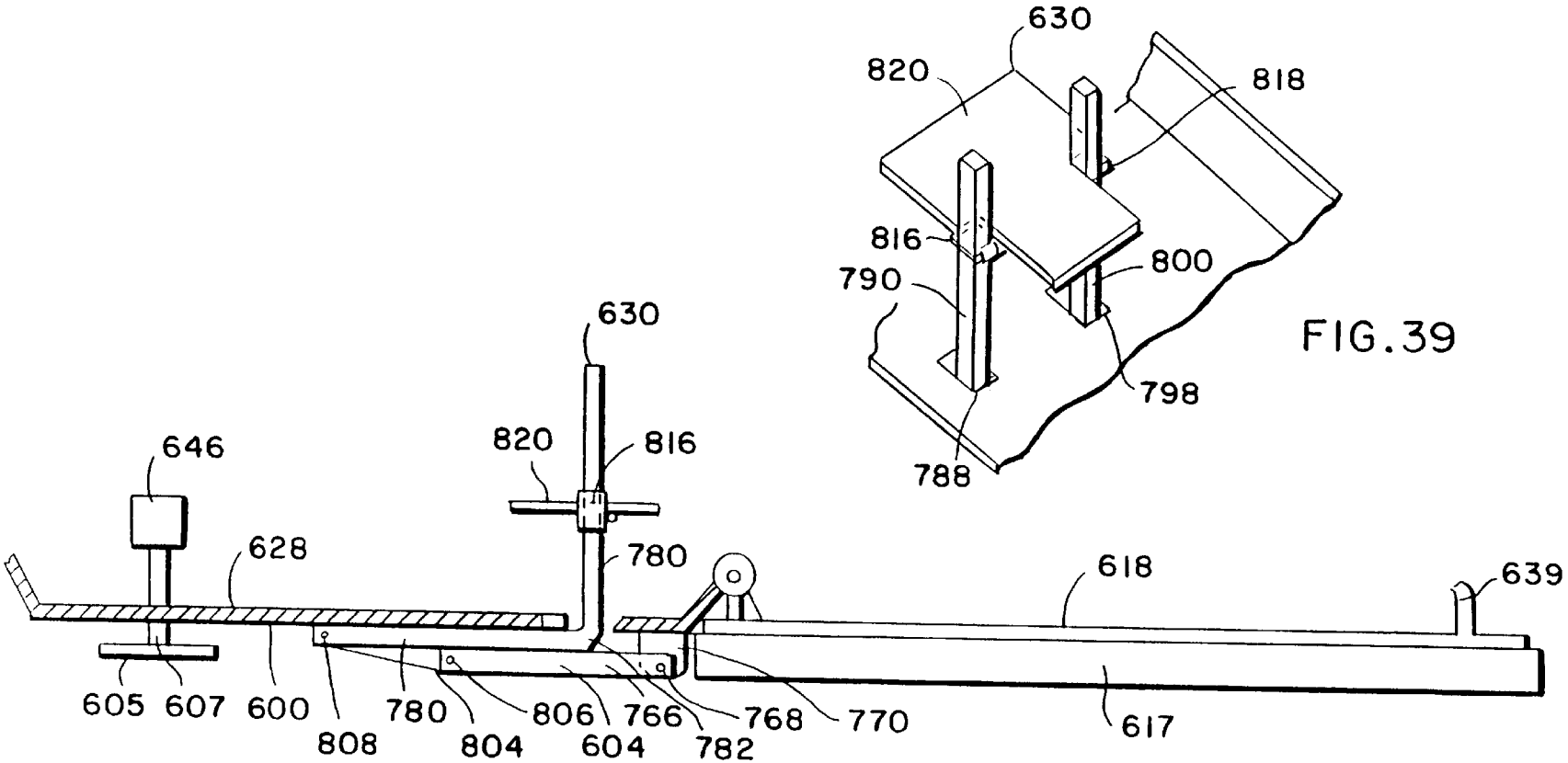
FIG. 37 is a cross-sectional partial side view of the variation of the third embodiment in second configuration.
FIG. 39 is an exploded perspective view of various elements encompassed by the third embodiment.
Figure 38:
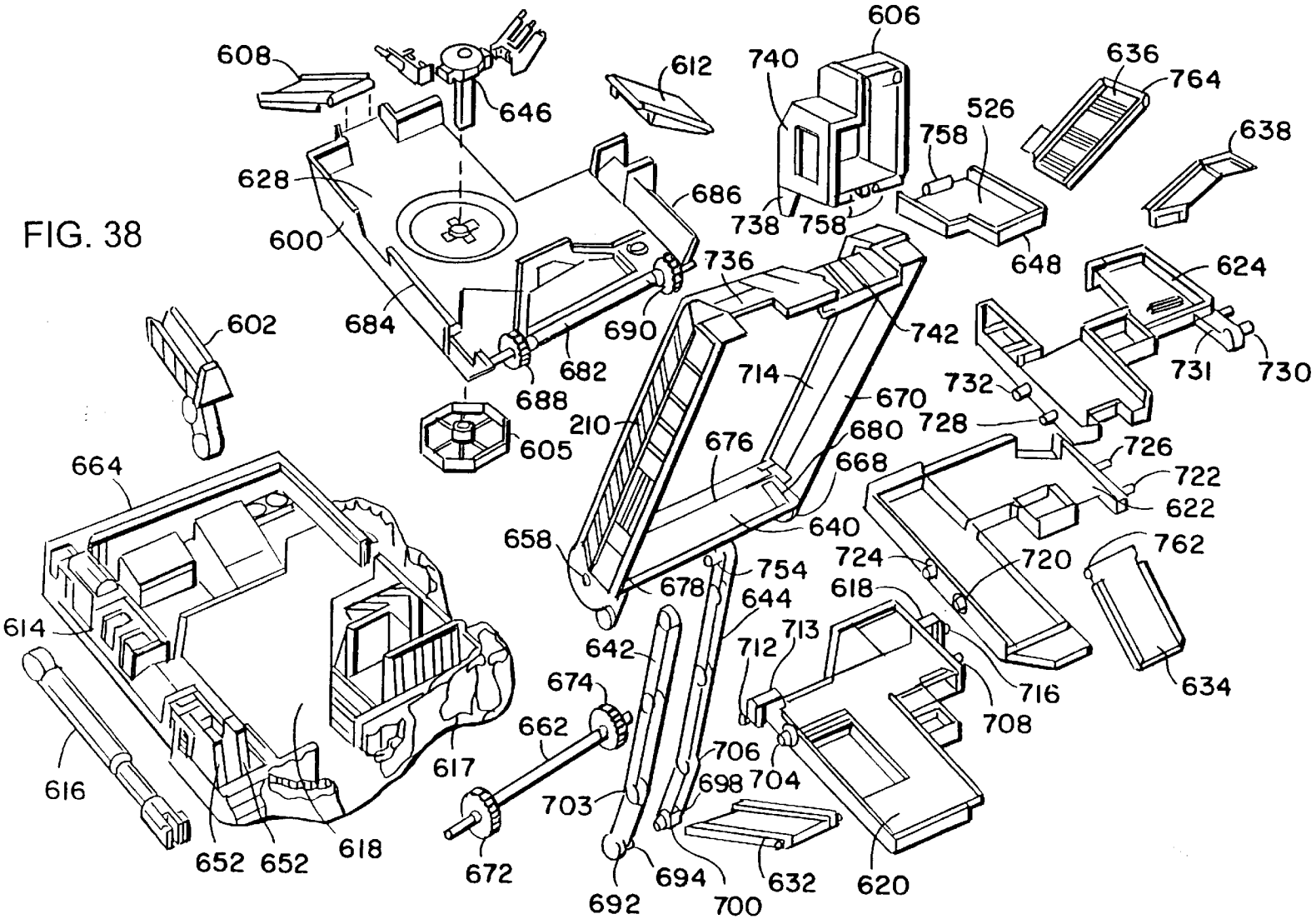
FIG. 38 is a partial perspective view of a portion of the variation of the third embodiment in second configuration.

As illustrated in FIGS. 31 and 34, the multilevel structure includes a base 617 and five tiers: a base tier 618, a first intermediate tier 620, a second intermediate tier 622, a third intermediate tier 624 and a top tier 626. A mezzanine level 628, which is positioned slightly higher than and opposite the base tier 618, is provided with an elevator 630. A series of ramps connect the tiers: a fourth ramp 632 leads from the base tier 618 to the first intermediate tier 620, a fifth ramp 634 leads from the first intermediate tier 620 to the second intermediate tier 622, a sixth ramp 636 leads from the second intermediate tier 622 to the third intermediate tier 624, and a seventh ramp 638 leads from the third intermediate tier 624 to the top tier 626. A beveled frame 639 surrounds and demarcates the base tier 618 within the base 617. A tier frame 640 surrounds and supports tiers 620, 622, 624 and 626. Opposing bent arms 642 and 644 also support tiers 620, 622 and 624. Additional ramps which, as is explained below, correspond to the first ramp 608, second ramp 610 and third ramp 612, provide sloped access to the mezzanine 628. A structure 646 designed and configured to have the appearance of a multiple rocket launcher is slidably mounted transversely to the mezzanine 628. The missile launcher 602, and piping 616 present in the above-ground missile launch site are also visible in the multilevel structure environment.

In this embodiment, the missile launcher 602 is the actuator lever which is pressed to cause transformation from the first position to the second position. During such transformation, the planar top portion 600 pivots up and flips over, thus traversing an arc of about 180 degrees and exposing its underside which is the mezzanine 628. As the top 600 pivots over, the tower 604 collapses laterally against the top 600 and is stored underneath the mezzanine 628 while the elevator 630 is presented perpendicularly to the mezzanine 628. The structure 646 appears to pop up and extend upwardly from the mezzanine 628. At the same time, the frame 640 pivots up out of the base tier 618 as the tiers 620, 622, and 624 rise out of the base tier 618 and unstack while remaining parallel to the base tier 618. When the frame 640 is at about a 45 degree angle relative to the base tier 618, the building 606, which is supported by the frame 640, moves up with the frame 640 and pivots upwardly on the frame 640 becoming substantially perpendicular in relation to the base tier 618. The roof 648 of the building 606 pivotally flips open to become substantially parallel to the base tier 618 and thus form a portion of the top tier 626 while the walls 650 of the building 606 provide an upwardly extending top structure.

In this embodiment, in addition to the above, the actuator and configuring means include a variety of elements more particularly described as follows. The missile launcher actuator 602 is pivotally mounted to a two-pronged support 652 by an actuator support pin 654 which extends through the actuator 602 and held by the prongs of the support 652. The support 652 is fixedly mounted to the base 617. The actuator 602 is pivotally connected by a first pushrod pin 656 to the pushrod 616 designed and configured, for example and in this instance, to have the appearance of piping. The pushrod 616 extends between the beveled frame 639 and an edge along the top of the base 617 surrounded by a frame (not shown) until it pivotally mates with the lower portion of a tier frame support pivot boss 658. A pin 660 maintains a pivotal connection between the pushrod 616 and the lower portion of the first tier frame support pivot boss 658. The first tier frame support pivot boss 658 extends between and bisects the corner where a first wall 664 of the beveled frame 639 meets a second wall 666 of the beveled frame 639. A tier frame support pivot boss mounting rod 662 is fixedly mounted to and extends along the top of the first wall 664 of the beveled frame 639 where one end of mounting rod 662 perpendicularly pivotally intersects with, supports and continues through a central portion of the first tier frame support pivot boss 658, terminating where it fixedly intersects with the second wall 666 of the beveled frame 639. The other end of the mounting rod 662 perpendicularly pivotally intersects with, supports and continues through the central portion of a second tier frame support pivot boss 668. The second tier frame support pivot boss 668 extends between and bisects the comer where the first wall 664 of the beveled frame 639 meets a third wall 670 of the beveled frame 639. The mounting rod 662 terminates where it fixedly intersects with the third wall 670 of the beveled frame 639.

A first fixed spur gear 672 is mounted perpendicularly to the first wall 664 of the beveled frame 639 adjacent to the first tier frame support pivot boss 658 such that the mounting rod 662 intersects and passes through the central portion of the first gear 672. A second fixed spur gear 674 is mounted perpendicularly to the first wall 664 of the beveled frame 639 adjacent to the second tier frame support pivot boss 668 such that the mounting rod 662 intersects and passes through the central portion of the second gear 674. The first and second gears 672 and 674 are of substantially equal size.

The first and second tier frame support pivot bosses 658 and 668 are fixedly mounted to opposite ends of a first wall 676 of the tier frame 640 thus providing the pivoting mount for the tier frame 640. The first tier frame wall 676 is located adjacent to the first wall 664 of the beveled frame 639 and arcs over it when pivoting. The pivotally mounted tier frame 640 is smaller than the beveled frame 639 and is designed and configured to fit within the confines of beveled frame 639 when in the first position. The first wall 676 contains first and second slots 678 and 680 designed and configured to receive the first and second fixed gears, respectively, thus allowing the tier frame 640 to pivot over them without interference.

The planar top portion 600 is pivotally attached to the first tier frame wall 676 by a rod 682 which is fixedly mounted to first and second sides 684 and 686, the portion between the two sides 684 and 686 being cut out to receive a portion of the first tier frame wall 676, the portion adapted to receive the rod 682 and form a hinge. A third spur gear 688 is fixedly mounted perpendicular to the outside edge of the first side 684 such that its teeth mesh with the teeth of the first fixed spur gear 672 to create a planetary gear arrangement, i.e., pivoting movement of the tier frame 640 causes the third gear 688 to rotate around the first gear 672. A fourth spur gear 690 is fixedly mounted perpendicular to the outside edge of the second side 686 such that its teeth mesh with the teeth of the second fixed spur gear 674 to create a planetary gear arrangement, i.e., pivoting movement of the tier frame 640 causes the fourth gear 690 to rotate about the second gear 674. The third and fourth gears 688 and 690 are the same size but smaller than the first and second gears 572 and 574. In this manner, since the top 500 is attached to the tier frame 640, the top pivots at the same time and in the same direction as the tier frame 640, but the arc traveled by the top 600 is amplified by the planetary gear arrangement,i.e., the top 600 covers a proportionately larger arc than the tier frame 640.

The first, second and third intermediate tiers 620, 622 and 624 are pivotally mounted to the tier frame 640 and to the opposed first and second bent arms 642 and 644. A first end 692 of the first bent arm 642 is slidably and pivotally mounted by a pin 694 to a first guide slot member 694 which is mounted perpendicularly to the base tier 618 interiorly adjacent to the second beveled frame wall 666. The pin 694 is fixedly mounted to the first bent arm perpendicular to its first end 692 thus projecting outwardly into the slot of the first guide slot member 696. A first end 698 of the second bent arm 644 is slidably and pivotally mounted by a pin 700 to a second guide slot member 702 (not shown) which corresponds to the first guide slot member 594 is mounted perpendicularly to the base tier 518 interiorly adjacent to the third beveled frame wall 570. The pin 700 is fixedly mounted to the second bent arm 544 perpendicular to its first end thus projecting outwardly into the slot of the guide slot member 702.

A first side of the first intermediate tier 620 is pivotally mounted transversely to the bent portion 703 of the first bent arm 642 by a pin 704 which is fixedly mounted to and coplanar with the first tier 620. Correspondingly, the other side of first tier 620 is pivotally mounted transversely to the bent portion 706 of the second bent arm 644 by a pin 708 which is fixedly mounted to and coplanar with the first tier 620. The first side of the first tier 620 is further pivotally mounted transversely to a second wall 710 of the tier frame 640 by a pin 712 which is fixedly mounted to the outer side of a first U-shaped member 713 rigidly attached to the first tier 620 such that the pin 712 is coplanar with the first tier 620. Correspondingly, the other side of the first tier 620 is pivotally mounted transversely to a third wall 714 of the tier frame 640 by a pin 716 which is fixedly mounted to the outer side of a second U-shaped member 718 rigidly attached to the first tier 620 such that the pin 716 is coplanar with the first tier 620. The U-shaped members 713 and 718 are designed and configured to receive the first and second bent arms 642 and 644, respectively, when the playset is in the first position.

A first side of the second intermediate tier 622 is pivotally mounted transversely to the first bent arm 642 by a pin 720 which is fixedly mounted to and coplanar with the second tier 622. Correspondingly, the other side of the second tier 622 is pivotally mounted transversely to the second bent arm 644 by a pin 722 which is fixedly mounted to and coplanar with the second tier 622. The first side of the second tier 622 is further pivotally mounted transversely to the second wall 710 of the tier frame 640 by a pin 724 which is fixedly mounted to and coplanar with the second tier 622. Correspondingly, the other side of the second tier 622 is pivotally mounted transversely to the third wall 714 of the tier frame 640 by a pin 726 which is fixedly mounted to and coplanar with the second tier 622.

A first side of the third intermediate tier 624 is pivotally mounted transversely to the first bent arm 642 by a pin 728 which is fixedly mounted to and coplanar with the third tier 624. Correspondingly, the other side of the third tier 624 is pivotally mounted transversely to the second bent arm 644 by a pin 730 which is fixedly mounted to a leg 731 attached coplanarly to the third tier 624 such that the pin 730 is also coplanar with the third tier 624. The first side of the third tier 624 is further pivotally mounted transversely to the second wall 710 of the tier frame 640 by a pin 732 which is fixedly mounted to and coplanar with the third tier 624. Correspondingly, the other side of the third tier 624 is pivotally mounted transversely to the third wall 714 of the tier frame 640 by a pin 734 which is fixedly mounted to the leg 731 such that the pin 734 is coplanar with the third tier 624.

The building 606 reversibly transforms into the top tier 626. The building 606 is pivotally attached to a fourth wall 736 of the tier frame 640 as follows: a first building boss 738 is rigidly mounted to a first wall 740 of the building 606. The first building boss 738 is received by a rectangular cut-out portion 742 in the fourth wall 736. A building support pivot rod 744 is rigidly mounted to the first building boss 738; the rod 742 passing through a first frame boss 746 (not shown) rigidly mounted to the tier frame 640; the rod 742 extending parallel to the fourth wall 736 and passing through a second frame boss 748 and terminating in a rigid mounting to a second building boss 750. The second building boss 750 is provided with an elliptical slot 752 which is designed and configured to receive and guide a pin 754 fixedly mounted transversely to the second end 756 of the second bent arm 644. The building roof 648 is pivotally mounted to the first building wall 740 by a hinge 758.

The fourth ramp 632 which provides a slope leading from the base tier 618 to the first tier 620 is pivotally attached to the first tier 620 by a hinge 760. The fifth ramp 634 which provides a slope leading from the first tier 620 to the second tier 622 is pivotally attached to the second tier 622 by a hinge 762. The sixth ramp 636 which provides a slope leading from the second tier 622 to the third tier 624 is pivotally attached to the third tier 624 by a hinge 764. The seventh ramp 638 which provides a slope leading from the third tier 624 to the top tier 626 is fixedly attached to the third tier 624. The seventh ramp 638 is hidden within the building 606 when the playset is in the first position and becomes substantially contiguous with the top tier 626 in the second position.

The tower 604 includes four structural posts which are pivotally mounted to the top portion 600. A first post 766 is pivotally mounted by a pin 768 to a first top tower boss 770 which is rigidly mounted transversely to the top 600 near the third spur gear 688. A second post 772 is pivotally mounted by a pin 774 to a second top tower boss 776 which is rigidly mounted transversely to the top 600. The first and second posts 766 and 772 are fixedly connected to each other by cross members 778. A third post 780 which is a first leg of a first L-shaped member 782 extends transversely from the top 600 near the first ramp 608. The third post 780 continues through the top 600 through a first aperture 788 situated in the top 600 where it intersects a second leg 790 of the first L-shaped member 782. A fourth post 791 which is a first leg of a second L-shaped member 792 extends transversely from the top 600. The fourth post 791 continues through the top 600 through a second aperture 798 situated in the top 600 where it intersects with a second leg 800 of the second L-shaped member 792. The third and fourth posts 780 and 791 are fixedly connected to each other by cross members 802.

The first and third posts 766 and 780 are pivotally connected to each other by a first arm 804 having a first pin 806 mounted at one end and a second pin 808 mounted at the other end. The first pin 806 is pivotally mounted to the end of the first post 766 and the second pin is pivotally mounted to the end of the third post 780. The second and fourth posts 772 and 790 are pivotally connected to each other by a corresponding second arm 810 (not shown) having a first pin 812 (not shown) mounted at one end and a second pin 814 (not shown) mounted at the other. The first pin 812 is pivotally mounted to the end of the second post 772 and the second pin 814 is pivotally mounted to the end of the fourth post 790.

The second leg 790 of the first L-shaped member 782 and the second leg 800 of the second L-shaped member 792 constitute the first and second elevator posts, respectively, of the elevator 630. A first frictionally engaged slidable member 816 conforms to and fits snugly around the first elevator post 890 and a second frictionally engaged slidable member 818 conforms to a fits snugly around the second elevator post 800. A pivotable platform 820 is connected to corresponding first and second pivot pin acceptors 822 and 824 (not shown) contained in first and second slidable members 816 and 818 respectively, by first and second pivot pins 826 and 828 (not shown), respectively, and spans the distance between the first elevator post 790 and the second elevator post 800.

The minitower 605 is slidably mounted within a housing 607 that is fixedly mounted perpendicular to the top 600. The housing 607 forms an opening in the top 600 where it is mounted to the top. The minitower 605 extends through the opening where it mates coaxially with the structure 646. The other end of the minitower 605 is a planar rectangular member which prevents the minitower from sliding through the housing 607. Similarly, the structure 646 is designed and configured to have a portion which is wider than the opening and will thus be prevented from passing through. The first, second and third ramps 608, 610 and 612 are pivotally situated on the top 600. The first ramp 608 is pivotally mounted by first and second pins 830 and 832 to first and second top ramp bosses 834 and 836, respectively. The second ramp 610 is pivotally mounted by first and second pins 838 and 840 to third and fourth top ramp bosses 842 and 844, respectively. The third ramp 612 is pivotally mounted by first pin 846 and a second pin 848 (not shown) to a fifth top ramp boss 850 and a sixth top ramp boss 852 (not shown), respectively.

In operation, transformation from the first position to the second position is initiated by pressing down the missile launcher actuator 602 which pivots counterclockwise about the actuator support pin 654 thus pulling back on the pushrod 616. As the pushrod 616 is pulled back, it pulls back on the lower portion of the tier frame support pivot boss 658 via pin 660 which acts a crank, causing the tier frame support pivot boss 658 to rotate counterclockwise about the pivot boss mounting rod 662. Since the pivot boss 658 is rigidly connected to the tier frame 640 counterclockwise rotation is transmitted to the tier frame 640 causing it to swing upwardly with the mounting rod 662 acting as a fulcrum. The second tier frame support pivot boss 668 also rotates counterclockwise about the mounting rod 662 and acts to stabilize and guide the tier frame 640 as it swings upwardly.

As the tier frame 640 swings upwardly, the first tier frame wall 676 arcs over the first wall 664 of the beveled frame 639. Since the first tier frame wall 676 is hingedly connected to the top portion 600, planetary rotation of the third and fourth gears 688 and 690 around the first and second gears 672 and 674, respectively causes the top 600 to pivotally flip open along with the tier frame 640. However, the top 600 opens a proportionately greater amount than the tier frame 640, i.e., the tier frame 640 subtends an arc of about 70 degrees while causing the top 600 to subtend an arc of about 180 degrees due to planetary rotation and gearing ratio. As the top 600 flips over and presents the mezzanine 628, the first, second, and third ramps 608, 610, and 612, which had initially sloped from the top 600 down, pivot about their respective pivot mounts, such that when the top 600 is completely open, i.e., it has swung 180 degrees and the mezzanine 628 is parallel with the base 617, the ramps 608, 610 and 612 slope downwardly from the mezzanine 628.

As the top 600 pivots and becomes perpendicular to the base 617, the tower 604 becomes parallel to the base 617 and on further pivoting, the tops of the first and second posts 766 and 772 contact the surface upon which the playset rests. The pressure of such contact on the first and second posts 766 and 772 causes the first and second posts 766 and 772 to pivotally collapse toward the third and fourth posts 780 and 790. Simultaneously, the first and second elevator posts 790 and 800 are forced to become perpendicular to the mezzanine 628 thus presenting the upright elevator 630. The platform 820 which is held parallel and adjacent to the underside of the top 600 in the first position, pivots about pins 826 and 828 to remain parallel to the mezzanine 628 as the elevator posts 790 and 800 become perpendicular to the mezzanine 600. The elevator platform 820 may then be moved up and down by grasping and pushing against it thus causing the first and second frictionally engaged slidable members 816 and 818 to move.

As the top 600 flips over and approaches its complete 180 degree arc, the minitower 605 contacts the surface upon which the playset is placed and is forced to slide up until the protuberance 609 contacts the housing 607 and prevents further movement of the minitower 605. In this manner, the minitower 605 acts as a break and then a support for the mezzanine 628. At the same time, the structure 646 is propelled upward by the sliding minitower 605.

Upward swinging of the tier frame 640 also causes the first, second, third, and top tiers 620, 622, 624, and 626 to become fully articulated. More particularly, the first ends 692 and 698 of the first and second bent arms 642 and 644 slide away from the first wall 664 of the beveled frame 639, as they are guided by the cam follower relationship of the slots 696 and 702 and pins 694 and 700, respectively. As the tier frame 640 swings upwardly, thus pulling the first and second bent arms 642 and 644 to swing upwardly, the pivotal relationships described above between each respective tier, the tier frame 640 and the first and second bents arms 642 and 644, cause the tiers 620, 622, and 624 to remain parallel with the base tier 618 while rising and separating from each other. As the tiers 620, 622, and 624 rise and separate, the ends of the fifth, sixth and seventh ramps 632, 634, and 636 that are pivotally attached to their respective tiers also rise up while the unattached ends slide along the tiers located respectively below them to maintain sloped contact between successive tiers.

As the tier frame 640 swings up, the pin 754 mounted at the second end 756 of the second bent arm 644 pulls down on a first end 854 of the elliptical slot 752 in the second building boss 750, thus causing the building boss 750 to pivot about the axis of the building support pivot rod 744, thus causing the building 606 to pivot upwardly with the building support pivot rod 744 acting as a fulcrum. As the building 606 pivots, the pin 754 slides relative to elliptical slot 752 and thus guides the building 606 to a perpendicular aspect relative to the base tier 618. The momentum generated by the pivoting building 606 causes the building roof 648 to pivotally flip open about the hinge 758 when the tier frame 640 stops pivoting. The open roof 648 is substantially parallel to the base tier 618 in the second position.

Transformation from the second position to the first position is initiated by lifting the missile launcher actuator 602 which pivots clockwise about the actuator support pin 654 thus pushing on the pushrod 616. As the pushrod 616 is pushed forward, it pushes on the lower portion of the first tier frame support pivot boss 658 via the pin 660 which acts as a crank, causing the tier frame support pivot boss 658 to rotate clockwise about the pivot boss mounting rod 662. Since the pivot boss 658 is rigidly connected to the tier frame 640 clockwise rotation is transmitted to the tier frame 640 causing it to swing downwardly with the mounting rod 662 acting as a fulcrum. The second tier frame support pivot boss 668 also rotates clockwise about the mounting rod 662 and acts to stabilize and guide the tier frame 640 as it swings downwardly.

As the tier frame 640 swings downwardly, the first tier frame wall 676 arcs over the first wall 664 of the beveled frame 639. Since the first tier frame wall 676 is hingedly connected to the top portion 600/mezzanine 628, clockwise planetary rotation of the third and fourth gears 688 and 690 around the first and second gears 672 and 674, respectively, causes the top 600/mezzanine 628 to flip closed along with the tier frame 640. However, the top 600/mezzanine 628 closes a proportionately greater amount than the tier frame 640, i.e., the tier frame 640 subtends an arc of about 70 degrees while causing the top 600/mezzanine 628 to subtend an arc of about 180 degrees due to planetary rotation and gearing ratio.

Downward swinging of the tier frame 640 causes the first and second bent arms 642 and 644 to swing downwardly while the first ends 692 and 698 of the first and second bent arms 642 and 644 slide back toward the first wall 664 of the beveled frame 639 as they are guided by the cam follower relationship between the slots 696 and 702 and the pins 694 and 700, respectively. As the tier frame 640 swings downwardly, the pivotal relationships described above between each respective tier, the tier frame 640, and first and second bent arms 642 and 644 cause the tiers 620, 622, and 624 to remain parallel with the base tier 618 while collapsing toward one another. As the playset closes, the tier frame 640 nests within the beveled frame 639 while the tiers nest one on top of the other within the beveled frame 639. The fifth, sixth and seventh ramps pivot and become parallel to the nesting tiers. The first and second bent arms 642 and 644 are received by first and second U-shaped members 713 and 718, respectively as they nest within the beveled frame 639.

As the tier frame 640 swings down, the pin 754 mounted at the second end 756 of the second bent arm 644 slides in the elliptical slot 752 in the second building boss 750, thus causing the building boss 750 to pivot about the axis of the building support pivot rod 744, thus causing the building 606 to pivot downwardly with the building support pivot rod 744 acting as a fulcrum. As the building 606 pivots, the pin 754 slides relative to the elliptical slot 752 and thus guides the building 606 to an aspect parallel to the plane of the tier frame 640. The building roof 648 is brought up as the building 606 pivots downwardly until it is about perpendicular relative to the base tier 618. At that point gravity pulls the roof 648 shut as the roof 648 pivots about the hinge 758.

As the top 600 flips over and conceals the mezzanine 628, the first, second, and third ramps 608, 610 and 612, which had sloped from the mezzanine 628 down, pivot about their respective pivot mounts such that when the top 600 is fully closed, i.e., it has swung 180 degrees, the ramps 608, 610, and 612 slope downwardly from the top 600. As the top 600 flips closed, the structure 646 contacts the third tier 624 which is nesting parallel to the base tier 618 and within the tier frame 640 and beveled frame 639 and is pushed up, thus pushing the minitower 605 up in the housing 607.

Upward movement of the top 600 lifts the collapsed tower 604 off the ground. In this manner, gravity pulls the tower 604 open as posts 766 and 772 pivot away from posts 780 and 791 while the mezzanine 628 rises up to meet the elevator platform 820. Contact between the mezzanine 628 and platform 820 causes the platform 820 to pivot about pins 826 and 828 and become parallel to the elevator posts 790 and 800. Thus, as the top 600 arcs upwardly, gravity begins to pull the opening tower 600 toward a perpendicular position in relation to the top 600 which causes the elevator 630 to arc towards the mezzanine 628. The elevator becomes parallel with the mezzanine 628 and ultimately nests against the third tier 624.

The above disclosure of embodiments and examples should not be considered as limiting the invention disclosed herein, but rather as exemplary. For example, ropes and pulleys may be included or substituted for pushrods and gears, or gears may be substituted or added to actuator assemblies. Indeed, it is contemplated that any number of changing environments containing one or a plurality of transformable or fixed structures may be substituted for the examples given herein. Consequently, modifications may be made by those with skill in the art that are within the scope of the following claims.

What is claimed is:

1. A transformable playset comprising:

a first three-dimensional structure which defines at least two planes configurable into at least a second three-dimensional structure which defines at least two non-parallel planar surfaces;

a third three-dimensional structure which defines at least two non-parallel planar surfaces; configurable into at least a fourth simulated three-dimensional structure which defines at least two non-parallel planar surfaces;

and a single actuator capable of being manipulated along a range of motion, the actuator connected to a first configuring means and to a second configuring means, wherein when the actuator is reversibly manipulated from one end to the other end of its range of motion, the first configuring means causes the first three-dimensional structure which defines at least two planes to be configured into the at least a second three-dimensional structure which defines at least two planes having a different orientation and shape than the first three-dimensional structure, the second configuring means causes the third three-dimensional structure which defines at least two planes to be configured into the at least a fourth three-dimensional structure having a different orientation and shape than the third three-dimensional structure.

2. A transformable playset according to claim 1 wherein the first three-dimensional structure is a first building and the second three-dimensional structure is a second building.

3. A transformable playset according to claim 1 wherein the third three-dimensional structure is a first tower and the fourth three-dimensional structure is a second tower.

4. A transformable playset according to claim 1 wherein the actuator is a lever pivotally connected to a pushrod.

5. A transformable playset according to claim 1 wherein the first configuring means includes at least first pivoting means that cooperates with the actuator to cause the first three-dimensional structure to swing up thereby revealing a hidden face of the structure.

6. A transformable playset according to claim 1 wherein the second configuring means includes a rotatable base that cooperates with the actuator, at least one first pivoting arm that depends from the rotatable base, at least one second pivoting arm that depends from the at least one first pivoting arm, such that rotation of the rotatable base causes the at least first pivoting arm to cause the at least second arm to pivot upwardly.

7. A transformable playset according to claim 5 wherein the configuring means further includes an openable roof depending from at least second pivoting means which cooperates with the first pivoting means to cause the roof to open as the first three-dimensional structure swings up.

8. A transformable playset comprising:

a single actuator capable of being manipulated along a range of motion, the actuator connected to a building structure having component parts configured to be reversibly transformable between a first three-dimensional building structure which defines at least two non-parallel planar surfaces and a second three-dimensional building structure which defines at least two non-parallel planar surfaces;

wherein a first manipulation of the actuator to the end of its range of motion, causes the first three-dimensional building structure transformed into the second three-dimensional building structure having a different orientation and shape than the first three-dimensional building structure and a second manipulation of the actuator to its other end of motion range causes the second three-dimensional structure to be transformed into the first three-dimensional building structure.

9. A transformable playset comprising a three-dimensional structure at least two non-parallel planar surfaces and including configuring means depending from an actuator on the base capable of being manipulated along a range of motion, such that actuation of the configuring means with the actuator to the end of the actuator's range of motion causes the three-dimensional structure to reversibly transform from the appearance of a first environment with two non-parallel planar surfaces to the appearance of a second environment with two non-parallel planar surfaces, the enviroments having a different orientation and shape from each other.

* * * * *